US007033717B2

(12) United States Patent
Kojima et al.

(10) Patent No.: US 7,033,717 B2
(45) Date of Patent: Apr. 25, 2006

(54) PROCESS FOR PRODUCING ELECTROPHOTOGRAPHIC PHOTOSENSITIVE MEMBER, AND ELECTROPHOTOGRAPHIC PHOTOSENSITIVE MEMBER AND ELECTROPHOTOGRAPHIC APPARATUS MAKING USE OF THE SAME

(75) Inventors: Satoshi Kojima, Shizuoka (JP); Toshiyuki Ehara, Kanagawa (JP); Hideaki Matsuoka, Shizuoka (JP); Junichiro Hashizume, Shizuoka (JP); Ryuji Okamura, Shizuoka (JP); Koji Hitsuishi, Shizuoka (JP); Hironori Ohwaki, Shizuoka (JP); Kazuto Hosoi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 263 days.

(21) Appl. No.: 10/630,772

(22) Filed: Jul. 31, 2003

(65) Prior Publication Data

US 2005/0153223 A1 Jul. 14, 2005

(30) Foreign Application Priority Data

| | | |
|---|---|---|
| Aug. 2, 2002 | (JP) | 2002-226261 |
| Aug. 2, 2002 | (JP) | 2002-226265 |
| Aug. 2, 2002 | (JP) | 2002-226266 |
| Aug. 9, 2002 | (JP) | 2002-234185 |

(51) Int. Cl.
*G03G 15/04* (2006.01)

(52) U.S. Cl. ..... 430/66; 430/128; 430/132

(58) Field of Classification Search ..... 430/66, 430/67, 128, 132

See application file for complete search history.

(56) References Cited

U.S. PATENT DOCUMENTS

| | | | | |
|---|---|---|---|---|
| 4,265,991 | A | 5/1981 | Hirai et al. | 430/64 |
| 4,451,547 | A | 5/1984 | Hirai et al. | 430/128 |
| 4,507,375 | A | 3/1985 | Hirai et al. | 430/128 |
| 4,552,824 | A | 11/1985 | Hirai et al. | 430/64 |
| 5,314,780 | A | 5/1994 | Takei et al. | 430/128 |
| 5,455,138 | A | 10/1995 | Okamura et al. | 430/128 |
| 5,480,627 | A | 1/1996 | Takei et al. | 430/127 |
| 5,576,060 | A | 11/1996 | Hirai et al. | 427/255.2 |
| 6,001,521 | A | 12/1999 | Hashizume et al. | 430/58.1 |
| 6,090,513 | A | 7/2000 | Niino et al. | 430/65 |
| 6,379,852 | B1 * | 4/2002 | Tsuchida et al. | 430/57.7 |
| 6,534,228 | B1 | 3/2003 | Kawada et al. | 430/66 |
| 6,846,600 | B1 * | 1/2005 | Ehara et al. | 430/66 |
| 2002/0168859 | A1 | 11/2002 | Ehara et al. | 438/694 |

FOREIGN PATENT DOCUMENTS

| | | |
|---|---|---|
| JP | 54-86341 | 7/1979 |
| JP | 64-86149 | 3/1989 |
| JP | 8-15882 | 1/1996 |
| JP | 2786756 | 5/1998 |
| JP | 11-133640 | 5/1999 |
| JP | 11-133641 | 5/1999 |

* cited by examiner

*Primary Examiner*—John L Goodrow
(74) *Attorney, Agent, or Firm*—Fitzpatrick, Cella, Harper & Scinto

(57) ABSTRACT

An electrophotographic photosensitive member production process is provided having the steps of placing a cylindrical substrate having a conductive surface in a first film-forming chamber, and decomposing a source gas with high-frequency power to deposit on the cylindrical substrate a first layer formed of a non-single-crystal material, taking out of the first film-forming chamber the cylindrical substrate with the first layer deposited thereon, and placing the cylindrical substrate with the first layer deposited thereon in a second film-forming chamber, and decomposing a source gas with a high-frequency power to deposit on the first layer a second layer having an upper-part blocking layer formed of a non-single-crystal material. Even where abnormal growth portions called spherical protuberances are present on the photosensitive member surface, they can be made not to appear on images, and image defects can vastly be remedied.

31 Claims, 9 Drawing Sheets

PROCESS FOR PRODUCING ELECTROPHOTOGRAPHIC PHOTOSENSITIVE MEMBER, AND ELECTROPHOTOGRAPHIC PHOTOSENSITIVE MEMBER AND ELECTROPHOTOGRAPHIC APPARATUS MAKING USE OF THE SAME

BACKGROUND OF THE INVENTION

1. Field of the Invention

This invention relates to a process for producing at a low cost an amorphous silicon electrophotographic photosensitive member which may reduce image defects, has high charging performance, can provide high density and can maintain good image formation over a long period of time. This invention also relates to such an electrophotographic photosensitive member, and an electrophotographic apparatus having the same.

2. Related Background Art

Materials that form photoconductive layers in solid-state image pick-up devices or in electrophotographic light-receiving members in the field of image formation or in character readers are required to have properties as follows: They are highly sensitive, have a high SN ratio [photocurrent (Ip)/(Id)], have absorption spectra suited to spectral characteristics of electromagnetic waves to be radiated, have a high response to light, have the desired dark resistance and are harmless to human bodies when used; and also, in the solid-state image pick-up devices, the materials are required to have properties that enable remaining images to be easily processed in a prescribed time. In particular, in the case of electrophotographic photosensitive members of electrophotographic apparatus used as business machines in offices, the harmlessness in their use is an important point.

Materials that attract notice from such viewpoints include amorphous silicon (hereinafter "a-Si") whose dangling bonds have been modified with monovalent elements such as hydrogen or halogen atoms, and its application to electrophotographic photosensitive members is disclosed in, e.g., Japanese Patent Application Laid-Open No. 54-86341 (corresponding to U.S. Pat. No. 4,265,991).

As processes by which electrophotographic photosensitive members comprised of a-Si are formed on conductive supports, many processes are known in the art, as exemplified by sputtering, a process in which source gases are decomposed by heat (thermal CVD), a process in which source gases are decomposed by light (photo-assisted CVD) and a process in which source gases are decomposed by plasma (plasma-assisted CVD). In particular, one having been put into practical use in a very advanced state at present is plasma-assisted CVD (chemical vapor deposition), i.e., a process in which source gases are decomposed by direct-current or high-frequency or microwave glow discharge to form deposited films on the conductive support.

As layer structures of such deposited films, proposed are those constructed to have a "surface layer" or an "upper-part blocking layer," having blocking power, which is further provided on the surface side, in addition to electrophotographic photosensitive members composed chiefly of a-Si and modification elements added appropriately, as conventionally done.

For example, Japanese Patent Application Laid-Open No. 08-15882 discloses an electrophotographic photosensitive member provided between a photoconductive layer and a surface layer with an intermediate layer (upper-part blocking layer) having carbon atoms in a smaller content than the surface layer and incorporated with atoms capable of controlling conductivity.

After a copy has been taken in an electrophotographic apparatus, toner remains partly on the periphery of the photosensitive member, and hence such residual toner must be removed. Such residual toner is commonly removed by means of a cleaning step making use of a cleaning blade, a fur brush or a magnet brush.

Meanwhile, conventional processes for forming electrophotographic photosensitive members have made it possible to obtain electrophotographic photosensitive members having characteristics and uniformity which are practical to a certain extent. Strict cleaning of the interiors of vacuum reactors also makes it possible to obtain electrophotographic photosensitive members having less defects to a certain extent. However, such conventional processes for producing electrophotographic photosensitive members have had such a problem that, regarding products in which large-area and relatively thick deposited films are required as in electrophotographic photosensitive members, it is difficult to obtain in a high yield deposited films that have uniform film quality, can meet requirements on various optical and electrical properties and also may lessen image defects when images are formed by an electrophotographic process.

In particular, a-Si films have a disposition that, where any dust in the order of micrometers have adhered to the substrate surface, the films may undergo abnormal growth on the dust serving as nuclei during film formation, i.e., the growth of "spherical protuberances." Such spherical protuberances have the shape of a reversed cone whose vertex starts from the dust, and have a disposition that they lower electrical resistance because there are a great many localized levels at the boundaries between a normal deposited portion and spherical protuberant portions, and make the acquired electric charges pass through the boundaries toward the substrate side. Hence, some part of the spherical protuberances appears in the form of white dots in solid black images on images formed (in the case of reverse development, appears in the form of black dots in solid white images). This image defect called "dots" is subjected to severer standards year by year, and images are treated as being poor in some cases even when only few dots are present in an A3-size sheet, depending on their size. Moreover, where electrophotographic photosensitive members are set in color copying machines, the standards come much severer, and images are treated as being poor in some cases even when only one dot is present in an A3-size sheet.

Such spherical protuberances start from the dust, and hence substrates to be used are strictly cleaned before films are formed thereon, where the steps of setting the substrates in a film formation apparatus are all operated in a clean room or in vacuum. In this way, efforts have been made so as to lessen as far as possible the dust which may adhere to the substrate surface before the film formation is started, and the desired effects have been obtained. However, the cause of the occurrence of spherical protuberances is not only the dust having adhered to the substrate surface. That is, where a-Si electrophotographic photosensitive members are produced, the layer thickness required is as large as several micrometers to tens of micrometers, and hence the film formation time reaches several hours to tens of hours. During such film formation, the a-Si becomes deposited not only on the substrates, but also on walls of the film-forming chamber and on structures inside the film-forming chamber. These chamber walls and structures do not have any surfaces that have been controlled like the substrates. Hence, they may have weakly adhered to cause film come-off (or film peel-off) in some cases during film formation carried out over a long time. Once even any slight film has come off during film formation, it causes dust, and the dust adheres to the surfaces of photosensitive members under deposition, so that, starting from the dust, the abnormal growth of spherical protuberances takes place inevitably. Accordingly, in order to maintain a high yield, careful management is required not only on the management of substrates before film formation but also on the prevention of film come-off in the film-forming chamber during the film formation. This has made it difficult to produce the a-Si photosensitive members.

It is known, as disclosed in Japanese Patent Applications Laid-Open No. 11-133640 and No. 11-133641 (corresponding to U.S. Pat. No. 6,001,521), that it is effective to use an amorphous carbon layer containing hydrogen (hereinafter referred to as "a-C:H films"). This a-C:H film, as it is also called diamond-like carbon (DLC), has a very high hardness. Hence, it can prevent scratches and wear and at the same time has a peculiar solid lubricity.

In practice, it has been ascertained that the use of the a-C:H film at the outermost surface of the photosensitive member enables filming to be effectively prevented in various environments.

However, in the process of producing electrophotographic photosensitive members making use of this a-C:H film as a surface layer, there has been a problem in production steps. Usually, in forming deposited films by using high-frequency plasma, by-products (polysilane) generated during deposited-film formation are removed by dry etching after the deposited-film formation has been completed, and the inside of the reactor is cleaned. However, the time for etching treatment after continuous formation of light-sensitive layers up to surface layers (a-C:H) is longer than the time for continuous formation of light-sensitive layers up to conventional surface layers (a-SiC). This is due to the fact that the a-C:H can be etched with great difficulty, and has been one of factors in bringing about a rise in production costs.

In addition, there is a case where residues of a-C:H films remains thin after the etching treatment, and this may cause image defects in the next deposited film formation.

Meanwhile, in electrophotographic apparatus, depending on the surface state of an a-Si photosensitive member, any damage of a cleaning blade that are caused by surface roughness, the above spherical protuberances or the like or too good slipperiness between the photosensitive member and the cleaning blade at the initial stage of service may cause faulty cleaning such as slip-through of developer (toner) to cause black lines on images.

To cope with such a difficulty, blade materials, contact pressure, developer composition and so forth may carefully be selected corresponding to the surface state of the photosensitive member. For example, the contact pressure of the cleaning blade at the initial stage is set a little high, and is thereafter made lower little by little. Such measure can lessen the difficulty to a certain extent. However, during the use of the electrophotographic apparatus over a long period of time, maintenance must be made in a large number of times in order to improve the quality of images, and further the maintenance may come complicated. Hence, the efficiency of operating the electrographic apparatus can not sufficiently be improved, bringing about an additional difficulty such as enlargement in the number of component parts in some cases.

Depending on the surface state of the photosensitive member and the state thereof with respect to the cleaning blade, during the use of the electrophotographic apparatus over a long period of time, the cleaning blade may gradually be turned up as the photosensitive member is rotated, to become unable to remove the toner sufficiently by cleaning.

With regard to processes for producing a-Si photosensitive members, plasma-assisted CVD carried out at VHF band frequency makes it possible to improve the film deposition rate more vastly than any cases making use of RF bands. However, with regard to surface properties, depending on production conditions, the surface state may come coarser on the level of a microscopic visual field (in the order of submicrons) than the surfaces of photosensitive members produced using RF bands. Hence, the photosensitive members produced using VHF bands may tend to cause damage of the cleaning blade or cause faulty cleaning such as slip-through of toner, bringing about a narrow latitude for coping with difficulties in some cases.

Especially in recent years, the advancement of digitization of electrophotographic apparatus has raised the level of a demand for image quality, and has reached a situation such that image defects in the extent that has been tolerated in conventional analogue type apparatus must be questioned.

Accordingly, any effective measures to remove the factors of image defects are desired.

SUMMARY OF THE INVENTION

An object of the present invention is to provide a process for producing an electrophotographic photosensitive member which can reduce image defects, can promise high image quality and is easy to handle, which process can solve such various problems in conventional electrophotographic photosensitive members without sacrificing any electrical properties and can produce electrophotographic photosensitive members at a low cost, stably and in a good yield, and to provide such an electrophotographic photosensitive member and an electrophotographic apparatus having the same.

Stated specifically, the present invention provides a process for producing an electrophotographic photosensitive member having a layer formed of a non-single-crystal material; the process comprising the steps of:

as a first step, placing a cylindrical substrate in a first film-forming chamber having an evacuation means and a source gas feed means and capable of being made vacuum-airtight, and decomposing at least a source gas by means of a high-frequency power to deposit on the substrate a first layer formed of at least a non-single-crystal material;

as a second step, moving to a second film-forming chamber the cylindrical substrate on which the first layer has been deposited; and as a third step, decomposing a source gas by means of a high-frequency power in the second film-forming chamber to deposit on the first layer a second layer comprising an upper-part blocking layer formed of at least a non-single-crystal material.

The present invention also provides such an electrophotographic photosensitive member, and an electrophotographic apparatus having the same.

In the first step, a plasma-assisted CVD system having employed a VHF band (VHF-PCVD process) may be employed, which has a high deposition rate and ensures superior film quality uniformity. In the third step, a plasma-assisted CVD system having employed an RF band (RF-PCVD process) may be employed, which has low deposition rate and ensures good adherence (or adhesion). This is preferable from the viewpoints of both image defect reduction and photosensitive member performance.

In the second step, the substrate on which the first layer has been deposited may first be taken out of the film-forming chamber into the atmosphere. It is also preferable to provide a step in which the surface of the substrate on which the first layer has been deposited is subjected to working such as polishing. In addition, the preset temperature for the substrate having a surface with conductivity may be made different between the second step and the third step, during which the substrate on which the first layer has been deposited may further preferably be put to inspection. Stated specifically, such Inspection includes inspection of external appearance, inspection of images, inspection of potential, and so forth. After the inspection, the substrate may further be subjected to cleaning with water, whereby the adherence in forming the subsequent upper-part blocking layer can be improved, bringing a very broad latitude for film come-off.

In the present invention, on the upper-part blocking layer, a non-single-crystal carbon film may further be deposited as the outermost surface layer. This enables images with a much higher level to be formed.

DESCRIPTION OF THE PREFERRED EMBODIMENTS

Figure 1:
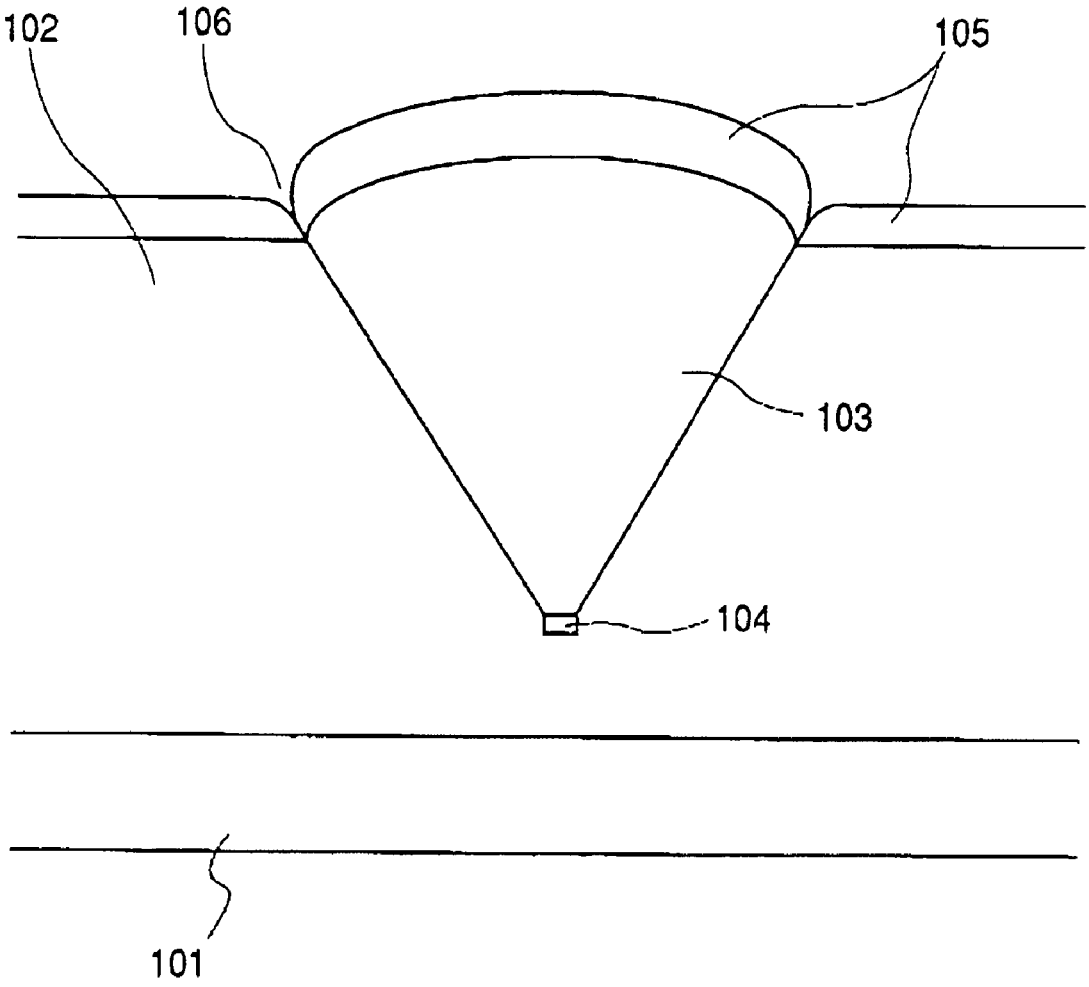
FIG. 1 is a diagrammatic sectional view showing an example of spherical protuberances of an electrophotographic photosensitive member.

As discussed previously, conventional processes for forming electrophotographic photosensitive members have made it possible to obtain electrophotographic photosensitive members having characteristics and uniformity which are practical to a certain extent. Strict cleaning of the interiors of vacuum reactors also makes it possible to obtain electrophotographic photosensitive members having less defects to a certain extent. However, such conventional processes for producing electrophotographic photosensitive members have had a problem that, regarding products in which large-area and relatively thick deposited films are required as in electrophotographic photosensitive members, it is difficult to obtain in a high yield deposited films that have uniform film quality, can meet requirements for various optical and electrical properties and also may lessen image defects when images are formed by an electrophotographic process.

In particular, a-Si films have a disposition that, where any dust in the order of micrometers have adhered to the substrate surface, the films may be grown abnormally on the dust serving as nuclei during film formation, i.e., the growth of "spherical protuberances." Such spherical protuberances have the shape of a reversed cone whose vertex starts from the dust, and have a disposition that they lower electrical resistance because there are a great many localized levels at the boundaries between a normal deposited portion and spherical protuberant portions, and make the acquired electric charges pass through the boundaries toward the substrate side. Hence, some parts of the spherical protuberances appear in the form of white dots in solid black images on images formed (in the case of reverse development, appear in the form of black dots in solid white images). This image defect called "dots" is subjected to severer standards year by year, and images are treated as being poor in some cases even when only few dots are present in an A3-size sheet, depending on their size. Moreover, where electrophotographic photosensitive members are set in color copying machines, the standards come much severer, and images are treated as being poor in some cases even when only one dot is present in an A3-size sheet.

Such spherical protuberances start from the dust, and hence substrates or supports to be used are strictly cleaned before films are formed thereon, where the steps of setting the supports in a film formation apparatus are all operated in a clean room or in vacuum. In this way, efforts have been made so as to lessen as far as possible the dust which may adhere to the support surface before the film formation is started, and the desired effects have been obtained. However, the cause of the occurrence of spherical protuberances is not only the dust having adhered to the support surface. That is, where a-Si electrophotographic photosensitive members are produced, the layer thickness required is as very large as several micrometers to tens of micrometers, and hence the film formation time reaches several hours to tens of hours. During such film formation, the a-Si becomes deposited not only on the supports, but also on walls of the film-forming chamber and on structures inside the film-forming chamber. These chamber walls and structures do not have any surfaces that have been controlled like the supports. Hence, they may have weakly adhered to cause film come-off in some cases during film formation carried out over a long time. Once even any slight film has come off during film formation, it results in dust, and the dust adheres to the surfaces of photosensitive members under deposition, so that, starting from the dust, the abnormal growth of spherical protuberances takes place inevitably. Accordingly, in order to maintain a high yield, careful management is required not only for the management of supports before film formation but also for the prevention of film come-off in the film-forming chamber during the film formation. This has made it difficult to produce the a-Si photosensitive members.

The present inventors have made studies to find a remedy for image defects coming from the spherical protuberances in the photosensitive members formed of a non-single-crystal material, in particular, the a-Si photosensitive members. In particular, they have made every effort to find how to prevent image defects due to the spherical protuberances caused by film come-off from walls of the film-forming chamber and from structures inside the film-forming chamber on the way of film formation.

As stated above, the reason why the spherical protuberances appear as image defects like dots is that there are many localized levels at the boundaries between a normal deposited portion and spherical protuberant portions, which results in low-resistance, and the acquired electric charges pass through the boundaries toward the substrate side. However, the spherical protuberances caused by the dust having adhered in the course of film formation grow not from the substrate or support but from a midpoint of the deposited film. Hence, if a blocking layer is provided on the surface side to prevent the acquired electric charges from being injected, there is a possibility that the spherical protuberances do not come into image defects even if they are present.

Accordingly, the present inventors have made an experiment where film formation conditions under which the spherical protuberances grow from a midpoint of a deposited film are picked out and an upper-part blocking layer is provided on the surface of the deposited film formed on a substrate under such conditions. However, unexpectedly, it has been found that the upper-part blocking layer can not prevent electric charges from being injected from the spherical protuberances, to cause image defects.

To examine the cause of this, cross sections of the spherical protuberances have been skived to observe them in detail by SEM (scanning electron microscopy). It is shown in FIG. 1 what the observed state is. In FIG. 1, reference numeral 101 denotes a conductive substrate; 102, a normal deposited portion of a first layer; 103, a spherical protuberance; 104, dust having adhered during film formation; 105, an upper-part blocking layer as a second layer; and 106, a boundary between the spherical protuberant portion and the normal deposited portion. As can be seen from FIG. 1, the spherical protuberance 103 has grown from a midpoint of the normal deposited portion, starting from the dust 104, and the boundary 106 is present between the spherical protuberant portion and the normal deposited portion. The acquired electric charges pass through this boundary toward the substrate side, and hence this may cause dots on images. Even though the upper-part blocking layer 105 is deposited on this spherical protuberance 103, the boundary 106 has formed also at the upper-part blocking layer 105 because the upper-part blocking layer 105 has been deposited maintaining the growth pattern of the spherical protuberance 103 having grown until then. As the result, the electric charges pass through this boundary, so that the function required for the upper-part blocking layer is lost.

Accordingly, the present inventors made extensive researches on how to prevent the boundary 106 from growing when the upper-part blocking layer 105 is deposited. As the result, they have discovered that the growth of this boundary 106 can be prevented by carrying out deposition in different ways in film formation between the deposition of the first layer and the deposition of the second layer.

More specifically, before the second-layer upper-part blocking layer is formed, the substrate with the first layer having been deposited thereon is first taken out of a first film-forming chamber and then anew moved to a second film-forming chamber, and thereafter the upper-part blocking layer is deposited, whereby this boundary can be prevented from growing. In particular, it has been found preferable that a high-vacuum type film formation process such as a VHF-PCVD process is employed in the first film-forming chamber and a low-rate type film formation process such as an RF-PCVD process is employed in the second film-forming chamber.

Figure 2:
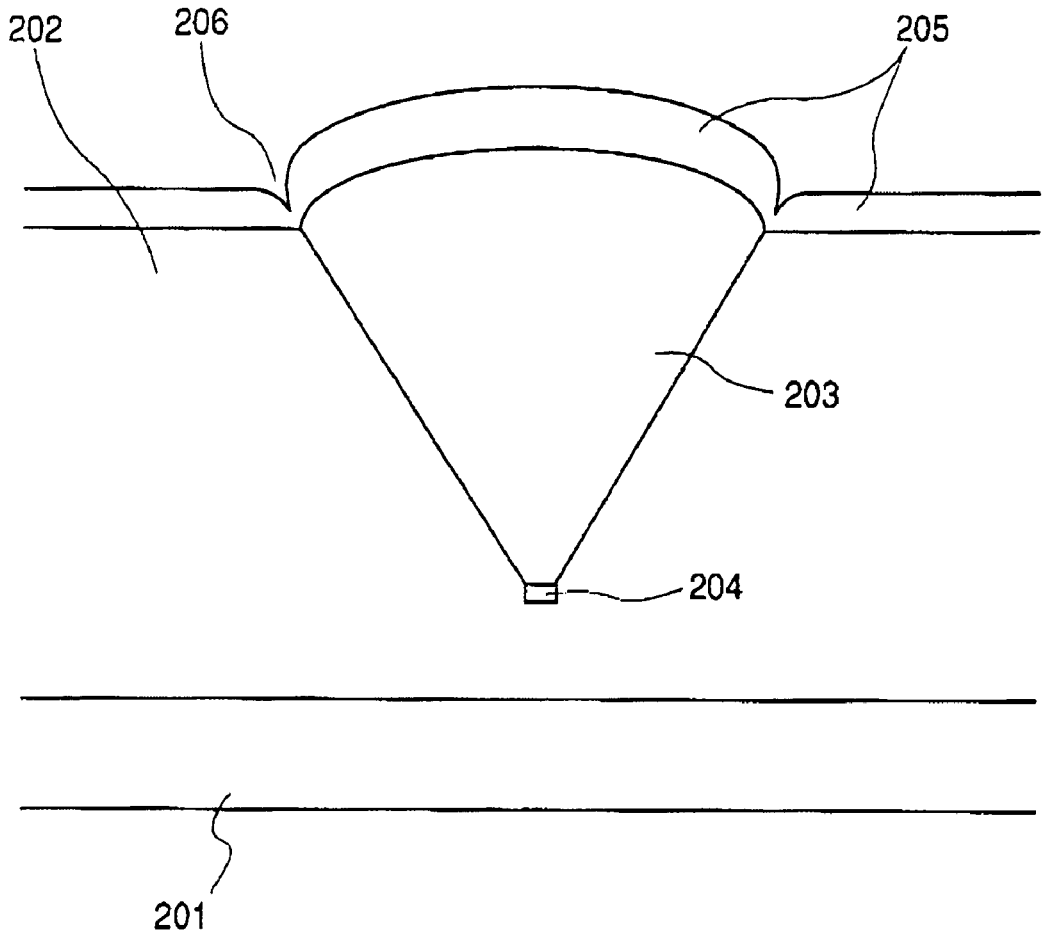
FIG. 2 is a diagrammatic sectional view showing an example of a spherical protuberance of the electrophotographic photosensitive member of the present invention.

To examine this situation, cross sections of the spherical protuberances have been skived again to observe the cross sections by SEM (scanning electron microscopy). The result is shown in FIG. 2. Like the former case, a spherical protuberance 203 has begun to grow from dust 204 having adhered to the normal deposited portion of a first layer 202 in the course of film formation. However, what differs in the photosensitive member in this case is that, when an upper-part blocking layer 205 is deposited, the boundary portion 206 is broken off from the boundary portion of a spherical protuberance 103 having grown until then. More specifically, it is assumed that the first layer 202 is formed in the first film-forming chamber employing the VHF-PCVD process, the substrate with the first layer having been thus formed is first taken out of the first film-forming chamber and thereafter moved to a second film-forming chamber employing the RF-PCVD process, and then the upper-part blocking layer 205 is formed, where the grown surface has come discontinuous. As the result, the boundary between the low-resistance spherical protuberant portion 203 and the normal deposited portion has been sealed with the upper-part blocking layer 205, so that the acquired electric charges can not easily pass through that boundary and the image defects can be kept from occurring.

Details of what changes occur at the surface of the first layer 202 are unclear at present, and it is presumed as follows: A difference in electron temperature is made because the film formation pressure differs greatly between the high-vacuum film formation process such as a VHF-PCVD process and the low-rate film formation process such as an RF-PCVD process. Hence, a difference in growth mechanism of deposited films is made, and consequently the boundary 106 can be kept from growing. In particular, it is assumed that since the low-rate film formation is carried out in the RF-PCVD process, the film coverage is improved and the deposited film is formed also at the part tending to be in shadow, such as the boundary at the protuberant portion, and hence the image defects can be kept from occurring.

It has further been found that, in order to prevent the electric charges from slipping through the spherical protuberance 203, it is effective to polish the tip portion of the spherical protuberance 203 to make it flat, after the first layer 202 has been formed.

Figure 3:
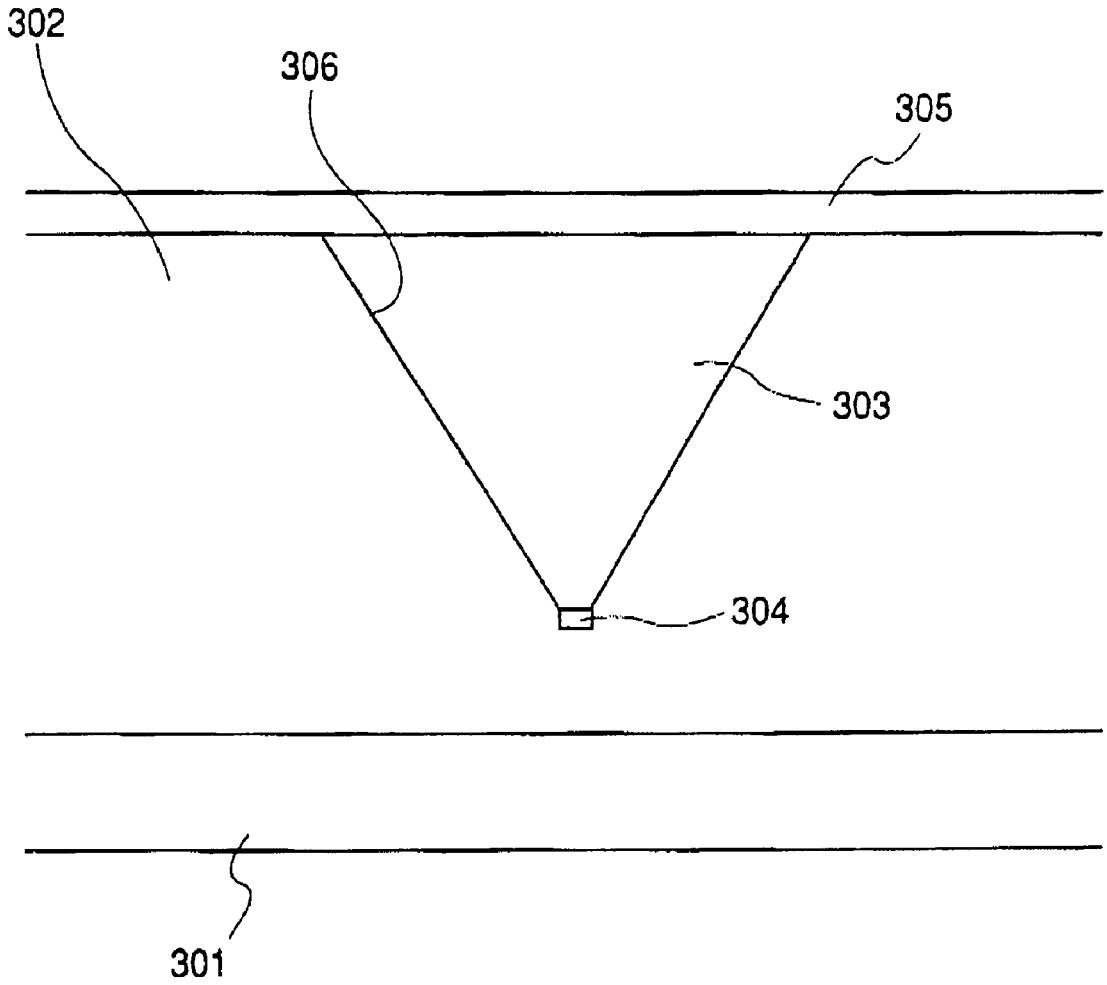
FIG. 3 is a diagrammatic sectional view showing an example of spherical protuberances of the electrophotographic photosensitive member of the present invention, the surface of which has been polished in the second step.

FIG. 3 shows an example of an electrophotographic photosensitive member in which, after the first layer 302 has been formed, the tip portion (or raised portion) of a spherical protuberance 303 is polished and flattened to form discontinuous layer-forming interfaces. The spherical protuberance 303 has begun to grow from dust 304 having adhered to the normal deposited portion of a first layer 302 in the course of film formation. However, before the upper-part blocking layer 305 is deposited, the tip portion of the spherical protuberance 303 is polished by a polishing means to make it flat. Hence, the upper-part blocking layer 305 formed thereafter does not take over any boundary portion 306 at all, and is uniformly deposited on the surface having been made flat. Thus, the boundary 306 between the spherical protuberance 303 and the normal deposited portion of the first layer 302 is more completely sealed when the layer-forming interfaces are made flat by means of a polishing means so that the layer-forming interfaces may come to be clear discontinuous interfaces and thereafter the upper-part blocking layer 305 is deposited. Hence, the acquired electric charges can more difficultly pass through that boundary and the image defects can more effectively be kept from occurring.

The present invention is equally effective in both of positively chargeable photosensitive members and negatively chargeable photosensitive members. However, the slip-through of electric charges that is due to the spherical protuberances may more remarkably occur in negatively chargeable photosensitive members, and hence even relatively small spherical protuberances have a great influence. Thus, the present invention is effective especially in the negatively chargeable photosensitive members.

It has still further been found that the adherence of the film on which the second layer has been deposited can sufficiently be improved when the surface of the first-layer deposited film is worked into a surface state that its arithmetic mean roughness (Ra) measured in a visual field of 10 μm×10 μm is 25 nm or less.

The present inventors have made extensive researches on the mechanism of causing slip-through of toners also in regard to faulty cleaning in electrophotographic apparatus.

Conventionally, as to the surfaces of a-Si photosensitive members, only abnormal growth defects have been polished away by means of a polishing apparatus to make them flat. As the result, at the surfaces of a-Si photosensitive members, fine roughness has remained without being made flat. If a photosensitive member having such a surface state is set in an electrophotographic apparatus, its cleaning blade may be too slippery because of such fine roughness at the initial stage where it begins to be used, and hence a developer may slip through to cause faulty cleaning. Accordingly, it is considered that the faulty cleaning is caused by slip-through of a developer such as a toner, because the photosensitive member has so large surface roughness as to provide too good slipperiness between the cleaning blade and the photosensitive member.

Then, on the basis of such consideration, it has been made possible to prevent the faulty cleaning from occurring, by working the surface of the first layer into a surface state that its arithmetic mean roughness (Ra) measured in a visual field of 10 μm×10 μm is 25 nm or less.

The working into the above surface state also enables the influence of reflection resulting from such a surface state to be prevented even in a system making use of coherent light, so that interference fringes can be kept from occurring.

In studying the a-Si photosensitive members making use of the a-C:H film in the surface layer, the present inventors have also become aware of the fact that it takes a longer time than conventional cases to perform cleaning of the interior of a reactor after the photosensitive members have been produced.

To solve such a problem, the present inventors performed extensive studies. For example, the improvement of etching conditions such as a concentration or type of etching gas and power to be applied have made it possible to shorten the time to a certain extent, but any techniques have not been made available which satisfactorily correspond with their costs.

Accordingly, the present inventors have changed the idea that the a-Si photosensitive layer and up to the a-C:H surface layer are formed in the same reactor, and have contrived a process in which a first layer is formed in a first reactor, then a second layer except for the a-C:H surface layer is formed in a second reactor, and thereafter the substrate on which the first and second layers have been formed (unfinished photosensitive member) is moved to a third reactor, where the a-C:H surface layer is formed. The first and second reactors are subjected to dry etching after the unfinished photosensitive member has been moved to the third reactor. Any a-C:H film is not formed in the first and second reactors and only Si type products are formed therein, and hence the time for etching treatment can vastly be shortened. In the meantime, only the a-C:H film is formed in the third reactor.

In forming the a-C:H film, any Si type source gas is not used, and hence polysilane is not generated when, e.g., a photoconductive layer is formed. Therefore, the a-C:H film forming third reactor need not be cleaned each time, and may be used without cleaning over certain cycles. This has proved to be a factor by which the total apparatus operating efficiency is improved and the production cost is cut down.

The a-C:H film deposition time is also very shorter than the first-layer deposited film formation time. Hence, this makes it possible to use a system in which a plurality of deposited-film-forming first reactors (for forming photoconductive layers) are disposed in respect to one set of the third reactor for forming the a-C:H film. On the unfinished photosensitive members having layers up to the first layers formed in the plurality of first reactors, the a-C:H surface layers may successively be formed in the third reactor. This enables the number of the second reactors to be reduced without wasting cycles, and hence is effective in improving investment efficiency. The time for forming the second layer except for the a-C:H surface layer is shorter than that for the first layer, and polysilane may be generated in a small quantity. Hence, the etching time can also be short. Occupation time is shorter than that for the first layer, but is longer than that for the a-C:H surface layer. Hence, the system construction may appropriately be determined in accordance with the manufacturing scale.

It has further been found that, in addition to the above etching treatment time, there is a difference in the state of cleaning when the etching condition of the reactor in which layers up to the a-Si photosensitive layer have been formed is compared with a case in which the photosensitive layer and up to the a-C:H surface layer have been formed in the same reactor.

Since the a-C:H film can be etched with great difficulty, residues of the a-C:H film may also partly remain after the etching when films are formed up to the a-C:H surface layer in the same reactor, and may soil the interior of the reactor with repeated production cycles to come to the cause of image defects in electrophotographic photosensitive members.

On the other hand, in the construction of the present invention, the interior of the first reactor is kept very clean after the etching, and the image defects may occur only at a very low probability, bringing an improvement in percentage of conforming articles.

Forming the a-C:H film surface layer in another reactor also brings the following secondary effects.

In order to obtain an a-C:H film having a sufficiently good quality as the photosensitive member surface layer as described above, it is known to require sufficient high-frequency energy. Deposited films in a polymer state may be formed unless source hydrocarbon gases are decomposed under application of sufficient energy in respect to their flow rates. Hence, the a-C:H surface layer must be formed under conditions having a higher high-frequency power than the conditions under which the a-Si film is formed.

In particular, the a-C:H film tends to be affected by plasma conditions to cause non-uniformity in hardness and layer thickness distribution. However, the construction of reactors optimized for forming a-C:H films has not necessarily been optimum for forming a-C:H films. Where different reactors are used for forming the a-Si film and for forming the a-C:H film as in the present invention, reactors having optimum construction for each reactor can be used. This makes it possible to obtain electrophotographic photosensitive members having higher performance.

As stated previously, the present inventors have made extensive researches on the mechanism of causing slip-through of toners also in regard to faulty cleaning in electrophotographic apparatus.

Figure 10A:
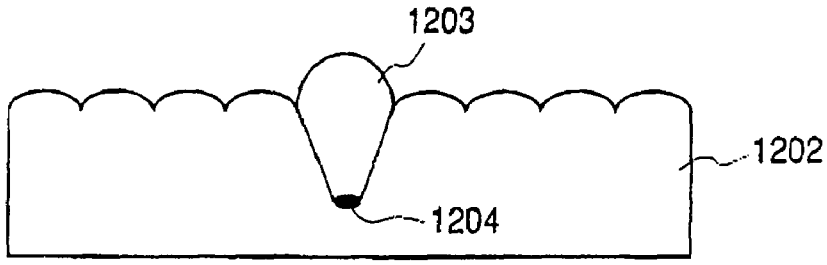
FIGS. 10A, 10B and 10C are diagrammatic sectional views for describing how the photosensitive member surface is worked.
Figure 10B:
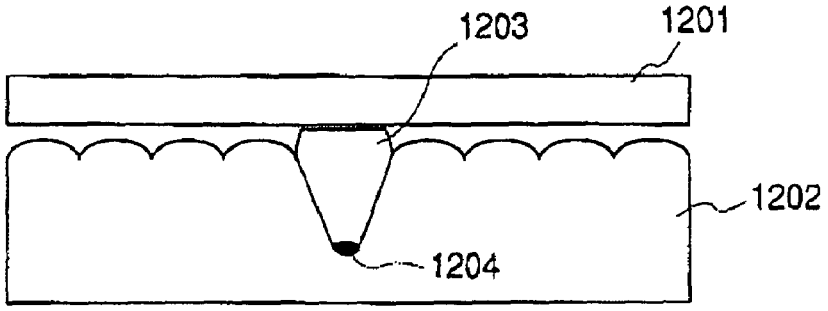

First, the surface of an a-Si photosensitive member produced has a sectional structure as shown in FIG. 10A. Conventionally, as to the surface of the a-Si photosensitive members, only abnormal growth defects have been polished away by means of a polishing apparatus to make them flat. As the result, as shown in FIG. 10B, at the surface of the a-Si photosensitive member, fine roughness has remained without being made flat. If the photosensitive member having such a surface state is disposed in an electrophotographic apparatus, the cleaning blade may be too slippery because of such fine roughness at the initial stage where it begins to be used, and hence a developer may slip through to cause faulty cleaning. Accordingly, it is considered that the faulty cleaning is caused by slip-through of a developer such as a toner, because the photosensitive member has so large surface roughness as to provide too good slipperiness between the cleaning blade and the photosensitive member.

Figure 10C:
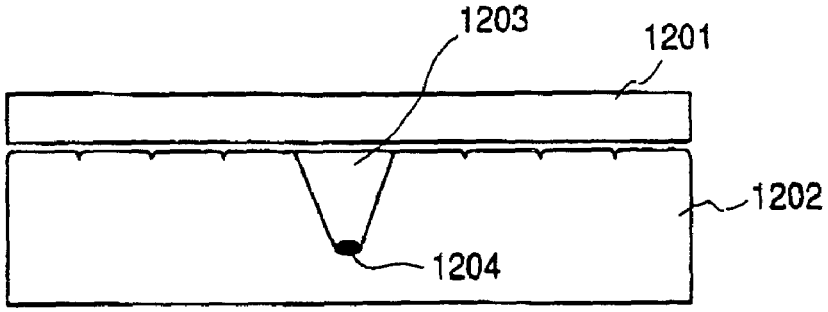

Then, on the basis of such consideration, as shown in FIG. 10C, the surface of the first layer is worked into a surface state that the arithmetic mean roughness (Ra) measured in a visual field of 10 μm×10 μm is 25 nm or less. This has made it possible to prevent the faulty cleaning from occurring, The working into the above surface state also enables any influence by reflection coming from such surface state to be prevented even in a system making use of coherent light, so that interference fringes can be kept from occurring. As the result of the foregoing, it has been made possible to maintain images with a better quality level over a long period of time.

The present invention is described below in greater detail with reference to the accompanying drawings as needed.

a-Si Photosensitive Member According to the Present Invention

Figure 4:
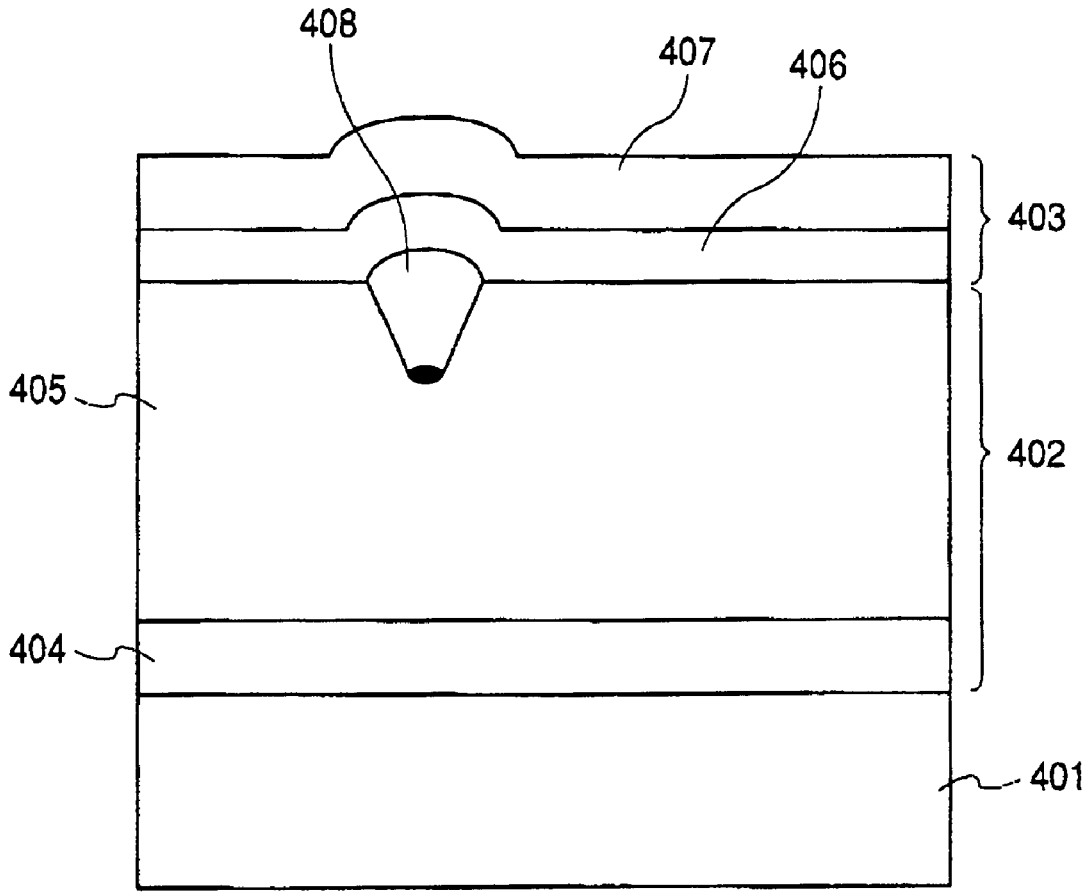
FIG. 4 is a diagrammatic sectional view showing an example of the electrophotographic photosensitive member of the present invention.

FIG. 4 shows an example of layer construction of the electrophotographic photosensitive member according to the present invention.

The electrophotographic photosensitive member of the present invention has a substrate 401 made of a conductive material as exemplified by aluminum or stainless steel, on which, in a first step, a first layer 402 is deposited in a first film-forming chamber, then, in a second step, the substrate on which the first layer has been deposited is taken out of the first film-forming chamber and moved to a second film-forming chamber, and, in a third step, a second layer 403 comprising an upper-part blocking layer 406 is superposed on the first layer 402 in the second film-forming chamber. When producing the electrophotographic photosensitive member in this way, the upper-part blocking layer 406 can be so deposited as to cover a spherical protuberance 408 having grown from an inner portion of the first layer 402. Thus, even though the spherical protuberance 408 is present, it does not appear on images, making it possible to keep good image quality. In the present invention, the first layer 402 includes a photoconductive layer 405. As a material for the photoconductive layer 405, a-Si is used. Also, as the upper-part blocking layer 406, a layer composed chiefly of a-Si and optionally containing carbon, nitrogen and oxygen is used.

The upper-part blocking layer 406 may be incorporated with an element belonging to Group 13 or Group 15 of the periodic table, selected as a dopant. This is preferable in view of an improvement in charge characteristics, and also enables charge polarity to be controlled.

Incidentally, in the first layer 402, a lower-part blocking layer 404 may optionally be provided. Where the lower-part blocking layer 404 is provided and is incorporated with an element belonging to Group 13 or Group 15 of the periodic table, selected as a dopant, such a layer also enables control of charge polarity such as positive charge or negative charge, to be controlled.

The Group 13 element serving as the dopant may specifically include boron (B), aluminum (Al), gallium (Ga), indium (In) and thallium (Tl). In particular, B and Al are preferred. The Group 15 element may specifically include phosphorus (P), arsenic (As), antimony (Sb) and bismuth (Bi). In particular, P is preferred.

In the second layer 403, a surface layer 407 may also optionally be provided on the upper-part blocking layer 406. As the surface layer 407, a layer composed chiefly of a-Si and optionally containing at least one of carbon, nitrogen and oxygen relatively in a large quantity is used. This layer can improve environmental resistance, wear resistance and scratch resistance. The use of a surface layer formed of a non-single-crystal material composed chiefly of carbon atoms also enables wear resistance and scratch resistance to be improved.

Besides, at least a first region of the photoconductive layer 405 may be deposited as the first layer 402, and at least a second region of the photoconductive layer 405 and the upper-part blocking layer 406 may be deposited as the second layer 403.

Shape and Material of Substrate According to the Present Invention

The substrate 401 may have any desired shapes according to how the electrophotographic photosensitive member is driven. For example, it may be in the shape of a cylinder or a sheetlike endless belt, having a smooth surface or uneven surface. Its thickness may appropriately be determined so that the electrophotographic photosensitive member can be formed as desired. Where a flexibility is required as electrophotographic photosensitive members, the substrate may be made as thin as possible as long as it can sufficiently function as a cylinder. In view of production and handling and from the viewpoint of mechanical strength, however, the cylinder may preferably have a wall thickness of 10 μm or more in usual cases.

As materials for the substrate, conductive materials such as aluminum and stainless steel as mentioned above are commonly used. Also usable are, e.g., materials having no conductivity, such as various types of plastic and glass, but provided with conductivity by vacuum deposition or the like of a conductive material on their surfaces at least on the side where the photoconductive layer is formed.

The conductive material may include, besides the foregoing, metals such as Cr, Mo, Au, In, Nb, Te, V, Ti, Pt, Pd and Fe, and alloys of any of these.

The plastic may include films or sheets of polyester, polyethylene, polycarbonate, cellulose acetate, polypropylene, polyvinyl chloride, polystyrene or polyamide.

First Layer According to the Present Invention

The first layer 402 in the present invention is constituted of a non-single-crystal material composed chiefly of silicon atoms and further containing hydrogen atoms and/or halogen atoms (hereinafter referred to as "a-Si(H,X)").

The a-Si(H,X) film may be formed by plasma-assisted CVD, sputtering or ion plating. Films prepared by the plasma-assisted CVD are preferred because films having especially high quality can be obtained.

In particular, the first layer 402 is required to have the largest layer thickness in the electrophotographic photosensitive member and is also required to have a uniform film quality. Hence, plasma-assisted CVD making use of a VHF band is preferably used, which can form plasma in high vacuum.

As materials for the a-Si(H,X) film, gaseous or gasifiable silicon hydrides (silanes) such as $SiH_4$ $Si_2H_6$, $Si_3H_8$ and $Si_4H_{10}$ may be used as source gases, any of which may be decomposed by means of a high-frequency power to form the film. In view of readiness of handling and Si-feeding efficiency at the time of layer formation, $SiH_4$ and $Si_2H_6$ are preferred.

The substrate temperature may preferably be kept at a temperature of approximately from 200° C. to 450° C., and more preferably from 250° C. to 350° C., in view of characteristics. This is to accelerate the surface reaction at the substrate surface to effect structural relaxation sufficiently.

The pressure inside the film-forming chamber (reactor) may appropriately be selected within an optimum range in accordance with layer designing. In usual cases, it may be set at from $1\times10^{-2}$ Pa to $1\times10^{3}$ Pa, and preferably from $5\times10^{-2}$ Pa to $5\times10^{2}$ Pa, and most preferably from $1\times10^{-1}$ Pa to $1\times10^{2}$ Pa.

In any of these gases, a gas containing $H_2$ or halogen atoms may further be mixed in a desired quantity to form the film. This is preferred in order to improve characteristics. Source gases effective for feeding halogen atoms may include fluorine gas ($F_2$) and interhalogen compounds such as BrF, ClF, $ClF_3$, $BrF_3$, $BrF_5$, $IF_5$ and $IF_7$. It may also include silicon compounds containing halogen atoms, what is called silane derivatives substituted with halogen atoms, specifically including silicon fluorides such as SiF4 and $Si_2F_6$, as preferred ones. Also, any of these source gases for feeding halogen atoms may optionally be diluted with gas such as $H_2$, He, Ar or Ne when used.

There are no particular limitations on the layer thickness of the first layer 402. It may suitably be from about 15 μm to 50 μm taking account of production cost and so forth.

The first layer 402 may also be formed in multiple layer construction in order to improve characteristics. For example, photosensitivity and charge characteristics can simultaneously be improved by disposing on the surface side a layer having a narrower band gap and on the substrate side a layer having a broader band gap. The designing of such layer construction brings about a dramatic effect especially in respect of light sources having a relatively long wavelength and also having almost no scattering of wavelength as in the case of semiconductor lasers.

The lower-part blocking layer 404, which may optionally be provided, may be formed of a-Si(H,X) as a base and may be incorporated with a dopant such as an element belonging to Group 13 or Group 15 of the periodic table. This makes it possible to control its conductivity type and to provide the layer with the ability to block carriers from being injected from the substrate. In this case, at least one element selected from C, N and O may optionally be incorporated so that the stress can be adjusted and the function to improve adherence of the photosensitive layer can be provided.

As the element belonging to Group 13 or Group 15 of the periodic table, used as the dopant of the lower-part blocking layer 404, those described previously may be used. Materials for incorporating such a Group 13 element may also specifically include, as a material for incorporating boron atoms, boron hydrides such as $B_2H_6$, $B_4H_{10}$, $B_5H_9$, $B_5H_{11}$, $B_6H_{10}$, $B_6H_{12}$ and $B_6H_{14}$ and boron halides such as $BF_3$, $BCl_3$ and $BBr_3$. Besides, the material may also include $AlCl_3$, $GaCl_3$, $Ga(CH_3)_3$, $InCl_3$ and $TlCl_3$. In particular, $B_2H_6$ is one of preferred materials also from the viewpoint of handling.

What can effectively be used as materials for incorporating the Group 15 element may include, as a material for incorporating phosphorus atoms, phosphorus hydrides such as $PH_3$ and P2H$_4$ and phosphorus halides such as $PF_3$, $PF_5$, $PCl_3$, $PCl_5$, $PBr_3$ and $PI_3$. It may further include $PH_4I$. Besides, the starting material for incorporating the Group 15 element may also include, as those which are effective, $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ and $BiBr_3$.

The dopant atoms may preferably be in a content of from $1\times10^{-2}$ to $1\times10^{4}$ atomic ppm, more preferably from $5\times10^{-2}$ to $5\times10^{3}$ atomic ppm, and most preferably from $1\times10^{-1}$ to $1\times10^{3}$ atomic ppm.

The first layer may include a non-single-crystal silicon carbide layer deposited on the photoconductive layer.

Depositing such a silicon carbide layer on the outermost surface of the first layer in the above first step brings an improvement in film adherence between the second layer deposited in the third step and the first layer, and can provide a very broad latitude for film come-off.

Also obtainable is the effect of preventing any polishing damages when the surface of the first layer is worked by polishing in the second step.

Second Layer According to the Present Invention

The second layer 403 according to the present invention is deposited after the substrate on which the first layer 402 has been formed is moved from the first film-forming chamber to the second film-forming chamber, stopping the discharge for a while.

To form the second layer 403, it is preferable to use the plasma-assisted CVD system making use of an RF band, having low rate and providing good adherence.

For the movement to the second film-forming chamber in the second step, the substrate on which the first layer 402 has been formed may be taken out of the first film-forming chamber as it stands kept in vacuum, or it may be taken out of the first film-forming chamber after it has been returned to atmospheric pressure. When it is moved to the second film-forming chamber, it may also be brought into contact with a gas containing oxygen and water vapor. As the gas containing oxygen and water vapor, the atmosphere may be used, which is air in a normal environment. More specifically, the gas used for such contact is a gas containing at least oxygen and water vapor and optionally containing an inert gas such as nitrogen gas. The gas may preferably be one containing, e.g., 5% by volume or more of the oxygen in the whole gas. It may also be pure oxygen to which water vapor has been added, but may usually be one having about the same oxygen content as air. The water vapor may be so added as to provide a relative humidity of, e.g., about 1% or more, and preferably 10% or more, at room temperature 25°

C. Under usual conditions, it is preferable to use the atmosphere, which is air in the environment, as being simple in steps.

During this contact with the gas, hill portions of the spherical protuberances present at the surface may preferably be polished by a polishing means to flatten the surface. The surface may preferably be so flattened as to have an arithmetic mean roughness (Ra) measured in a visual field of 10 μm×10 μm, of 25 nm or less. Such working may be carried out using a surface-polishing system described later. Making the spherical protuberances flat can effectively prevent electric charges from slipping through, and also can prevent the cleaning blade from chipping or the faulty cleaning from occurring because of the spherical protuberances. This also can prevent the occurrence of the toner melt adhesion that may start from the spherical protuberances.

It is also worthwhile to make inspection of external appearance or evaluation of characteristics If necessary when the substrate on which the first layer has been formed (unfinished photosensitive member) is taken out of the first film-forming chamber. Making inspection at this point of time makes it possible to omit subsequent steps in respect of unfinished photosensitive members found to have poor quality, bringing cost reduction as a whole.

In addition, the substrate on which the first layer has been formed may be cleaned before it is set in the second film-forming chamber. It is preferable to do so in order to improve the adherence of the second layer 403 and lessen any dust having adhered. As a specific method for such cleaning, it is preferable that the surface is wiped and cleaned with clean cloth or paper, or it is more preferable to clean the surface strictly by organic cleaning or by washing with water. In particular, in consideration for environment, washing with water by means of a water washing system described later is more preferable.

It is also preferable to beforehand subject the outermost surface of the first layer to etching before the substrate on which the first layer has been formed is set in the second film-forming chamber to deposit the second layer 403. This brings an improvement in adherence of film when the second layer is deposited, and good photosensitive members can be obtained against heat shock and vibration. Plasma etching is particularly preferred in view of such advantages that its system can be simple and, after the etching, it can continuously be changed over to the step of depositing the second layer 403.

The second layer 403 in the present invention includes the upper-part blocking layer 406. The upper-part blocking layer 406 has the function to block charges from being injected from the surface side to the first-layer side when the photosensitive member is subjected to charging in a certain polarity on its free surface, and exhibits no such function when subjected to charging in a reverse polarity.

In order to provide such function, it is necessary for the upper-part blocking layer 406 to be properly incorporated with atoms capable of controlling conductivity. As the atoms used for such purpose, an element belonging to Group 13 of the periodic table or an element belonging to Group 15 of the periodic table may be used in the present invention. The Group 13 element may specifically include boron (B), aluminum (Al), gallium (Ga), indium (In) and thallium (Tl). In particular, boron is preferred. The Group 15 element may specifically include phosphorus (P), arsenic (As), antimony (Sb) and bismuth (Bi). In particular, phosphorus is preferred.

The content of the atoms capable of controlling conductivity which are to be incorporated in the upper-part blocking layer 406 may appropriately be changed taking account of the composition of the upper-part blocking layer 406 and the manner of production. In general, such atoms may preferably be in a content of from 100 atomic ppm or more to 30,000 atomic ppm or less, and more preferably from 500 atomic ppm or more to 10,000 atomic ppm or less.

The atoms capable of controlling the conductivity which are contained in the upper-part blocking layer 406 may evenly uniformly be distributed in the upper-part blocking layer 406, or may be contained in such a state that they are distributed non-uniformly in the layer thickness direction. In any case, however, in the in-plane direction parallel to the surface of the substrate, it is necessary for such atoms to be evenly contained in a uniform distribution so that the properties in the in-plane direction can also be made uniform.

The upper-part blocking layer 406 may be formed using any materials so long as they are a-Si materials, and may preferably be constituted of the same material as the surface layer 407 detailed later. More specifically, preferably usable are "a-SiC:H,X" (amorphous silicon containing a hydrogen atom (H) and/or a halogen atom (X) and further containing a carbon atom), "a-SiO:H,X" (amorphous silicon containing a hydrogen atom (H) and/or a halogen atom (X) and further containing an oxygen atom), "a-SiN:H,X" (amorphous silicon containing a hydrogen atom (H) and/or a halogen atom (X) and further containing a nitrogen atom), and "a-SiCON:H,X" (amorphous silicon containing a hydrogen atom (H) and/or a halogen atom (X) and further containing at least one of a carbon atom, an oxygen atom and a nitrogen atom). The carbon atoms or nitrogen atoms or oxygen atoms contained in the upper-part blocking layer 406 may evenly uniformly be distributed in that layer, or may be contained in such a state that they are distributed non-uniformly in the layer thickness direction. In any case, however, in the in-plane direction parallel to the surface of the substrate, it is necessary for such atoms to be evenly contained in a uniform distribution so that the properties in the in-plane direction can also be made uniform.

The content of the carbon atoms and/or nitrogen atoms and/or oxygen atoms to be incorporated in the whole layer region of the upper-part blocking layer 406 may appropriately be so determined that the object of the present invention can effectively be achieved. It may preferably be in the range of from 10% to 70% based on the total sum of silicon atoms, as the amount of one kind when one kind of these is incorporated, and as the amount of the total sum when two or more kinds of these are incorporated.

In the present invention, the upper-part blocking layer 406 is required to be incorporated with hydrogen atoms and/or halogen atoms. This is because they are incorporated in order to compensate uncombined bonds of silicon atoms and are essential and indispensable for improving layer quality, in particular, for improving photoconductivity and charge retentivity. The hydrogen atoms may usually be in a content of from 30 to 70 atomic %, preferably from 35 to 65 atomic %, and more preferably from 40 to 60 atomic %, based on the total amount of constituent atoms. The halogen atoms may usually be in a content of from 0.01 to 15 atomic %, preferably from 0.1 to 10 atomic %, and more preferably from 0.5 to 5 atomic %.

The layer thickness of the upper-part blocking layer 406 is regulated to the thickness that can effectively prevent image defects caused by the spherical protuberances 408. The spherical protuberances 408 are various in size when they are viewed on the surface side, and have such a disposition that those having a larger diameter have a greater degree of injection of electric charges, and more tend to appear on images. Accordingly, it is effective that the larger the spherical protuberances are, the larger the layer thickness of the upper-part blocking layer 406 is. Stated specifically, the upper-part blocking layer 406 may preferably be in a thickness at least $10^{-4}$ time as large as the diameter of the largest spherical protuberance among spherical protuberances present at the surface of the unfinished photosensitive member after the second layer 403 has been deposited. Making the layer have the thickness of this range can effectively prevent electric charges from slipping through the spherical protuberances 408. As the upper limit, the layer thickness may be 1 μm or less. This is preferable from the viewpoint of minimizing deterioration in sensitivity.

In order to improve the adherence between the first layer 402 and the second layer 403, it is effective to provide between the first layer 402 and the upper-part blocking layer 406 a layer having the same composition as the former.

It is also effective for the upper-part blocking layer 406 to be continuously changed in composition from the first layer 402 side toward the surface layer 407. This is effective not only in improving the adherence but also in preventing the interference.

In order to form an upper-part blocking layer 406 having characteristics that can achieve the object of the present invention, it is necessary to appropriately set the mixing ratio of the Si-feeding gas to the C-and/or N-and/or O-feeding gas(es), the gas pressure inside the reactors, the discharge power and the substrate temperature.

Materials that can serve as source gases for feeding silicon (Si), used to form the upper-part blocking layer 406, may include gaseous or gasifiable silicon hydrides (silanes) such as $SiH_4$, $Si_2H_6$, $Si_3H_8$ and $Si_4H_{10}$, which can be effectively used. In view of readiness in handling for layer formation and Si-feeding efficiency, the material may preferably include $SiH_4$ and $Si_2H_6$. These Si-feeding source gases may be used optionally after their dilution with a gas such as $H_2$, He, Ar or Ne.

Materials that can serve as source gases for feeding carbon (C) may include gaseous or gasifiable hydrocarbons such as $CH_4$, $C_2H_2$, $C_2H_6$, $C_3H_8$ and $C_4H_{10}$. In view of readiness in handling for layer formation and C-feeding efficiency, the material may preferably include $CH_4$, $C_2H_2$ and $C_2H_6$. These C-feeding source gases may be used optionally after their dilution with a gas such as $H_2$, He, Ar or Ne.

Materials that can serve as source gases for feeding nitrogen or oxygen may include gaseous or gasifiable compounds such as $NH_3$, NO, $N_2O$, $NO_2$, $O_2$, CO, $CO_2$ and $N_2$. These nitrogen- or oxygen-feeding source gases may be used optionally after their dilution with a gas such as $H_2$, He, Ar or Ne.

The pressure inside the film-forming chamber (reactor) may appropriately be selected within an optimum range in accordance with layer designing. In usual cases, it may be set at from $1\times10^{-2}$ Pa to $1\times10^{3}$ Pa, and preferably from $5\times10^{-2}$ Pa to $5\times10^{2}$ Pa, and most preferably from $1\times10^{-1}$ Pa to $1\times10^{2}$ Pa.

The temperature of the substrate may also appropriately be selected within an optimum range in accordance with layer designing. In usual cases, the temperature may preferably be set at from 150° C. to 350° C., more preferably from 180° C. to 330° C., and most preferably from 200° C. to 300° C.

In the present invention, the film formation factors such as the dilute gas, the mixing ratio, gas pressure, discharge power and substrate temperature for forming the upper-part blocking layer 406 are by no means independently separately determined in usual cases. Optimum values of factors for forming the layer should be determined on the basis of mutual and systematic relationship so that photosensitive members having the desired characteristics can be formed.

The second layer 403 in the present invention may also optionally be provided with an a-Si type intermediate layer beneath the upper-part blocking layer 406.

The intermediate layer is constituted of a non-single-crystal material having as a base an amorphous silicon containing hydrogen (H) and/or a halogen (X) and composed chiefly of silicon atoms [a-Si(H,X)] and further containing at least one of atoms selected from carbon atoms, nitrogen atoms and oxygen atoms. Such a non-single-crystal material may include amorphous silicon carbide, amorphous silicon nitride and amorphous silicon oxide.

In this case, the intermediate layer may be continuously changed in composition from the photosensitive layer toward the upper-part blocking layer. This is effective in improving the adherence of film.

To form the intermediate layer, the substrate temperature (Ts) and the gas pressure inside the reactor must appropriately be set as desired. The substrate temperature (Ts) may appropriately be selected within an optimum range in accordance with layer designing. In usual cases, the temperature may preferably be set at from 150° C. to 350° C., more preferably from 180° C. to 330° C., and most preferably from 200° C. to 300° C.

The pressure inside the reactor may also likewise appropriately be selected within an optimum range in accordance with layer designing. In usual cases, it may be set at from $1\times10^{-2}$ Pa to $1\times10^{3}$ Pa, and preferably from $5\times10^{-2}$ Pa to $5\times10^{2}$ Pa, and most preferably from $1\times10^{-2}$ Pa to $1\times10^{2}$ Pa.

In the present invention, the second layer 403 may further optionally be provided, on the upper-part blocking layer 406, with a surface layer 407 formed of a non-single-crystal material, in particular, an a-Si material. This surface layer 407 has a free surface, and is effective in improvement chiefly in moisture resistance, performance for continuous repeated use, electrical breakdown strength, service environmental properties and running performance.

Including the a-Si type surface layer 407, the amorphous materials that form the photoconductive layer 405 constituting the first layer 402 and form the upper-part blocking layer 406 and surface layer 407 each have a common constituent, silicon atoms, and hence a chemical stability is well ensured at the interface between layers. Where an a-Si type material is used as a material for the surface layer 407, preferred is a compound with silicon atoms which contains at least one element selected from carbon, nitrogen and oxygen. In particular, one composed chiefly of a-SiC is preferred, i.e., an a-SiC surface layer.

Where the surface layer 407 contains at least one of carbon, nitrogen and oxygen, any of these atoms may preferably be in a content ranging from 30% to 90% based on all the atoms constituting a network.

The surface layer 407 is also incorporated therein with hydrogen atoms and/or fluorine atoms. This is essential and indispensable in order to compensate uncombined bonds of silicon atoms, and to improve layer quality, in particular, to improve photoconductivity and charge retentivity. The hydrogen atoms may usually be in a content of from 30 to 70 atomic %, preferably from 35 to 65 atomic %, and most preferably from 40 to 60 atomic %, based on the total amount of constituent atoms. The fluorine atoms may usually be in a content of from 0.01 to 15 atomic %, preferably from 0.1 to 10 atomic %, and more preferably from 0.5 to 5 atomic %.

The photosensitive member formed to have the hydrogen content and/or fluorine content within these ranges is well applicable as a product remarkably superior in its practical use. More specifically, any defects or imperfections (comprised chiefly of dangling bonds of silicon atoms or carbon atoms) present inside the surface layer 407 are known to have ill influences on the properties required for electrophotographic photosensitive members. For example, charge characteristics may deteriorate because of the injection of charges from the free surface; charge characteristics may vary because of changes in surface structure in a service environment, e.g., in an environment of high humidity; and the injection of electric charges into the surface layer from the photoconductive layer at the time of corona charging or irradiation with light may cause a remaining image phenomenon during repeated use because of entrapment of electric charges in the defects inside the surface layer. These can be cited as the ill influences.

However, the controlling of the hydrogen content in the surface layer 407 so as to be 30 atomic % or more brings a great decrease in the defects inside the surface layer 407, so that, as compared with conventional cases, improvements can be achieved in respect of electrical properties and high-speed continuous-use performance. On the other hand, if the hydrogen content in the surface layer 407 is more than 70 atomic %, the hardness of the surface layer 407 may lower, and hence the layer may come not to endure the repeated use. Thus, the controlling of hydrogen content in the surface layer 407 within the range set out above is one of very important factors for obtaining superior electrophotographic performance as desired. The hydrogen content in the surface layer 407 can be controlled according to the flow rate (ratio) of source gases, the support temperature, the discharge power, the gas pressure and so forth.

The controlling of fluorine atom content in the surface layer 407 so as to be within the range of 0.01 atomic % or more also makes it possible to more effectively generate the bonds between silicon atoms and carbon atoms in the surface layer 407. As a function of the fluorine atoms in the surface layer 407, it is also possible to effectively prevent the bonds between silicon atoms and carbon atoms from breaking because of damages caused by coronas or the like.

On the other hand, if the fluorine atom content in the surface layer 407 is more than 15 atomic %, it comes almost ineffective to generate the bonds between silicon atoms and carbon atoms in the surface layer 407 and to prevent the bonds between silicon atoms and carbon atoms from breaking because of damage caused by coronas or the like. Moreover, residual potential and image memory may become remarkably seen because the excessive fluorine atoms inhibit the mobility of carriers in the surface layer. Thus, the controlling of fluorine content in the surface layer 407 within the range set out above is one of important factors for obtaining the desired electrophotographic performance. The fluorine content in the surface layer 407, like the hydrogen content, can be controlled according to the flow rate ratio of source gases, the support temperature, the discharge power, the gas pressure and so forth.

In the present invention, the surface layer 407 may preferably be further incorporated with atoms capable of controlling its conductivity as needed. The atoms capable of controlling the conductivity may be contained in the surface layer 407 in an evenly uniformly distributed state, or may be contained partly in such a state that they are distributed non-uniformly in the layer thickness direction.

The atoms capable of controlling the conductivity may include what is called impurities in the field of semiconductors, and atoms belonging to Group 13 or Group 15 of the periodic table may be used.

The surface layer 407 may usually be formed in a thickness of from 0.01 to 3 μm, preferably from 0.05 to 2 μm, and most preferably from 0.1 to 1 μm. If the layer thickness is smaller than 0.01 μm, the surface layer 407 may become lost because of friction or the like during the use of the photosensitive member. If it is larger than 3 μm, a lowering in electrophotographic performance may occur because of an increase in residual potential.

To form a surface layer 407 having properties that can achieve the object of the present invention, the substrate temperature and the gas pressure inside the reactor must appropriately be set as desired. The substrate temperature (Ts) may appropriately be selected within an optimum range in accordance with layer designing. In usual cases, the temperature may preferably be set at from 150° C., to 350° C., more preferably from 180° C. to 330° C., and most preferably from 200° C. to 300° C.

The pressure inside the reactor may also likewise appropriately be selected within an optimum range in accordance with layer designing. In usual cases, it may be set at from $1\times10^{-2}$ Pa to $1\times10^{3}$ Pa, and preferably from $5\times10^{-2}$ Pa to $5\times10^{2}$ Pa, and most preferably from $1\times10^{-1}$ Pa to $1\times10^{2}$ Pa.

As source gases used to form the surface layer 407, the source gases used to form the upper-part blocking layer 406 may be used.

The second layer 403 may also include a surface layer formed of a non-single-crystal material composed chiefly of carbon, i.e., non-single-crystal carbon, and further containing hydrogen atoms. This surface layer is hereinafter often referred to as "a-C:H surface layer."

What is herein meant by "non-single-crystal carbon" chiefly indicates amorphous carbon having a nature intermediate between graphite and diamond, and may also partly contain a microcrystalline or polycrystalline component.

This a-C:H surface layer has a free surface, and is provided chiefly in order to achieve what is aimed in the present invention, i.e., the prevention of melt adhesion, scratching and wear in long-term service.

The a-C:H surface layer can be effective alike even when impurities are a little contained. For example, even when impurities such as Si, N, O, P and B are contained in the surface layer, the effect of the present invention is sufficiently obtainable as long as their content is about 10 atomic % or less based on the whole elements in the surface layer.

The a-C:H surface layer is incorporated with hydrogen atoms. Incorporation of hydrogen atoms effectively compensates any structural defects in the film to reduce the density of localized levels. Hence, the transparency of the film is improved and, in the surface layer, any unwanted absorption of light is kept from taking place, bringing an improvement in photosensitivity. Also, the presence of hydrogen atoms in the film is said to play an important role for the solid lubricity.

The hydrogen atoms incorporated in the a-C:H surface layer may preferably be in a content of from 41 to 60 atomic %, and more preferably from 45 to 50 atomic %, as H/(C+H). If the hydrogen atoms are in a content less than 41 atomic %, a narrow optical band gap may result, which is unsuitable in view of sensitivity. If on the other hand they are in a content more than 60 atomic %, a low hardness may result, tending to cause scrapes. The a-C:H surface layer is preferably usable as long as it has an optical band gap in a value of approximately from 1.2 to 2.2 eV, and preferably 1.6 eV or more in view of sensitivity. It is favorably usable as long as it has a refractive index of approximately from 1.6 to 2.8.

As to the layer thickness of the surface layer, the degree of interference is measured with a reflection spectral interferometer (MCPD2000, manufactured by Ohtsuka Denshi K.K.), and the layer thickness is calculated from the measured value and a known refractive index. The layer thickness of the surface layer may be controlled by conditions for film formation.

The a-C:H surface layer may have a layer thickness of from 5 nm to 2,000 nm, and preferably from 10 nm to 100 nm. If it has a layer thickness of less than 5 nm, it is difficult to obtain the intended effect in long-term service. If it has a layer thickness of more than 2,000 nm, it may turn necessary to take account of demerits such as a lowering of photosensitivity, and residual charge. Accordingly, it is better for the layer thickness to be 2,000 nm or less.

The surface layer may be deposited by known thin-film deposition processes as exemplified by glow discharging, sputtering, vacuum metallizing, ion plating, photo-assisted CVD and thermal CVD. Any of these thin-film deposition processes may be employed under appropriate selection in accordance with factors such as the conditions for manufacture, the extent of a load on capital investment in equipment, the scale of manufacture and the properties or performances desired on electrophotographic photosensitive members for electrophotographic apparatus to be produced. In view of productivity of the electrophotographic photosensitive members, it is preferable to use the same deposition process as that for the photoconductive layer.

As to the high-frequency power used to decompose source gases, it may preferably be as high as possible because the decomposition of hydrocarbons proceeds sufficiently. Stated specifically, as the quantity of electricity (W) per unit volume (ml) in unit time (min) in normal condition (normal) [(W·min/ml(normal)], it may usually be from 0.5 to 30, preferably from 0.8 to 20, and most preferably from 1 to 15. If it is too high, abnormal discharge may take place to cause deterioration of characteristics of the electrophotographic photosensitive member. Accordingly, the electric power must be controlled to a level not to cause such abnormal discharge.

As discharge frequency of the power used in plasma-assisted CVD when the surface layer in the present invention is formed, any frequencies may be used. In an industrial scale, preferably usable is both of hlgh-frequency power of from 1 MHz or more to less than 50 MHz, which is called an RF frequency band, and high-frequency power of a frequency of from 50 MHz or more to 450 MHz or less.

With regard to discharge space pressure set when the surface layer is deposited, it may preferably be kept at from 13.3 Pa to 1,333 Pa (0.1 Torr to 10 Torr) when a usual RF (typically 50 to 450 MHz) power is used, and from 0.133 Pa to 13.3 Pa (0.1 mTorr to 100 mTorr) when a VHF band (typically 50 to 450 MHz) power is used.

Materials that can serve as gases for feeding carbon may include, as those effectively usable, gaseous or gasifiable hydrocarbons such as $CH_4$, $C_2H_2$, $C_2H_6$, $C_3H_8$ and $C_4H_{10}$. In view of readiness in handling and carbon feed efficiency at the time of film formation, $CH_4$, $C_2H_2$ and $C_2H_6$ are preferred. Also, any of these carbon-feeding material gases may further optionally be diluted with a gas such as $H_2$, He, Ar or Ne when used.

In the case of the amorphous carbon (a-C), the substrate temperature may preferably be a low temperature. This is because graphite components may increase with a rise in substrate temperature to bring about undesirable influences such as a lowering of hardness, a lowering of transparency and a lowering of surface resistance. Accordingly, the substrate temperature may be controlled to from room temperature to 400° C., and may preferably be set at from 20° C. to 150° C.

The a-C:H surface layer in the present invention may further optionally incorporated with halogen atoms.

The a-C:H surface layer may also be divided into two layers on the side close to the photoconductive layer and on the side distant therefrom, and be so constructed that hydrogen atoms are added to the former (first surface layer) and halogen atoms, in particular, fluorine atoms are added to the latter (second surface layer). In such construction, conditions are so set that the first surface layer has a hardness (dynamic hardness) higher than that of the second surface layer. For example, when fluorine is added, it may be added in a content of from 6 atomic % to 50 atomic %, and preferably from 30 atomic % to 50 atomic %.

Such an a-C:H surface layer is favorably usable as long as it has an optical band gap in a value of approximately from 1.2 to 2.2 eV, and preferably 1.6 eV or more in view of sensitivity. It is favorably usable as long as it has a refractive index of approximately from 1.8 to 2.8.

In the case when the surface layer formed of a-C:H is deposited, it has the effect of controlling the image defects the upper-part blocking layer alone can not completely control, in virtue of the cooperative effect of the special effect the a-C:H film has and the effect of making the boundary portion 206 (FIG. 2) break off.

Details of the special effect the a-C:H film has are unclear at present, and it is presumed that such an effect is in virtue of a difference in growth process between the a-Si:H type film and the a-C:H film. It seems that the a-C:H film grows as if it fills in the hollows of boundary portions 206 of the upper-part blocking layer 205.

Figure 5:
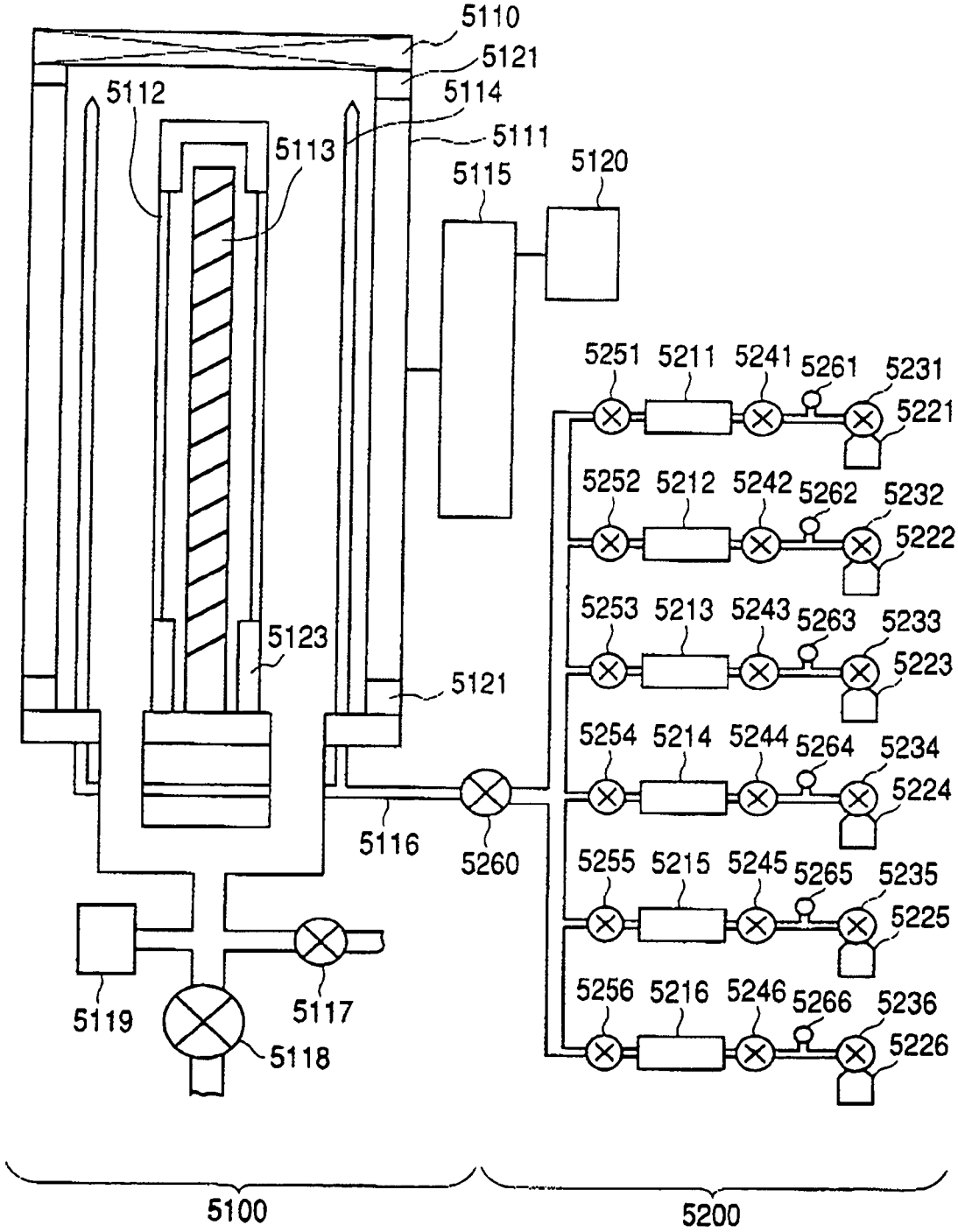
FIG. 5 is a diagrammatic sectional view of an a-Si photosensitive member film-forming apparatus making use of RF.
Figure 6:
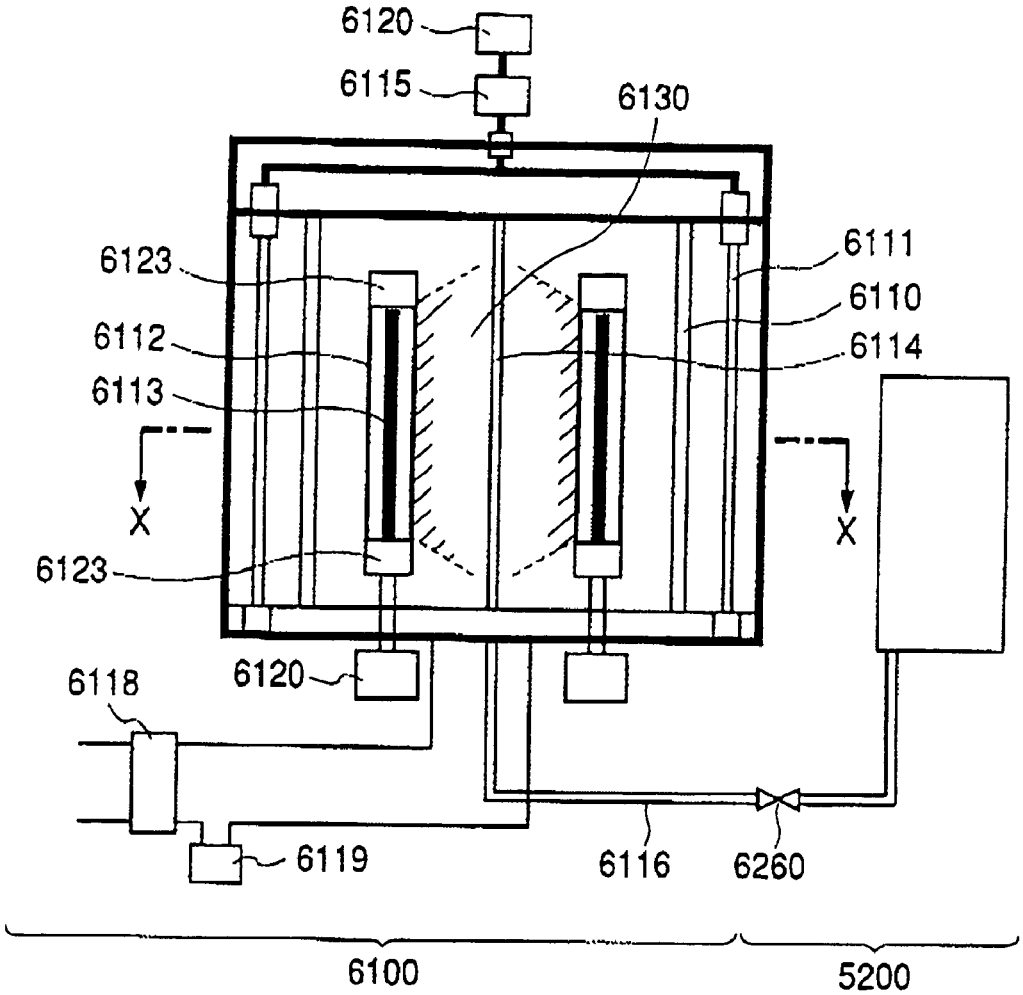
FIG. 6 is a diagrammatic sectional view of an a-Si photosensitive member film-forming apparatus making use of VHF.
Figure 6:
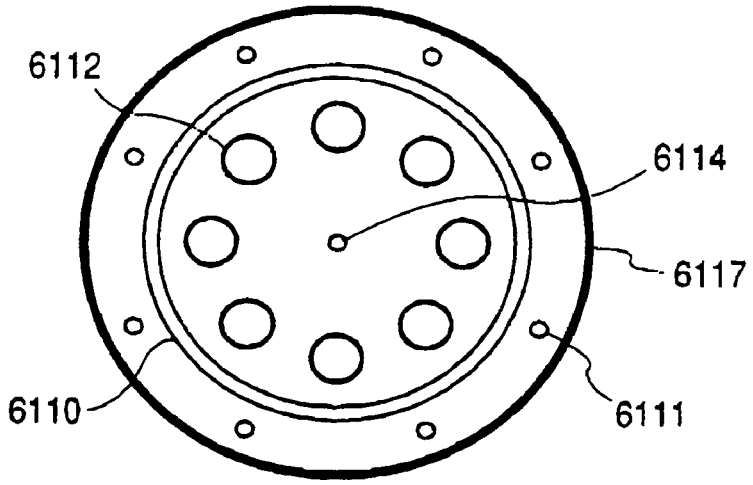

Desirable numerical ranges of the substrate temperature and gas pressure for forming the surface layer may include the ranges given above, but conditions are by no means independently separately determined in usual cases. Optimum values should be determined on the basis of mutual and systematic relationship so that photosensitive members having the desired characteristics can be formed.

a-Si Photosensitive Member Film Formation Apparatus According to the Present Invention FIG. 5 diagrammatically illustrates an example of a deposition apparatus for producing the photosensitive member by RF plasma-assisted CVD making use of an RF band high-frequency power source, used to form the second layer. FIG. 6 diagrammatically Illustrates an example of a deposition apparatus for producing the photosensitive member by VHF plasma-assisted CVD making use of a VHF power source, used to form the first layer.

These apparatus are each constituted chiefly of a deposition system 5100 or 6100, a material gas feed system 5200 and an exhaust system (not shown) for evacuating the inside of a film-forming chamber 5110. Incidentally, the apparatus shown in FIG. 6 is constructed by changing the deposition system 5100 shown in FIG. 5, for the deposition system 6100 shown in FIG. 6.

The first layer is formed by the deposition apparatus shown in FIG. 6, employing the VHF plasma-assisted CVD (first film-forming chamber). Here, the high-frequency power to be applied is supplied from a VHF power source with a frequency of from 50 MHz to 450 MHz, e.g., a frequency of 105 MHz. The pressure is kept at approximately from 13.3 mPa to 1,330 Pa, i.e., a pressure a little lower than that in the RF plasma-assisted CVD.

In the film-forming chamber 6110 in the deposition system 6100, cylindrical substrates 6112, heaters 6113 for heating the substrate, and a source gas feed pipe 6114 are provided. A high-frequency power source 6120 is further connected to the film-forming chamber via a high-frequency matching box 6115.

The source gas feed system 5200 is, as shown in FIG. 5, constituted of gas cylinders 5221 to 5226 for source gases such as $SiH_4$, $H_2$, $CH_4$, NO, $B_2H_6$ and $CF_4$, valves 5231 to 5236, 5241 to 5246 and 5251 to 5256, and mass flow controllers 5211 to 5216. The gas cylinders for the respective constituent gases are connected to the gas feed pipe 6114 in the film-forming chamber 6110 via a valve 6260.

The cylindrical substrates 6112 are set on conductive supporting stands 6123 and are thereby connected to the ground.

An example of procedure of forming photosensitive members by means of the apparatus shown in FIG. 6 is described below.

The cylindrical substrates 6112 are set in the film-forming chamber 6110, and the inside of the film-forming chamber 6110 is evacuated by means of an exhaust device (e.g., a vacuum pump; not shown). Subsequently, the temperature of each cylindrical substrate 6112 is controlled at a desired temperature of from 200° C. to 450° C., preferably from 250° C. to 350° C., by means of the heaters 6113 for heating the substrates. Next, in order that source gases for forming the photosensitive members are flowed into the film-forming chamber 6110, gas cylinder valves 5231 to 5236 and a leak valve 5117 of the source gas feed system 5200 are checked to make sure that they are closed, and also flow-in valves 5241 to 5246, flow-out valves 5251 to 5256 and an auxiliary valve 6260 are checked to make sure that they are opened. Then, a main valve 6118 is opened to evacuate the insides of the film-forming chamber 6110 and a gas feed pipe 6116.

Thereafter, at the time a vacuum gauge 6119 has been read to indicate a pressure of about 0.5 mPa, the auxiliary valve 6260 and the flow-out valves 5251 to 5256 are closed. Thereafter, valves 5231 to 5236 are opened so that gases are respectively introduced from gas cylinders 5221 to 5226, and each gas is controlled to have a pressure of 0.2 MPa by operating pressure controllers 5261 to 5266. Next, the flow-in valves 5241 to 5246 are slowly opened so that gases are respectively introduced into mass flow controllers 5211 to 5216.

After the film formation has been made ready to start as a result of the above procedure, the first layer. e.g., the photoconductive layer is first formed on each cylindrical substrate 6112.

That is, at the time the cylindrical substrates 6112 has had the desired temperature, some necessary ones among the flow-out valves 5251 to 5256 and the auxiliary valve 6260 are slowly opened so that desired source gases are fed into the film-forming chamber 6110 from the gas cylinders 5221 to 5226 through a gas feed pipe 6114. Next, the mass flow controllers 5211 to 5216 are operated so that each source gas is adjusted to flow at a desired rate. In that course, the opening of the main valve 6118 is adjusted while watching the vacuum gauge 6119 so that the pressure inside the film-forming chamber 6110 comes to a desired pressure of from 13.3 Pa to 1,330 Pa. At the time the inner pressure has become stable, a high-frequency power source 6120 is set at a desired electric power and a high-frequency power with a frequency of from 50 MHz to 450 MHz, e.g., 105 MHz is supplied to a cathode electrode 6111 through the high-frequency matching box 6115 to cause high-frequency glow discharge to take place. The source gases fed into the film-forming chamber 6110 are decomposed by the discharge energy thus produced, so that the desired first layer composed chiefly of silicon atoms is formed on the cylindrical support 6112.

In this apparatus, in a discharge space 6130 surrounded by the cylindrical substrates 6112, the source gases fed thereinto are excited by discharge energy to undergo dissociation, and a stated deposited film is formed on each cylindrical substrate 6112. Here, the cylindrical substrate is rotated at a desired rotational speed by means of a substrate-rotating motor 6120 so that the layer can uniformly be formed.

After a film with a desired thickness has been formed, the supply of high-frequency power is stopped, and the flow-out valves 5251 to 5256 are closed to stop gases from flowing into the film-forming chamber 6110. The formation of the first layer is thus completed. The composition and layer thickness of the first layer may be set according to known conventional ones. Also when the lower-part blocking layer is provided between the first layer and the substrate, basically the above procedure may previously be repeated.

It is important that each cylindrical substrate on which films have been formed up to the first layer in the manner described above (unfinished photosensitive member) is once taken out of the first film-forming chamber and is moved to the second film-forming chamber shown in FIG. 5. When it is taken out of the first film-forming chamber, the external appearance of the unfinished photosensitive member may be inspected to check any peeling or spherical protrusions. Also, image inspection and potential characteristics inspection may also be made.

Where an inspection is made in which the unfinished photosensitive member comes into contact with ozone, as in such image inspection and potential characteristics inspection, it is preferable to subject its surface to water washing or organic washing before the second layer is formed. In consideration of environment in recent years, water washing is preferred. Methods for the water washing are described later. The water washing thus carried out before the second layer is formed can more improve the adherence of the surface layer.

The unfinished photosensitive member having been thus exposed to the atmosphere is moved to the deposition apparatus employing the RF plasma-assisted CVD making use of an RF band high-frequency power, used to form the second layer (second film-forming chamber), and then the second layer comprising the upper-part blocking layer is formed. The film formation of the second layer may basically be conducted according to the film formation of the first layer except that a hydrocarbon gas such as $CH_4$ or $C_2H_6$ as a source gas and optionally a dilute gas such as $H_2$ are additionally used.

Here, the high-frequency power has a frequency of from 1 MHz to 50 MHz, e.g., 13.56 MHz, and such high-frequency power is supplied to a cathode electrode 5111 through the high-frequency matching box 5115 to cause high-frequency glow discharge to take place. The material gases fed into the film-forming chamber 5110 are decomposed by the discharge energy thus produced, so that the second layer composed chiefly of silicon atoms is formed on the cylindrical substrate 5112. During this film formation, the pressure is kept at approximately from 13.3 Pa to 1,330 Pa, which is a little higher than that in the VHF plasma-assisted CVD process.

The composition and layer thickness of the second layer may be set according to known conventional ones. Also when the second layer is deposited after the same layer as the first layer has been deposited in order to improve the adherence between the second layer and the first layer, basically the above procedure may previously be repeated.

The SiC type surface layer is further formed at the outermost surface, using an Si-containing gas and a carbon-containing gas. In that case as well, basically the above procedure may be repeated.

Surface-Polishing Apparatus According to the Present Invention

In the electrophotographic photosensitive member production process of the present invention, the substrate on which the first layer has been deposited may be polished by bringing a polishing tape into contact with the surface of the first layer having been deposited in the first step, by means of an elastic rubber roller, providing a relative difference in speed between the rotational-movement speed of the first-layer surface rotationally moved together with the cylindrical substrate and the rotational-movement speed of the elastic roller which brings the polishing tape into contact with that surface.

Figure 7:
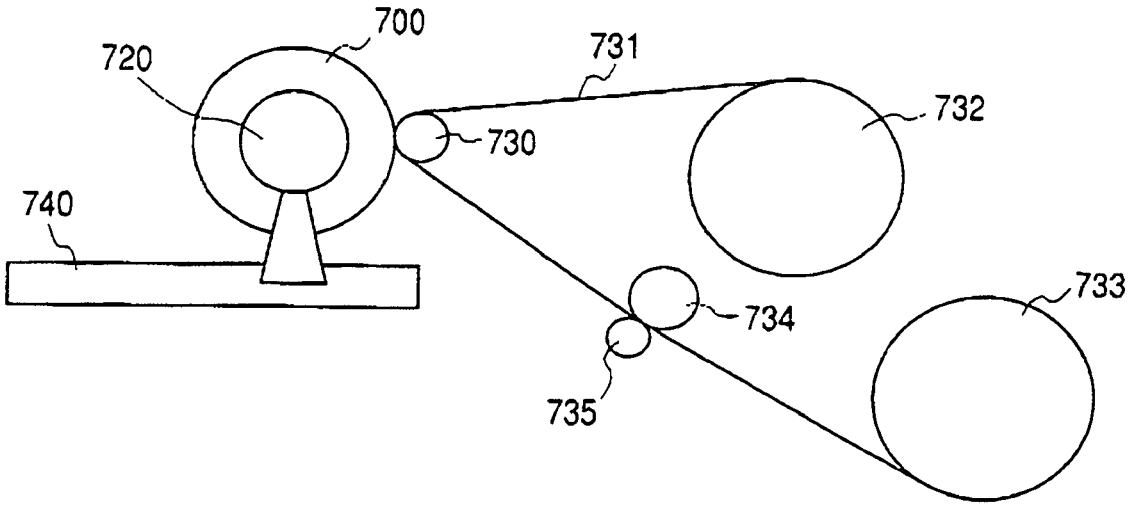
FIG. 7 is a diagrammatic sectional view of a surface-polishing apparatus used in the present invention.

FIG. 7 shows an example of a surface-polishing apparatus used in the production process for the electrophotographic photosensitive member of the present invention when the surface working is carried out, stated specifically, an example of a surface-polishing apparatus used when polishing is carried out as the surface working.

In the example of construction of the surface-polishing apparatus shown in FIG. 7, a working object member (the surface of the deposited film on the cylindrical substrate) 700 is the cylindrical substrate on the surface of which the first layer formed of a-Si has been deposited, and is attached to an elastic support mechanism 720. In the apparatus shown in FIG. 7, for example, an air pressure holder is used as the elastic support mechanism 720. Stated specifically, an air pressure holder manufactured by Bridgestone Corporation (trade name: AIR PICK; model: PO45TCA*820) is used. A pressure elastic roller 730 is pressed against the surface of the a-Si first layer of the working object member 700 via a polishing tape 731 put around the roller.

The polishing tape 731 is delivered from a wind-off roll 732 and wound up on a wind-up roll 733. Its delivery speed is regulated by a constant-rate delivery roll 734 and a capstan roller 735, and its tension is also regulated by them. As the polishing tape 731. a tape usually called a lapping tape may preferably be used. When the first layer such as the photoconductive layer formed of a non-single-crystal material such as a-Si or an intermediate layer such as the upper-part blocking layer is subjected to surface working, a lapping tape may be used in which SiC, $Al_2O_3$, $Fe_2O_3$ or the like is used as abrasive grains. Stated specifically, a lapping tape LT-C2000, available from Fuji Photo Film Co., Ltd, is used.

The pressure elastic roller 730 has its roller part made of a material such as neoprene rubber or silicone rubber, and has a JIS rubber hardness in the range of from 20 to 80, and preferably a JIS rubber hardness in the range of from 30 to 60. The roller part may also preferably have such a shape that it has a diameter which is larger at the middle portion than that at both ends, preferably having, e.g., a diameter difference between them in the range of from 0.0 to 0.6 mm, and more preferably in the range of from 0.2 to 0.4 mm. The pressure elastic roller 730 is pressed against the working object member (the surface of the deposited film on the cylindrical substrate) 700 being rotated, at a pressure in the range of from 0.05 MPa to 0.2 MPa, during which the lapping tape 731, e.g., the above lapping tape is fed between them to polish the deposited-film surface.

Where the surface polishing is carried out in the atmosphere, a means of wet polishing such as buffing may also be used besides the above means making use of the polishing tape. Also, when this means of wet polishing is used, the step of removing by washing a liquid used for polishing is provided after the polishing step. In such a case, treatment in which the surface is brought into contact with water to wash the surface may also be made in combination.

In this way, the layer-forming interfaces as described previously, involving amorphous silicon, are made flat to make the layer-forming interfaces have discontinuous interfaces, whereby, as shown in FIG. 3, the boundary 306 between the spherical protuberance 303 and the normal deposited portion of the first layer 302 is more completely sealed. Hence, it is harder for the acquired electric charges to pass through that boundary, and a photosensitive member can be obtained which has the effect of keeping image defects from occurring more effectively.

Means by which Surface Profile is Ascertained Before and After the Surface Working in the Production Process for the Electrophotographic Photosensitive Member of the Present Invention In the electrophotographic photosensitive member of the present invention, the second layer is deposited on the surface of the first layer or intermediate layer having been subjected to the above surface working. Here, the working may preferably be so carried out that the surface properties come to be in a certain specific value as a result of the surface working, e.g., the polishing.

Microscopic changes in a surface state before and after this surface working differ from macroscopic surface roughness, and changes of microscopic surface profile must be observed. Evaluation of such changes of microscopic surface profile can provide more suitable conditions in respect of the surface working conditions in the production process for the electrophotographic photosensitive member of the present invention.

Stated specifically, as a means for ascertaining the substantial surface state before and after the surface working, it is preferable to investigate the changes of surface at an atomic level by means of, e.g., an atomic-force microscope (AFM), stated specifically, a commercially available atomic-force microscope (AFM) Q-Scope 250, manufactured by Quesant Co. The reason why an observation means is used having so high a resolution as to require the use of the atomic-force microscope (AFM) is that, in order to ascertain the presence of any change at the part of normal areas as a result of surface working, e.g., polishing, what is more important is not to observe roughness in the order of hundreds of nanometers (nm) which is governed by the surface roughness of the cylindrical substrate itself used, but to take note of finer roughness resulting from the character of the deposited film itself, such as the photoconductive layer or the intermediate layer, and observe its changes exactly.

Such fine roughness can be measured in a high precision and a good reproducibility with, e.g., the AFM by narrowing the range of measurement and also avoiding any systematic errors ascribable to a curvature tilt of sample surface. Stated specifically, as a measuring mode of the above Q-Scope 250, manufactured by Quesant Co., the tilt removal mode may be selected, and, after the curvature an AFM image of the sample has is fitted to a parabola, it is made flat to make correction (parabolic correction). The surface shape of the electrophotographic photosensitive member assumes a cylindrical shape on the whole, and hence the above method of observation making use of the above flattening correction is a preferred method. When any tilt remains in the whole image, the correction to remove the tilt may further be executed (line-by-line correction). Thus, the tilt of sample surface may appropriately be corrected within the range that does not cause any strain in the data. This allows extraction of only the intended information on the finer roughness resulting from the character of the deposited film itself.

Water Washing System According to the Present Invention

With regard to the washing with water, it is disclosed in, e.g., Japanese Patent No. 2786756 (corresponding to U.S. Pat. No. 5,314,780). An example of the water washing system (washer) usable in the present invention is shown in FIG. 8.

Figure 8:
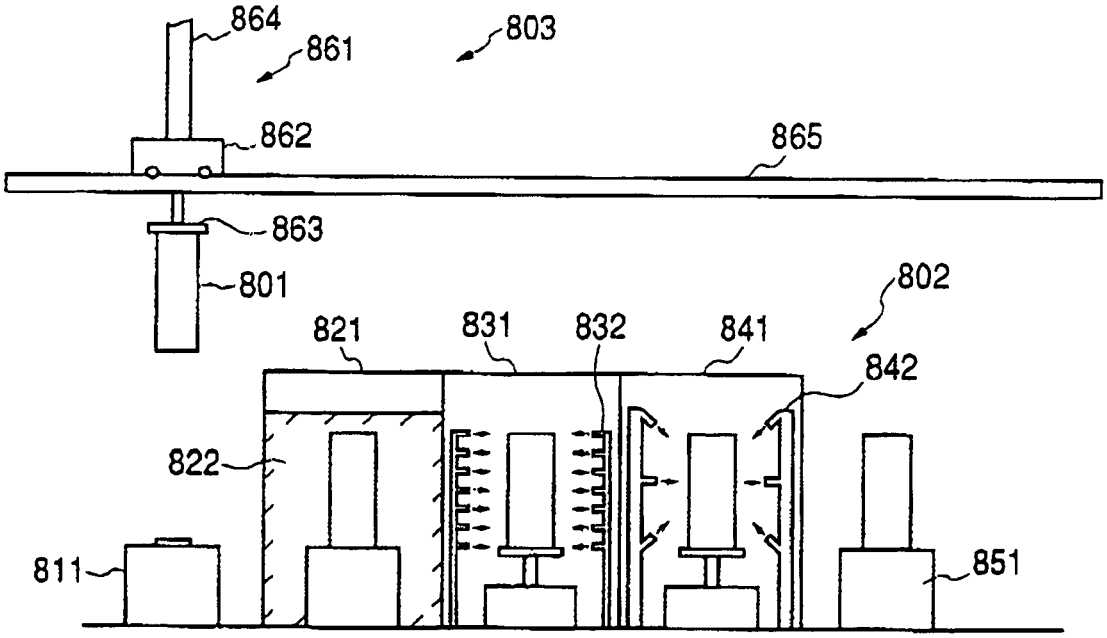
FIG. 8 is a diagrammatic sectional view of a water washing system used in the present invention.

The washing system shown in FIG. 8 consists of a treating section 802 and a treating object member transport mechanism 803. The treating section 802 consists of a treating object member feed stand 811, a treating object member wash chamber 821, a pure-water contact chamber 831, a drying chamber 841 and a treating object member delivery stand 851. The wash chamber 821 and the pure-water contact chamber 831 are both fitted with temperature control units (not shown) for keeping the liquid temperature constant. The transport mechanism 803 consists of a transport rail 865 and a transport arm 861, and the transport arm 861 consists of a moving mechanism 862 which moves on the rail 865, a chucking mechanism 863 which holds a treating object member 801, and an air cylinder 864 for up and down moving the chucking mechanism 853. The treating object member 801 placed on the feed stand 811 is transported to the wash chamber 821 by means of the transport mechanism 803. Any oil and powder adhering to the surface are washed away in the wash chamber 821 by ultrasonic treatment made in a wash liquid 822 comprised of an aqueous surface-active agent solution. Next, the treating object member 801 is carried to the pure-water contact chamber 831 by means of the transport mechanism 803, where pure water with a resistivity of 175 kΩ·m (17.5 MΩ·cm), kept at a temperature of 25° C., is sprayed against it from a nozzle 832 at a pressure of 4.9 MPa. The treating object member 801 for which the step of pure-water contact has been finished is moved to the drying chamber 841 by means of the is transport mechanism 803, where high-temperature high-pressure air is blown against it from a nozzle 842, so that the treating object member is dried. The treating object member 801 for which the step of drying has been finished is carried to the delivery stand 851 by means of the transport mechanism 803.

Electrophotographic Apparatus According to the Present Invention

Figure 9:
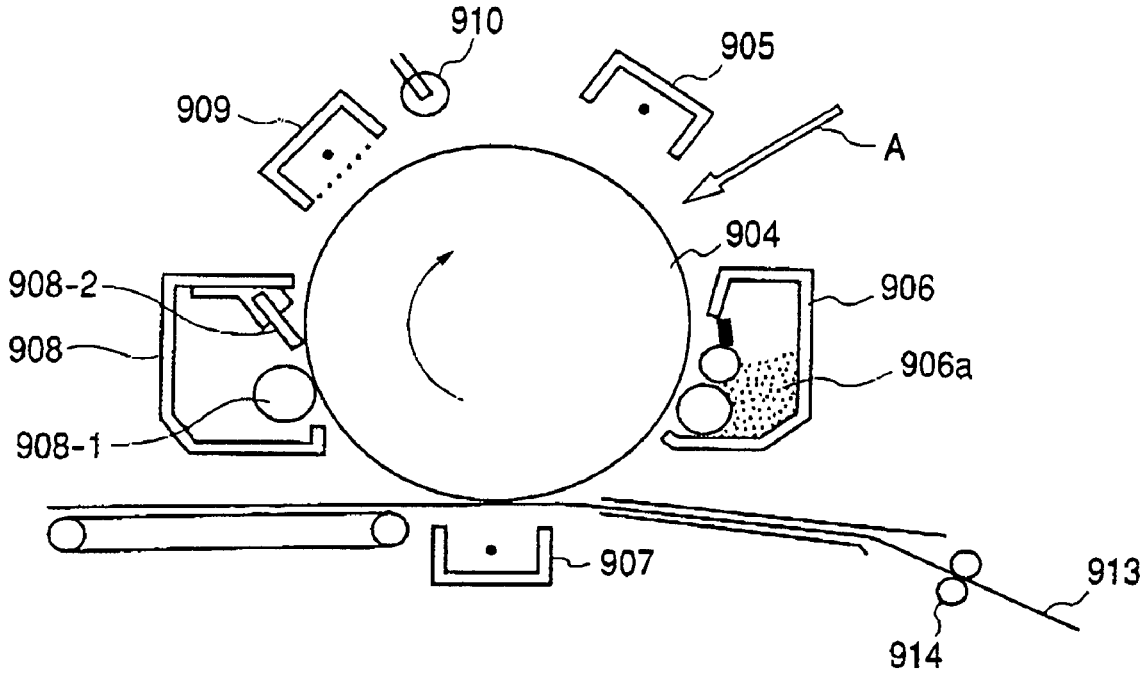
FIG. 9 is a diagrammatic sectional view showing an example of an electrophotographic apparatus making use of a corona charging system.

An example of an electrophotographic apparatus making use of the electrophotographic photosensitive member of the present invention is shown in FIG. 9. The apparatus of this example is suited when a cylindrical electrophotographic photosensitive member is used. The electrophotographic apparatus of the present invention is by no means limited to this example, and the photosensitive member may have any desired shape such as the shape of an endless belt.

In FIG. 9, reference numeral 904 denotes the electrophotographic photosensitive member which is referred to in the present invention; and 905, a primary charging assembly which performs charging in order to form an electrostatic latent image on the photosensitive member 904. In FIG. 9, a corona charging assembly is illustrated. Reference numeral 906 denotes a developing assembly for feeding a developer (toner) **906*a* to the photosensitive member on which the electrostatic latent image has been formed; and 907, a transfer charging assembly for transferring the toner on the photosensitive member surface to a transfer medium. Reference numeral 908 denotes a cleaner with which the photosensitive member surface is cleaned. In this example, in order to perform uniform cleaning of the photosensitive member surface effectively, the photosensitive member is cleaned by means of an elastic roller 908-1 and a cleaning blade 908-2. However, other construction may also be designed in which only any one of them is provided or the cleaner 908 itself is not provided. Reference numerals 909 and 910 denotes an AC charge eliminator and a charge elimination lamp, respectively, for eliminating electric charges from the photosensitive member surface so as to be prepared for the next-round copying operation. Of course, other construction may also be designed in which any one of them is not provided or both are not provided. Reference numeral 913 denotes a transfer medium such as paper; and 914**, a transfer medium feed roller. As a light source of exposure A. a halogen light source or a light source such as a laser or LED chiefly of single wavelength is used.

Using such an apparatus, copied images are formed, e.g., in the following way.

First, the electrophotographic photosensitive member 904 is rotated in the direction of an arrow at a stated speed, and the surface of the photosensitive member 904 is uniformly electrostatically charged by means of the primary charging assembly 905. Next, the surface of the photosensitive member 904 thus charged is subjected to exposure A for an image to form an electrostatic latent image of the image on the surface of the photosensitive member 904. Then, when the surface of the photosensitive member 904 at its part where the electrostatic latent image has been formed passes the part provided with the developing assembly 906, the toner is fed to the surface of the photosensitive member 904 by means of the developing assembly 906, and the electrostatic latent image is rendered visible (developed) as an image formed of the toner **906*a* (toner image). As the photosensitive member 904 is further rotated, this toner image reaches the part provided with the transfer charging assembly 907, where it is transferred to the transfer medium 913 forwarded by means of the feed roller 914**.

After the transfer has been completed, to make preparation for the next copying step, the surface of the photosensitive member 904 is cleaned to remove residual toner therefrom by means of the cleaner 908, and is further subjected to charge elimination by means of the charge eliminator 909 and charge elimination lamp 910 so as to make the potential of that surface zero or almost zero. Thus, a first-time copying step is completed.

There are many localized levels in the electrophotographic photosensitive member 904, and hence some photocarriers are captured in the localized levels, so that their mobility lowers or the rate of recombination of photocarriers lowers. As the result, photo-carriers produced upon image information exposure remain in the interior of the photosensitive member and are released from the localized levels at the time of charging or thereafter. Hence, a difference in surface potential is produced between exposed areas and unexposed areas, and this tends to appear finally as image formation history (hereinafter "ghost") caused by photo-memory.

Accordingly, in electrophotographic apparatus making use of a conventional electrophotographic photosensitive member 904, it has been done to provide a charge elimination light source in order to eliminate such ghost. As the charge elimination light source, it is common to use an LED array, which can strictly control wavelength and amount of light. This is because, if the ability to eliminate photo-memory is made higher at random, a difficulty may be raised in respect of how charging efficiency is secured and potential shift is lessened.

As described above, the electrophotographic photosensitive member production process is carried out which comprises the steps of:

as a first step, placing a cylindrical substrate in a first film-forming chamber having an evacuation means and a source gas feed means and capable of being made vacuum-airtight, and decomposing at least a source gas by means of a high-frequency power to deposit on the substrate a first layer formed of at least the non-single-crystal material;

as a second step, taking out of the first film-forming chamber the cylindrical substrate on which the first layer has been deposited, and moving the same to a second film-forming chamber; and as a third step, decomposing a source gas by means of a high-frequency power in the second film-forming chamber to deposit on the first layer a second layer comprising an upper-part blocking layer formed of at least a non-single-crystal material. By carrying out this process, the spherical protuberances present at the photosensitive member surface can be made not to appear on images. As the result, it has been made possible to provide an electrophotographic photosensitive member production process which can vastly remedy the image defects.

The image defects can be reduced when the first film-forming chamber used in the first step is the photosensitive member production apparatus of a VHF system, and the second film-forming chamber used in the third step is the photosensitive member production apparatus of an RF system.

In the second step, the protuberant portions of the spherical protuberances may be polished to make them flat and thereafter the second layer may be deposited. This can make the spherical protuberances appear less frequently on images. As a result, the image defects can be reduced.

It is more preferable that the unfinished photosensitive member is brought into contact with water between the first step and the second step. Stated specifically, it is washed with water. This brings an improvement in adherence when the surface layer is formed thereon, and brings a very broad latitude for film come-off.

The inspection may also optionally be made in the second step on the unfinished photosensitive member. This makes it possible to omit subsequent steps in respect of unfinished photosensitive members found to have poor quality, bringing cost reduction as a whole.

EXAMPLES

The present invention is described below by giving Examples and Comparative Examples. The present invention is by no means limited by these.

Example A-1

Using the a-Si photosensitive member film formation apparatus (first film-forming chamber) shown in FIG. 6, a photoconductive layer was deposited as the first layer on each cylindrical aluminum substrate of 108 mm in diameter under conditions shown in Table A-1.

TABLE A-1

| | Photoconductive layer |
|---|---|
| Source gas and flow rate: | |
| $SiH_4$ [ml/min(normal)] | 200 |
| $H_2$ [ml/min(normal)] | 400 |
| Substrate temperature: | |
| (° C.) | 240 |
| Reactor internal pressure: | |
| (Pa) | 0.7 |
| High-frequency power: | |
| (W) | 500 |
| Layer thickness: | |
| (μm) | 25 |

normal: volume in standard condition

Next, each substrate on which the first layer was formed was moved to the second film-forming chamber shown in FIG. 5, in a vacuum state by using a transport chamber, and as the second layer an upper-part blocking layer and a surface layer were deposited on the first layer under conditions shown in Table A-2.

TABLE A-2

| | Upper-part blocking layer | Surface layer |
|---|---|---|
| Source gas and flow rate: | | |
| $SiH_4$ [ml/min(normal)] | 200 | 50 |
| $B_2H_6$ (ppm) (based on $SiH_4$) | 1,000 | — |
| $CH_4$ [ml/min(normal)] | 200 | 500 |
| Substrate temperature: | | |
| (° C.) | 220 | 220 |
| Reactor internal pressure: | | |
| (Pa) | 67 | 67 |
| High-frequency power: | | |
| (W) | 300 | 300 |
| Layer thickness: | | |
| (μm) | 0.3 | 0.5 |

The photosensitive members obtained following the above procedure were photosensitive members used under negative charging, and were evaluated in the following way.

Number of Spherical Protuberances:

The surface of each photosensitive member obtained was observed on an optical microscope. Then, the number of spherical protuberances larger than 20 μm in diameter was counted to examine their number per 10 $cm^2$. The results obtained were ranked by relative comparison regarding as 100% the value obtained in Comparative Example A-2.

A: From 35% or more to less than 65%.

B: From 65% or more to less than 95%.

C: Equal to Comparative Example A-2.

Image Defects:

In an electrophotographic apparatus employing a corona discharge system as a primary charging assembly, the electrophotographic photosensitive member obtained in this Example was set, and images were formed. Stated specifically, a copying machine GP-605 (manufactured by CANON INC.; process speed: 300 mm/sec; image exposure) was used as a base machine which was so remodeled that negative charging also was performable, and its toner was changed for a negative toner. Using this copying machine as a test electrophotographic apparatus, copies of an A3-size white blank original were taken. Images thus obtained were observed, and the number of black dots coming from spherical protuberances of 0.3 mm or more in diameter was counted. The results obtained were ranked by relative comparison regarding as 100% the value obtained in Comparative Example A-2.

A: From 35% or more to less than 65%.

B: From 65% or more to less than 85%.

C: From 85% or more to less than 95%.

D: Equal to Comparative Example A-2.

Charging Performance:

The electrophotographic photosensitive member was set in the electrophotographic apparatus, and a high-voltage of +6 kV (in a case of positive charging) or −6 kV (In a case of negative charging) was applied to its, charging assembly to perform corona charging, where the dark-area surface potential of the electrophotographic photosensitive member was measured with a surface potentiometer installed at the position of the developing assembly. The results obtained were ranked by relative evaluation regarding as 100% the value obtained in Comparative Example A-3.

AA: 125% or more.

A: From 115% or more to less than 125%.

B: From 105% or more to less than 115%.

C: Equal to Comparative Example A-3.

Residual Potential:

The electrophotographic photosensitive member was charged to a constant dark-area surface potential (450 V). Then, this was immediately irradiated with relatively strong light (5 Lux·sec) in a constant amount of light. Here, the residual potential of the electrophotographic photosensitive member was measured with a surface potentiometer installed at the position of the developing assembly. The results obtained were ranked by relative evaluation regarding as 100% the value obtained in Comparative Example A-3.

A: Less than 85%.

B: From 85% or more to less than 95%.

C: Equal to Comparative Example A-3.

Potential Uniformity:

The electrophotographic photosensitive member was charged to a constant dark-area surface potential (450 V). Then, this was immediately irradiated with light (0.5 Lux·sec) in a constant amount of light. Here, the surface potential of the electrophotographic photosensitive member at its middle portion in the drum axial direction was measured with a surface potentiometer installed at the position of the developing assembly. Then, the potential distribution in the peripheral direction and drum axial direction was measured, and the value of a maximum value minus a minimum value was calculated. The results obtained were ranked by relative evaluation regarding as 100% the value obtained in Comparative Example A-3.

A: Less than 95%.

B: From 95% or more to less than 105%.

C: Equal to Comparative Example A-3.

Cost:

Production time for each photosensitive member was calculated, and was regarded as cost for each. The VHF system deposition apparatus shown in FIG. 6 can produce eight electrophotographic photosensitive members each time. The RF system deposition apparatus shown in FIG. 5 produces one electrophotographic photosensitive members each time. The results obtained were ranked by relative evaluation regarding as 100% the value obtained in Comparative Example A-4.

A: Less than 85%.

B: From 85% or more to less than 95%.

C: Equal to Comparative Example A-4.

Overall evaluation was made by the above methods. The results are shown in Table A-5 together with those of Comparative Examples A-1, A-2. A-3 and A-4.

Comparative Example A-1

Using the first film-forming chamber shown in FIG. 6, the first layer photoconductive layer was formed on each cylindrical aluminum substrate of 108 mm in diameter under conditions shown in Table A-1. Subsequently, as the second layer an upper-part blocking layer and a surface layer were deposited on the first layer under conditions shown in Table A-3. The negative-charging photosensitive members thus produced were evaluated in the same manner as in Example A-1 to obtain the results shown in Table A-5.

Comparative Example A-2

Using the a-Si photosensitive member film formation apparatus shown in FIG. 5, the first layer photoconductive layer was formed on a cylindrical aluminum substrate of 108 mm in diameter under conditions shown in Table A-4. Subsequently, as the second layer an upper-part blocking layer and a surface layer were deposited on the first layer under conditions shown in Table A-2. The negative-charging photosensitive member thus produced was evaluated in the same manner as in Example A-1 to obtain the results shown in Table A-5.

Comparative Example A-3

Using the a-Si photosensitive member film formation apparatus shown in FIG. 6, the first layer photoconductive layer was formed on each cylindrical aluminum substrate of 108 mm in diameter under conditions shown in Table A-1. Each substrate on which the first layer was formed was moved to the second film-forming chamber shown in FIG. 5, in a vacuum state by using a transport chamber, and, in this Comparative Example, the upper-part blocking layer in the second layer shown in Table A-2 was not formed and only the surface layer was deposited on the first layer. Each negative-charging photosensitive member thus produced was evaluated in the same manner as in Example A-1 to obtain the results shown in Table A-5.

Comparative Example A-4

Using the a-Si photosensitive member film formation apparatus shown in FIG. 6, the first layer photoconductive layer was formed on each cylindrical aluminum substrate of 108 mm in diameter under conditions shown in Table A-4. The substrate on which the first layer was formed was moved to the second film-forming chamber shown in FIG. 5, in a vacuum state by using a transport chamber, and, as the second layer, an upper-part blocking layer and a surface layer were deposited on the first layer under the conditions shown in Table A-2. Each negative-charging photosensitive member thus produced was evaluated in the same manner as in Example A-1 to obtain the results shown in Table A-5.

TABLE A-3

| | Upper-part blocking layer | Surface layer |
|---|---|---|
| Source gas and flow rate: | | |
| $SiH_4$ [ml/min(normal)] | 100 | 50 |
| $B_2H_6$ (ppm) (based on $SiH_4$) | 500 | — |
| $CH_4$ [ml/min(normal)] | 100 | 100 |
| Substrate temperature: | | |
| (° C.) | 240 | 200 |
| Reactor internal pressure: | | |
| (Pa) | 0.6 | 0.6 |
| High-frequency power: | | |
| (W) | 300 | 300 |
| Layer thickness: | | |
| (μm) | 0.3 | 0.5 |

TABLE A-4

| | Photoconductive layer |
|---|---|
| Source gas and flow rate: | |
| $SiH_4$ [ml/min(normal)] | 400 |
| $H_2$ [ml/min(normal)] | 400 |
| Substrate temperature: | |
| (° C.) | 240 |
| Reactor internal pressure: | |
| (Pa) | 67 |
| High-frequency power: | |
| (W) | 500 |
| Layer thickness: | |
| (μm) | 25 |

TABLE A-5

| | Example | Comparative Example | | | |
|---|---|---|---|---|---|
| Evaluation | A-1 | A-1 | A-2 | A-3 | A-4 |
| Number of spherical protuberances: | C | C | C | C | C |
| Number of image defects: | B | C | C | D | C |
| Charging performance: | A | A | A | C | A |
| Residual potential: | A | A | A | C | A |
| Potential uniformity: | A | A | B | B | B |
| Cost: | A | A | B | A | C |

As can be seen from Table A-5, the photosensitive member of the present invention is very improved in the number of image defects, dots, even though the number of spherical protuberances are on the same level as those in Comparative Examples A-1 to A-4.

In Comparative Example A-1, the VHF system is subsequently employed for the deposition of the second layer, where the growth mechanism is identical, and the image defects were little reduced in number. Hence, the effect of reducing dots was exhibited only a little. In Comparative Example A-2, the RF system is subsequently employed for the deposition of the first layer and for the deposition of the second layer. As the result, since the growth mechanism is identical, the image defects were little reduced in number.

It can also be understood that, as shown in Example A-1 and Comparative Examples A-1 and A-2, providing the upper-part blocking layer brings improvements in charging performance and residual potential, and the image defects were reduced in number.

Example A-2

Using the first film-forming chamber shown in FIG. 6, layers up to a photoconductive layer were deposited as the first layer on each cylindrical aluminum substrate of 108 mm in diameter under conditions shown in Table A-6.

TABLE A-6

| | Lower-part blocking layer | Photoconductive layer |
|---|---|---|
| Source gas and flow rate: | | |
| $SiH_4$ [ml/min(normal)] | 150 | 150 |
| $H_2$ [ml/min(normal)] | 150 | 150 |
| $B_2H_4$ (ppm) (based on $SiH_4$) | 500 | 0.3 |
| NO [ml/min(normal)] | 10 | — |
| Substrate temperature: | | |
| (° C.) | 200 | 200 |
| Reactor internal pressure: | | |
| (Pa) | 0.8 | 0.8 |
| High-frequency power: | | |
| (W) | 300 | 300 |
| Layer thickness: | | |
| (μm) | 3 | 30 |

Next, in that state, each substrate on which the first layer was formed was moved to the second film-forming chamber shown in FIG. 5, in a vacuum state by using a transport chamber, and as the second layer an upper-part blocking layer was deposited on the first layer under conditions shown in Table A-7.

TABLE A-7

| | Upper-part blocking layer |
|---|---|
| Source gas and flow rate: | |
| $SiH_4$ [ml/min(normal)] | 200 |
| $PH_3$ (ppm) (based on $SiH_4$) | 1,000 |
| $CH_4$ [ml/min(normal)] | 200 |
| Substrate temperature: | |
| (° C.) | 240 |
| Reactor internal pressure: | |
| (Pa) | 67 |
| High-frequency power: | |
| (W) | 300 |
| Layer thickness: | |
| (μm) | 0.3 |

The photosensitive members obtained following the above procedure were photosensitive members used under positive charging, and were evaluated in the same manner as in Example A-1, a copying machine basing on GP-605 (manufactured by CANON INC.) as a test electrophotographic apparatus. The results are shown in Table A-8.

Example A-3

Electrophotographic photosensitive members were produced in the same manner as in Example A-2 except that each substrate on which the first layer was formed was taken out of the first film-forming chamber and exposed to the atmosphere. Evaluation was made in the same manner as in Example A-1 to obtain the results shown in Table A-8.

TABLE A-8

| Evaluation | Example A-2 | Example A-3 |
|---|---|---|
| Number of spherical protuberances: | C | C |
| Number of image defects: | B | B |
| Charging performance: | A | A |
| Residual potential: | A | A |
| Potential uniformity: | A | A |
| Cost: | A | A |

As can be seen from Table A-8, the effect of the present invention is obtainable where the unfinished photosensitive drum is moved from the first film-forming chamber of a high-vacuum film formation system and the second layer is formed in the second film-forming chamber of an RF-system. Also, when it is moved from the first film-forming chamber to the second film-forming chamber, it may be moved in vacuum or exposed to the atmosphere.

Example A-4

Using the first film-forming chamber shown in FIG. 6, a lower-part blocking layer and up to a photoconductive layer were deposited as the first layer on each cylindrical aluminum substrate of 108 mm in diameter under conditions shown in Table A-9.

TABLE A-9

| | Lower-part blocking layer | Photoconductive layer |
|---|---|---|
| Source gas and flow rate: | | |
| $SiH_4$ [ml/min(normal)}] | 200 | 200 |
| $PH_3$ (ppm) (based on $SiH_4$) | 1,500 | 1.0 |
| NO [ml/min(normal)] | 10 | — |
| Substrate temperature: | | |
| (° C.) | 200 | 200 |
| Reactor internal pressure: | | |
| (Pa) | 0.8 | 0.8 |
| High-frequency power: | | |
| (W) | 1,000 | 2,000 |
| Layer thickness: | | |
| (μm) | 3 | 30 |

Next, each substrate on which the first layer was deposited was first taken out of the first film-forming chamber into the atmosphere, and then moved to the second film-forming chamber shown in FIG. 5, where as the second layer an upper-part blocking layer and a surface layer were deposited on the first layer under conditions shown in Table A-10.

TABLE A-10

| | Upper-part blocking layer | Surface layer |
|---|---|---|
| Source gas and flow rate: | | |
| $SiH_4$ [ml/min(normal)] | 150 | 20 |
| $B_2H_6$ (ppm)} (based on $SiH_4$) | 3,000 | — |
| $CH_4$ [ml/min(normal)] | 150 | 700 |
| Substrate temperature: | | |
| (° C.) | 240 | 200 |
| Reactor internal pressure: | | |
| (Pa) | 50 | 48 |
| High-frequency power: | | |
| (W) | 350 | 280 |
| Layer thickness: | | |
| (μm) | 0.5 | 0.5 |

The negative-charging photosensitive members obtained following the above procedure were evaluated in the same manner as in Example A-1. The results are shown in Table A-11.

Example A-5

Using the first film-forming chamber shown in FIG. 6, a lower-part blocking layer and up to a photoconductive layer were deposited as the first layer on each cylindrical aluminum substrate of 108 mm in diameter under conditions shown in Table A-9.

Next, each substrate on which the first layer was deposited was first taken out of the first film-forming chamber into the atmosphere. Then, in this Example, at this stage, its surface was polished by means of the polishing apparatus shown in FIG. 7, to flatten the protuberant portions of the spherical protuberances. For this flattening, the polishing was so carried out that the height of a protuberance decreased from about 10 μm to 0.5 μm or less when measured with a laser microscope.

Next, the substrate on which the first layer was deposited and then polished was cleaned by means of the water washing system shown in FIG. 8. Thereafter, this was moved to the second film-forming chamber shown in FIG. 5, where as the second layer an upper-part blocking layer and a surface layer were deposited on the first layer under conditions shown in Table A-10.

The negative-charging photosensitive members obtained following the above procedure were evaluated in the same manner as in Example A-1. The results are shown in Table A-11.

TABLE A-11

| Evaluation | Example A-4 | Example A-5 |
|---|---|---|
| Number of spherical protuberances: | C | C |
| Number of image defects: | B | A |
| Charging performance: | A | A |
| Residual potential: | A | A |
| Potential uniformity: | A | A |
| Cost: | A | A |

As can be seen from Table A-11, the effect of the present invention is obtainable likewise even where the lower-part blocking layer is provided. It has also been found that the effect of reducing image defects is more improved when the second layer is deposited after the the protuberant portions of the spherical protuberances have been made flat.

Example A-6

Using the first film-forming chamber shown in FIG. 6, a lower-part blocking layer and up to a photoconductive layer were deposited as the first layer on each cylindrical aluminum substrate of 108 mm in diameter under conditions shown in Table A-12.

TABLE A-12

| | Lower-part blocking layer | Photoconductive layer |
|---|---|---|
| Source gas and flow rate: | | |
| $SiH_4$ [ml/min(normal)] | 120 | 500 |
| $H_2$ [ml/min(normal)] | 360 | 1,000 |
| $PH_3$ (ppm) (based on $SiH_4$) | 3,000 | 0.5 |
| NO [ml/min(normal)] | 5 | — |
| Substrate temperature: | | |
| (° C.) | 290 | 290 |
| Reactor internal pressure: | | |
| (Pa) | 0.6 | 0.7 |
| High-frequency power: | | |
| (W) | 400 | 700 |
| Layer thickness: | | |
| (μm) | 5 | 30 |

Next, each substrate on which the first layer was deposited was first taken out of the first film-forming chamber into the atmosphere, and then cleaned by means of the water washing system shown in FIG. 8. Thereafter, this was moved to the second film-forming chamber shown in FIG. 5, where as the second layer an upper-part blocking layer and a surface layer were deposited on the first layer under conditions shown in Table A-13. In this Example, photosensitive members A-6A to A-6F were produced in which their upper-part blocking layers were made to be different in layer thickness by changing film formation time.

TABLE A-13

| | Upper-part blocking layer | Surface layer |
|---|---|---|
| Source gas and flow rate: | | |
| $SiH_4$ [ml/min(normal)] | 150 | 20 |
| $B_2H_6$ (ppm) (based on $SiH_4$) | 1,000 | — |
| $CH_4$ [ml/min(normal)] | 500 | 600 |
| Substrate temperature: | | |
| (° C.) | 240 | 240 |
| Reactor internal pressure: | | |
| (Pa) | 80 | 80 |
| High-frequency power: | | |
| (W) | 300 | 100 |
| Layer thickness: | | |
| (μm) | 0.001 to 2 | 0.5 |

The negative-charging photosensitive members obtained following the above procedure were evaluated in the same manner as in Example A-1, and also the size of the spherical protuberances was further evaluated. The whole surface of each photosensitive member obtained was observed with an optical microscope to examine the diameter of the largest spherical protuberance. As the result, it was found that, under the production conditions in this Example, the diameter was about 100 μm in every photosensitive member. The ratio of the layer thickness of the upper-part blocking layer to the diameter of the largest spherical protuberance, thus measured, was determined.

The results of evaluation are shown in Table A-14. As can be seen from Table A-14, in order to obtain the effect of reducing image defects in the present invention, the layer thickness $10^{-4}$ times or more as large as the diameter of the largest spherical protuberance is preferable as the layer thickness of the upper-part blocking layer. Also, the effect of reducing image defects was sufficiently obtained in respect of the photosensitive member A-6 F, but a lowering of sensitivity was seen because the thickness of the upper-part blocking layer is too large. Accordingly, it is preferable to control the upper limit of the layer thickness to be 1 μm or less. Also, when the cleaning was carried out by means of the water washing system before the second layer was deposited, the adhesion was improved.

TABLE A-14

| Example A-6 | | | | | |
|---|---|---|---|---|---|
| Photosensitive member No: | | | | | |
| A-6A | A-6B | A-6C | A-6D | A-6E | A-6F |
| Layer thickness of upper-part blocking layer: (μm) | | | | | |
| 0.001 | 0.005 | 0.01 | 0.1 | 1 | 2 |
| Layer thickness ratio of upper-part blocking layer to diameter of largest spherical protuberance: | | | | | |
| $1 \times 10^{-5}$ | $1 \times 10^{-5}$ | $1 \times 10^{-4}$ | $1 \times 10^{-3}$ | $1 \times 10^{-2}$ | $2 \times 10^{-2}$ |
| Evaluation | | | | | |
| Number of spherical protuberances: | | | | | |
| C | C | C | C | C | C |
| Number of image defects: | | | | | |
| C | C | B | B | B | B |
| Charging performance: | | | | | |
| B | B | A | A | A | A |
| Residual potential: | | | | | |
| B | B | A | A | A | A |
| Potential uniformity: | | | | | |
| A | A | A | A | B | B |
| Cost: | | | | | |
| A | A | A | A | A | B |

Example A-7

Using the first film-forming chamber shown in FIG. 6, a lower-part blocking layer and up to a photoconductive layer were deposited as the first layer on each cylindrical aluminum substrate of 108 mm in diameter under conditions shown in Table A-15.

TABLE A-15

| | Lower-part blocking layer | Photoconductive layer |
|---|---|---|
| Source gas and flow rate: | | |
| $SiH_4$ [ml/min(normal)] | 100 | 100 |
| $H_2$ [ml/min(normal)] | 300 | 600 |
| $PH_3$ [ppm] (based on $SiH_4$) | 300 | — |
| NO [ml/min(normal)] | 5 | — |
| Substrate temperature: | | |
| (° C.) | 260 | 260 |
| Reactor internal pressure: | | |
| (Pa) | 0.6 | 0.8 |
| High-frequency power: | | |
| (W) | 500 | 800 |
| Layer thickness: | | |
| (μm) | 3 | 25 |

Next, each substrate on which the first layer was deposited was first taken out of the first film-forming chamber into the atmosphere, and then cleaned by means of the water washing system shown in FIG. 8. This was moved to the second film-forming chamber shown in FIG. 5, and thereafter the inside of the second film-forming chamber was evacuated, where as the second layer an upper-part blocking layer and a surface layer were deposited on the first layer under conditions shown in Table A-16. In this Example, photosensitive members A-7G to A-7L were produced in which the content of Group 13 element B (boron) incorporated in the upper-part blocking layer was changed.

TABLE A-16

| | Upper-part blocking layer | Surface layer |
|---|---|---|
| Source gas and flow rate: | | |
| $SiH_4$ [ml/min(normal)] | 100 | 50 |
| $B_2H_6$ (ppm) (based on $SiH_4$) | (changed) | — |
| $CH_4$ [ml/min(normal)] | 500 | 500 |
| Substrate temperature: | | |
| (° C.) | 240 | 240 |
| Reactor internal pressure: | | |
| (Pa) | 70 | 70 |
| High-frequency power: | | |
| (W) | 300 | 100 |
| Layer thickness: | | |
| (μm) | 0.3 | 0.5 |

The negative-charging photosensitive members obtained following the above procedure were evaluated in the same manner as in Example A-1.

After the evaluation, samples were cut out from the respective photosensitive members, and SIMS (secondary ion mass spectroscopy) was conducted to examine the B (boron) content in each upper-part blocking layer.

The results of evaluation are shown in Table A-17. As can be seen from Table A-17, it is suitable for the B (boron) content in each upper-part blocking layer to be from 100 atomic ppm to 30,000 atomic ppm. Also, when the cleaning was carried out by means of the water washing system before the second layer is deposited, the adhesion was improved.

TABLE A-17

| Example A-7 | | | | | |
|---|---|---|---|---|---|
| Photosensitive member No: | | | | | |
| A-7G | A-7H | A-7I | A-7J | A-7K | A-7L |
| B content in upper-part blocking layer: (atomic ppm) | | | | | |
| 80 | 100 | 1,000 | 10,000 | 30,000 | 35,000 |
| Evaluation | | | | | |
| Number of spherical protuberances: | | | | | |
| C | C | C | C | C | C |
| Number of image defects: | | | | | |
| C | B | B | B | B | C |
| Charging performance: | | | | | |
| C | A | A | A | A | C |
| Residual potential: | | | | | |
| C | A | A | A | A | C |
| Potential uniformity: | | | | | |
| B | A | A | A | A | B |
| Cost: | | | | | |
| A | A | A | A | A | A |

Example A-8

Using the first film-forming chamber shown in FIG. 6, a lower-part blocking layer and up to the first region and second region of a photoconductive layer were deposited as the first layer on each cylindrical aluminum substrate of 108 mm in diameter under conditions shown in Table A-18.

TABLE A-18

| | Lower-part blocking layer | Photoconductive layer Region 1 | Photoconductive layer Region 2 |
|---|---|---|---|
| Source gas and flow rate: | | | |
| $SiH_4$ [ml/min(normal)] | 100 | 100 | 100 |
| $H_2$ [ml/min(normal)] | 300 | 600 | 800 |
| $PH_3$ (ppm) (based on $SiH_4$) | 300 | — | — |
| NO [ml/min(normal)] | 5 | — | — |
| Substrate temperature: | | | |
| (° C.) | 260 | 260 | 260 |
| Reactor internal pressure: | | | |
| (Pa) | 0.6 | 0.8 | 0.8 |
| High-frequency power: | | | |
| (W) | 500 | 800 | 100 |
| Layer thickness: | | | |
| (μm) | 3 | 25 | 5 |

Next, each unfinished photosensitive member thus obtained was taken out of the first film-forming chamber into the atmosphere, and then cleaned by means of the water washing system shown in FIG. 8. After this unfinished photosensitive member was moved to the second film-forming chamber shown in FIG. 5, the inside of the second film-forming chamber was evacuated, where, subsequently, as the second layer an upper-part blocking layer and a surface layer were deposited on the first layer under conditions shown in Table A-19. In this Example, the photosensitive members were each so produced that the photoconductive layer consisted of the first region and the second region. Evaluation was made in the same manner as in Example A-1.

TABLE A-19

| | Upper-part blocking layer | Surface layer |
|---|---|---|
| Source gas and flow rate: | | |
| $SiH_4$ [ml/min(normal)] | 150 | 20 |
| $B_2H_6$ (ppm) (based on $SiH_4$) | 3,000 | — |
| $CH_4$ [ml/min(normal)] | 150 | 700 |
| Substrate temperature: | | |
| (° C.) | 240 | 200 |
| Reactor internal pressure: | | |
| (Pa) | 50 | 48 |
| High-frequency power: | | |
| (W) | 350 | 280 |
| Layer thickness: | | |
| (μm) | 0.1 | 0.5 |

Example A-9

Using the first film-forming chamber shown in FIG. 6, a lower-part blocking layer and up to the first region of a photoconductive layer were deposited as the first layer on each cylindrical aluminum substrate of 108 mm in diameter under conditions shown in Table A-20.

TABLE A-20

| | Lower-part blocking layer | Photo-conductive layer Region 1 |
|---|---|---|
| Source gas and flow rate: | | |
| $SiH_4$ [ml/min(normal)] | 100 | 100 |
| $H_2$ [ml/min(normal)] | 300 | 600 |
| $PH_3$ (ppm) (based on $SiH_4$) | 300 | — |
| NO [ml/min(normal)] | 5 | — |
| Substrate temperature: | | |
| (° C.) | 260 | 260 |
| Reactor internal pressure: | | |
| (Pa) | 0.6 | 0.8 |
| High-frequency power: | | |
| (W) | 500 | 800 |
| Layer thickness: | | |
| (μm) | 3 | 25 |

Next, each unfinished photosensitive member thus obtained was taken out of the first film-forming chamber into the atmosphere, and then cleaned by means of the water washing system shown in FIG. 8. After this unfinished photosensitive member was moved to the second film-forming chamber shown in FIG. 5, the inside of the second film-forming chamber was evacuated, where, subsequently, as the second layer, the second region of the photoconductive layer, an upper-part blocking layer and a surface layer were deposited on the first layer under conditions shown in Table A-21. In this Example, the layers up to the first region of the photoconductive layer were formed in the first film-forming chamber, and the layers beginning from the second region of the photoconductive layer were formed in the second film-forming chamber to produce the photosensitive members.

TABLE A-21

| | Photocon-ductive layer Region 2 | Upper-part blocking layer | Surface layer |
|---|---|---|---|
| Source gas and flow rate: | | | |
| $SiH_4$ [ml/min(normal)] | 100 | 150 | 20 |
| $H_2$ [ml/min(normal)] | 800 | — | — |
| $B_2H_6$ (ppm) (based on $SiH_4$) | — | 3.000 | — |
| $CH_4$ [ml/min(normal)] | — | 150 | 700 |
| Substrate temperature: | | | |
| (° C.) | 260 | 240 | 200 |
| Reactor internal pressure: | | | |
| (Pa) | 45 | 50 | 48 |
| High-frequency power: | | | |
| (W) | 100 | 350 | 280 |
| Layer thickness: | | | |
| (μm) | 5 | 0.1 | 0.5 |

The negative-charging photosensitive members obtained following the above procedure were evaluated in the same manner as in Example A-1. The results of evaluation are shown in Table A-22. As can be seen from Table A-22, the effect of the present invention is obtainable also when the photoconductive layer is divided into the first region and the second region and still also when the unfinished photosensitive drum is moved from the first film-forming chamber of a high-vacuum film formation system at the stage between the first region and the second region to carry out film formation in the second film-forming chamber of an RF system.

TABLE A-22

| | Example | |
|---|---|---|
| Evaluation | A-8 | A-9 |
| Number of spherical protuberances: | C | C |
| Number of image defects: | B | B |
| Charging performance: | A | A |
| Residual potential: | A | A |
| Potential uniformity: | A | A |
| Cost: | A | B |

Example A-10

Using the first film-forming chamber shown in FIG. 6, a lower-part blocking layer and up to a photoconductive layer were deposited as the first layer on each cylindrical aluminum substrate of 108 mm in diameter under conditions shown in Table A-23.

TABLE A-23

| | Lower-part blocking layer | Photoconductive layer |
|---|---|---|
| Source gas and flow rate: | | |
| $SiH_4$ [ml/min(normal)] | 80 | 400 |
| $H_2$ [ml/min(normal)] | 300 | 800 |
| $PH_3$ (ppm) (based on $SiH_4$) | 2,500 | 0.3 |
| NO [ml/min(normal)] | 4 | — |
| Substrate temperature: | | |
| (° C.) | 280 | 280 |
| Reactor internal pressure: | | |
| (Pa) | 0.6 | 0.7 |
| High-frequency power: | | |
| (W) | 400 | 1,000 |
| Layer thickness: | | |
| (μm) | 2 | 28 |

Next, each substrate on which the first layer was deposited was first taken out of the first film-forming chamber into the atmosphere. Then, in this Example, at this stage, its surface was polished by means of the polishing apparatus shown in FIG. 7, to flatten the protuberant portions of the spherical protuberances. Thereafter, this was cleaned by means of the water washing system shown in FIG. 8. Then, the substrate on which the first layer was deposited having been polished and cleaned, was moved to the second film-forming chamber shown in FIG. 5, where as the second layer an upper-part blocking layer and a surface layer were deposited on the first layer under conditions shown in Table A-24. In this Example, μm in every photosensitive member of A-10A to A-10F. The ratio of the layer thickness of the upper-part blocking layer to the diameter of the largest spherical protuberance was determined.

The negative-charging photosensitive members obtained were evaluated in the same manner as in Example A-1, and evaluation was further made on image defects after running (extensive operation).

Image Defects After Running:

The electrophotographic photosensitive members obtained were each set in the electrophotographic apparatus to conduct a 100,000-sheet continuous paper feed running test in A4-size paper lateral feed. After the 100,000-sheet paper feed running, copies of an A3-size white blank original were taken. The images thus obtained were observed to count the number of black dots coming from spherical protuberances of 0.3 mm or more in diameter.

The results obtained were ranked in comparison with the number of black dots on images before paper feed running.

A: Any image defects are seen not to have worsened even after the running. Very good.

B: Image defects have slightly worsened, and increasing by less than 10%. Good.

C: Image defects are seen to have increased by 10% or more to less than 20%, but no problem in practical use.

The results of evaluation are shown in Table A-25. As can be seen from Table A-25, it has been found preferable, in order to obtain the effect of reducing image defects in the present invention, to flatten the protuberant portions of the spherical protuberances present at the surface of the first layer and also to make the upper-part blocking layer have a layer thickness $10^{-4}$ times as large as the diameter of the largest spherical protuberance. Also, the effect of reducing image defects was sufficiently obtained in respect of the photosensitive member A-10F, whose upper-part blocking layer was 1.5 μm thick, but a lowering in sensitivity was a little seen. Thus, it is found preferable that the upper limit of the layer thickness is so controlled as to be 1 μm or less.

TABLE A-25

| Example A-10 | | | | | |
|---|---|---|---|---|---|
| Photosensitive member No: | | | | | |
| A-10A | A-10B | A-10C | A-10D | A-10E | A-10F |
| Layer thickness of upper-part blocking layer: (μm) | | | | | |
| 0.004 | 0.008 | 0.1 | 0.5 | 1 | 1.5 |
| Layer thickness ratio of upper-part blocking layer to diameter of largest spherical protuberance: | | | | | |
| $1 \times 10^{-5}$ | $1 \times 10^{-4}$ | $1.3 \times 10^{-3}$ | $6.3 \times 10^{-3}$ | $1.3 \times 10^{-2}$ | $1.9 \times 10^{-2}$ |
| Evaluation | | | | | |
| Number of spherical protuberances: | | | | | |
| C | C | C | C | C | C |
| Number of image defects: | | | | | |
| B | A | A | A | A | A |
| Number of image defects after running: | | | | | |
| B | A | A | A | A | A |
| Charging performance: | | | | | |
| B | A | A | A | A | A |
| Residual potential: | | | | | |
| B | A | A | A | A | A |
| Potential uniformity: | | | | | |
| A | A | A | A | B | B |
| Cost: | | | | | |
| A | A | A | A | A | B |

Example B-1

Using the a-Si photosensitive member film formation apparatus (first film-forming chamber) shown in FIG. 6, a photoconductive layer was deposited as the first layer on each cylindrical aluminum substrate of 108 mm in diameter under conditions shown in Table B-1.

TABLE B-1

| | Photoconductive layer |
|---|---|
| Source gas and flow rate: | |
| $SiH_4$ [ml/min(normal)] | 200 |
| $H_2$ [ml/min(normal)] | 400 |
| Substrate temperature: | |
| (° C.) | 240 |
| Reactor internal pressure: | |
| (Pa) | 0.7 |
| High-frequency power: | |
| (W) (105 MHz) | 500 |
| Layer thickness: | |
| (μm) | 25 |

Next, each unfinished photosensitive member obtained was moved to the second film-forming chamber shown in FIG. 5, in a vacuum state by using a transport chamber, and as the second layer an upper-part blocking layer and a surface layer were deposited on the first layer under conditions shown in Table B-2.

TABLE B-2

| | Upper-part blocking layer | Surface layer |
|---|---|---|
| Source gas and flow rate: | | |
| $SiH_4$ [ml/min(normal)] | 200 | 0 |
| $B_2H_6$ (ppm) (based on $SiH_4$) | 1,000 | 0 |
| $CH_4$ [ml/min(normal)] | 200 | 100 |
| Substrate temperature: | | |
| (° C.) | 220 | 220 |
| Reactor internal pressure: | | |
| (Pa) | 67 | 67 |
| High-frequency power: | | |
| (W) (13.56 MHz) | 300 | 1,000 |
| Layer thickness: | | |
| (μm) | 0.3 | 0.5 |

The photosensitive members obtained following the above procedure were photosensitive members used under negative charging, and were evaluated in the same manner as in Example A-1 in respect of the number of spherical protuberances, the image defects, the charging performance, the residual potential, the potential uniformity and the cost.

Note, however, that with regard to the results obtained the photosensitive members were ranked and assorted by relative comparison regarding as 100% the value obtained in Comparative Example B-2, as in Example A-1. Here, with regard to the cost, evaluation was made by relative comparison regarding as 100% the value obtained in Comparative Example B-1.

Evaluation Ranks in Examples B

Number of Spherical Protuberances

A: From 35% or more to less than 65%.
B: From 65% or more to less than 95%.
C: Equal to Comparative Example B-2.
D: 105% or more.

Image Defects:

A: From 35% or more to less than 65%.
B: From 65% or more to less than 85%.
C: From 85% or more to less than 95%.
D: Equal to Comparative Example B-2.

Charging Performance:

A: 115% or more.
B: From 105% or more to less than 115%.
C: Equal to Comparative Example B-2.

Residual Potential:

A: Less than 85%.
B: From 85% or more to less than 95%.
C: Equal to Comparative Example B-2.

Potential Uniformity:

A: Less than 95%.
B: Equal to Comparative Example B-2.
C: From 105% or more to less than 110%.
D: 110% or more.

Cost:

A: Less than 85%.
B: From 85% or more to less than 95%.
C: Equal to Comparative Example B-1.
D: 105% or more.

Overall evaluation was made by the above methods. The results are shown in Table B-4 together with those of Comparative Examples B-1.

Comparative Example B-1

Using the a-Si photosensitive member film formation apparatus shown in FIG. 5, the first layer photoconductive layer was formed on a cylindrical aluminum substrate of 108 mm in diameter under conditions shown in Table B-3. Subsequently, without proceeding with the second step, as the second layer an upper-part blocking layer and a surface layer were deposited on the first layer.

The negative-charging photosensitive member thus produced was evaluated in the same manner as in Example B-1 to obtain the results shown in Table B-4.

TABLE B-3

| | Photoconductive layer | Upper-part blocking layer | Surface layer |
|---|---|---|---|
| Source gas and flow rate: | | | |
| $SiH_4$ [ml/min(normal)] | 400 | 200 | 0 |
| $H_2$ [ml/min(normal)] | 400 | 0 | 0 |
| $B_2H_6$ (ppm) (based on $SiH_4$) | 0 | 1,000 | 0 |
| $CH_4$ [ml/min(normal)] | 0 | 200 | 100 |
| Substrate temperature: | | | |
| (° C.) | 240 | 220 | 220 |
| Reactor internal pressure: | | | |
| (Pa) | 67 | 67 | 67 |
| High-frequency power: | | | |
| (W) (13.56 MHz) | 500 | 300 | 1,000 |
| Layer thickness: | | | |
| (μm) | 25 | 0.3 | 0.5 |

Comparative Example B-2

As with Comparative Example B-1 but using the a-Si photosensitive member film formation apparatus shown in FIG. 6, the first layer photoconductive layer was formed on each cylindrical aluminum substrate of 108 mm in diameter under conditions shown in Table B-1. Each unfinished photosensitive member with the first layer thus deposited was first taken out of the first film-forming chamber, and then moved to the second film-forming chamber shown in FIG. 5. In this Comparative Example, the second layer upper-part blocking layer in the second layer shown in Table B-2 was not formed and only the surface layer was deposited on the first layer.

Each negative-charging photosensitive member thus produced was evaluated in the same manner as in Example B-1 to obtain the results shown in Table B-4

TABLE B-4

| | Example | Comparative Example | |
|---|---|---|---|
| Evaluation | B-1 | B-1 | B-2 |
| Number of spherical protuberances: | C | C | C |
| Number of image defects: | B | C | D |
| Charging performance: | A | A | C |
| Residual potential: | A | A | C |
| Potential uniformity: | A | A | B |
| Cost: | A | C | A |

As can be seen from Table B-4, the photosensitive member of the present invention is very improved in the number of image defects, dots, even though the number of spherical protuberances are on the same level as those in Comparative Examples B-1 and B-2.

In Comparative Example B-1, the RF system was subsequently employed for the deposition of the first layer and second layer, where the growth mechanism is identical, and the image defects were little reduced in number. Hence, the effect of reducing dots was exhibited only a little. In Comparative Example B-2, the second layer was deposited by the RF system after the first layer has been deposited by the VHF system. Since, however, the upper-part blocking layer was not provided, the image defects were little reduced in number.

In particular, it is understandable that providing the upper-part blocking layer brings improvements in charging performance and residual potential, and the image defects were reduced in number.

Example B-2

Using the first film-forming chamber shown in FIG. 6, a photoconductive layer was deposited as the first layer on each cylindrical aluminum substrate of 108 mm in diameter under conditions shown in Table B-5, to produce unfinished photosensitive members.

TABLE B-5

| | Lower-part blocking layer | Photoconductive layer |
|---|---|---|
| Source gas and flow rate: | | |
| $SiH_4$ [ml/min(normal)] | 150 | 150 |
| $H_2$ [ml/min(normal)] | 150 | 150 |
| $B_2H_6$ (ppm) (based on $SiH_4$) | 500 | 0.3 |
| NO [ml/min(normal)] | 10 | 0 |
| $CH_4$ [ml/min(normal)] | 0 | 0 |
| Substrate temperature: | | |
| (° C.) | 200 | 200 |
| Reactor internal pressure: | | |
| (Pa) | 0.8 | 0.8 |
| High-frequency power: | | |
| (W) (105 MHz) | 300 | 300 |
| Layer thickness: | | |
| (μm) | 3 | 30 |

Next, in that state, each unfinished photosensitive member with the first layer thus deposited was moved to the second film-forming chamber shown in FIG. 5, in a vacuum state by using a transport chamber, and as the second layer an upper-part blocking layer was deposited on the first layer under conditions shown in Table B-6.

TABLE B-6

| | Upper-part blocking layer | Surface layer |
|---|---|---|
| Source gas and flow rate: | | |
| $SiH_4$ [ml/min(normal)] | 200 | 0 |
| $PH_3$ (ppm) (based on $SiH_4$) | 1,000 | 0 |
| $CH_4$ [ml/min(normal)] | 200 | 100 |

TABLE B-6-continued

| | Upper-part blocking layer | Surface layer |
|---|---|---|
| Substrate temperature: | | |
| (° C.) | 240 | 240 |
| Reactor internal pressure: | | |
| (Pa) | 67 | 67 |
| High-frequency power: | | |
| (W) (13.56 MHz) | 300 | 1,000 |
| Layer thickness: | | |
| (μm) | 0.3 | 0.5 |

The photosensitive members obtained following the above procedure were photosensitive members used under positive charging, and were evaluated in the same manner as in Example B-1, using for the evaluation a copying machine basing on GP-605 (manufactured by CANON INC.), as a test electrophotographic apparatus. The results are shown in Table B-7.

Example B-3

Electrophotographic photosensitive members were produced in the same manner as in Example B-2 except that the unfinished photosensitive member was taken out of the first film-forming chamber and exposed to the atmosphere. Thereafter, each unfinished photosensitive member was moved to the second film-forming chamber, and the second layer was deposited on the first layer.

The photosensitive members thus produced were evaluated in the same manner as in Example B-1 to obtain the results shown in Table B-7.

TABLE B-7

| | Example | |
|---|---|---|
| Evaluation | B-2 | B-3 |
| Number of spherical protuberances: | C | C |
| Number of image defects: | B | B |
| Charging performance: | A | A |
| Residual potential: | A | A |
| Potential uniformity: | A | A |
| Cost: | A | A |

As can be seen from Table B-7, the effect of the present invention is obtainable where the unfinished photosensitive drum is moved from the first film-forming chamber of a high-vacuum film formation system and the second layer is formed in the second film-forming chamber of an RF-system. When it is moved from the first film-forming chamber to the second film-forming chamber, it may be moved in vacuum or exposed to the atmosphere.

Example B-4

Using the first film-forming chamber shown in FIG. 6, a photoconductive layer was deposited as the first layer on each cylindrical aluminum substrate of 108 mm in diameter under the conditions shown in Table B-1, to produce unfinished photosensitive members. Each unfinished photosensitive member with the photoconductive layer thus deposited was first taken out of the first film-forming chamber. Then, in the same manner as in Example B-1, the surface of the unfinished photosensitive member was observed with a microscope to count the number of spherical protuberances, and the results were ranked.

Thereafter, those having ranks C and D for the number of spherical protuberances were picked out, and the unfinished photosensitive members were each set in the second film-forming chamber shown in FIG. 5. Then, an upper-part blocking layer and a surface layer were deposited under the conditions shown in Table B-2.

The photosensitive members thus produced were evaluated in the same manner as in Example B-1 to obtain the results shown in Table B-9.

Example B-5

Among the unfinished photosensitive members each having the photoconductive layer deposited as the first layer in Example B-4, those having ranks C and D for the number of spherical protuberances were picked out, and the unfinished photosensitive members were each set in the second film-forming chamber shown in FIG. 5. Then, an upper-part blocking layer and an a-SiC surface layer were deposited under conditions shown in Table B-8.

TABLE B-8

| | Upper-part blocking layer | Surface layer |
|---|---|---|
| Source gas and flow rate: | | |
| $SiH_4$ [ml/min(normal)] | 200 | 20 |
| $B_2H_6$ (ppm) (based on $SiH_4$) | 1,000 | 0 |
| $CH_4$ [ml/min(normal)] | 200 | 700 |
| Substrate temperature: | | |
| (° C.) | 240 | 240 |
| Reactor internal pressure: | | |
| (Pa) | 67 | 67 |
| High-frequency power: | | |
| (W) (13.56 MHz) | 300 | 280 |
| Layer thickness: | | |
| (μm) | 0.3 | 0.5 |

The photosensitive members thus produced were evaluated in the same manner as in Example B-1 to obtain the results shown in Table B-9.

TABLE B-9

| Example B-4 | | | | Example B-5 | | | |
|---|---|---|---|---|---|---|---|
| Before deposition | | After deposition | | Before deposition | | After deposition | |
| Number of spherical protuberances: | | | | | | | |
| C | D | C | D | C | D | C | D |
| Number of image defects: | | | | | | | |
| C | D | A | B | C | D | B | C |
| Charging performance: | | | | | | | |
| A | A | A | A | A | A | A | A |
| Residual potential: | | | | | | | |
| A | A | A | A | A | A | A | A |

TABLE B-9-continued

| Example B-4 | | | | Example B-5 | | | |
|---|---|---|---|---|---|---|---|
| Before deposition | | After deposition | | Before deposition | | After deposition | |
| Potential uniformity: | | | | | | | |
| A | A | A | A | A | A | A | A |
| Cost: | | | | | | | |
| A | A | A | A | A | A | A | A |

In Table B-9;

"Before depositions": Evaluation of the rank C and rank D photosensitive members before the upper-part blocking layer and the surface layer were deposited.

"After depositions": Evaluation of the rank C and rank D photosensitive members after the upper-part blocking layer and the surface layer were deposited.

As shown in Table B-9, the photosensitive members with the upper-part blocking layer and the surface layer deposited thereon can remedy image defects, as compared with the photosensitive members before they are deposited. Further, the use of the a-C:H surface layer as the surface layer brought such a result that even image defects on a bad level were greatly remedied.

Example B-6

Using the first film-forming chamber shown in FIG. 6, a lower-part blocking layer and up to a photoconductive layer were deposited as the first layer on each cylindrical aluminum substrate of 108 mm in diameter under conditions shown in Table B-10.

TABLE B-10

| | Lower-part blocking layer | Photoconductive layer |
|---|---|---|
| Source gas and flow rate: | | |
| $SiH_4$ [ml/min(normal)] | 200 | 200 |
| $PH_3$ (ppm) (based on $SiH_4$) | 1,500 | 1.0 |
| NO [ml/min(normal)] | 10 | 0 |
| Substrate temperature: | | |
| (° C.) | 200 | 200 |
| Reactor internal pressure: | | |
| (Pa) | 0.8 | 0.8 |
| High-frequency power: | | |
| (W) (100 MHz) | 1,000 | 2,000 |
| Layer thickness: | | |
| (μm) | 3 | 30 |

Next, each unfinished photosensitive member with the first layer thus deposited was first taken out of the first film-forming chamber into the atmosphere, and then moved to the second film-forming chamber shown in FIG. 5, where as the second layer an upper-part blocking layer and a surface layer were deposited on the first layer under conditions shown in Table B-11.

TABLE B-11

| | Upper-part blocking layer | Surface layer |
|---|---|---|
| Source gas and flow rate: | | |
| $SiH_4$ [ml/min(normal)] | 150 | 0 |
| $B_2H_6$ (ppm) (based on $SiH_4$) | 3,000 | 0 |
| $CH_4$ [(ml/min(normal)] | 150 | 100 |
| Substrate temperature: | | |
| (° C.) | 240 | 200 |
| Reactor internal pressure: | | |
| (Pa) | 50 | 48 |
| High-frequency power: | | |
| (W) (13.56 MHz) | 350 | 1,000 |
| Layer thickness: | | |
| (μm) | 0.5 | 0.5 |

The negative-charging photosensitive members obtained following the above procedure were evaluated in the same manner as in Example B-1. The results are shown in Table B-12 together with the results in Example B-7.

Example B-7

Using the first film-forming chamber shown in FIG. 6, a lower-part blocking layer and up to a photoconductive layer were deposited as the first layer on each cylindrical aluminum substrate of 108 mm in diameter under conditions shown in Table B-10, to produce unfinished photosensitive members.

Next, each unfinished photosensitive member with the first layer thus deposited was first taken out of the first film-forming chamber into the atmosphere. Then, in this Example, at this stage, its surface was polished by means of the polishing apparatus shown in FIG. 7, to flatten the protuberant portions of the spherical protuberances. Next, this unfinished photosensitive member was cleaned by means of the water washing system shown in FIG. 8. Thereafter, this unfinished photosensitive member was moved to the second film-forming chamber shown in FIG. 5, where as the second layer an upper-part blocking layer and a surface layer were deposited on the first layer under conditions shown in Table B-11.

The negative-charging photosensitive members obtained following the above procedure were evaluated in the same manner as in Example B-1. The results are shown in Table B-12 together with the results in Example B-6.

TABLE B-12

| | Example | |
|---|---|---|
| Evaluation | B-6 | B-7 |
| Number of spherical protuberances: | C | C |
| Number of image defects: | B | A |
| Charging performance: | A | A |
| Residual potential: | A | A |
| Potential uniformity: | A | A |
| Cost: | A | A |

As can be seen from Table B-12, the effect of the present invention is obtainable likewise also in the case of the negative-charging photosensitive members. It has also been found that the effect of reducing image defects is more improved when the second layer is deposited after the the protuberant portions of the spherical protuberances have been made flat.

Example B-8

Using the first film-forming chamber shown in FIG. 6, a lower-part blocking layer and up to a photoconductive layer were deposited as the first layer on each cylindrical aluminum substrate of 108 mm in diameter under conditions shown in Table B-13.

TABLE B-13

| | Lower-part blocking layer | Photoconductive layer |
|---|---|---|
| Source gas and flow rate: | | |
| $SiH_4$ [ml/min(normal)] | 120 | 500 |
| $H_2$ [ml/min(normal)] | 360 | 1,000 |
| $PH_3$ (ppm) (based on $SiH_4$) | 3,000 | 0.5 |
| NO [ml/min(normal)] | 5 | 0 |
| Substrate temperature: | | |
| (° C.) | 290 | 290 |
| Reactor internal pressure: | | |
| (Pa) | 0.6 | 0.7 |
| High-frequency power: | | |
| (W) (105 MHz) | 400 | 700 |
| Layer thickness: | | |
| (μm) | 5 | 30 |

Next, each unfinished photosensitive member with the first layer thus deposited was first taken out of the first film-forming chamber into the atmosphere, and then the unfinished photosensitive member cleaned by means of the water washing system shown in FIG. 8. Thereafter, this unfinished photosensitive member was moved to the second film-forming chamber shown in FIG. 5, where as the second layer an upper-part blocking layer and a surface layer were deposited on the first layer under conditions shown in Table B-14. In this Example, photosensitive members B-8A to B-8F were produced whose upper-part blocking layers were so formed as to be different in layer thickness by changing film formation time for the upper-part blocking layer.

TABLE B-14

| | Upper-part blocking layer | Surface layer |
|---|---|---|
| Source gas and flow rate: | | |
| $SiH_4$ [ml/min(normal)] | 150 | 0 |
| $B_2H_6$ (ppm) (based on $SiH_4$) | 10,000 | 0 |
| $CH_4$ [ml/min(normal)] | 500 | 100 |
| Substrate temperature: | | |
| (° C.) | 240 | 240 |
| Reactor internal pressure: | | |
| (Pa) | 80 | 80 |
| High-frequency power: | | |
| (W) (13.56 MHz) | 300 | 100 |

TABLE B-14-continued

| | Upper-part blocking layer | Surface layer |
|---|---|---|
| Layer thickness: | | |
| (μm) | 0.001 to 2 | 0.5 |

The negative-charging photosensitive members obtained following the above procedure were evaluated in the same manner as in Example B-1, and also the size of the spherical protuberances was further evaluated. The whole surface of each photosensitive member obtained was observed with an optical microscope to examine the diameter of the largest spherical protuberance. As the result, it was found that, under the production conditions of this Example, the diameter was about 100 μm in every photosensitive member. The ratio of the layer thickness of the upper-part blocking layer to the diameter of the largest spherical protuberance, thus measured, was determined.

The results of evaluation are shown in Table B-15. As can be seen from Table B-15, in order to obtain the effect of reducing image defects in the present invention, the layer thickness $10^{-4}$ times or more as large as the diameter of the largest spherical protuberance is preferable as the layer thickness of the upper-part blocking layer. Also, the effect of reducing image defects was sufficiently obtained in respect of the photosensitive member B-8F, but a lowering of sensitivity was seen because the thickness of the upper-part blocking layer was too large. Thus, it is found preferable to control the upper limit of the layer thickness to be 1 μm or less. Also, when the cleaning was carried out by means of the water washing system before the second layer is deposited, the adhesion was improved.

TABLE B-15

Example B-8

| Photosensitive member No: | | | | | |
|---|---|---|---|---|---|
| B-8A | B-8B | B-8C | B-8D | B-8E | B-8F |
| Layer thickness of upper-part blocking layer: (μm) | | | | | |
| 0.001 | 0.005 | 0.01 | 0.1 | 1 | 2 |
| Layer thickness ratio of upper-part blocking layer to diameter of largest spherical protuberance: | | | | | |
| $1 \times 10^{-5}$ | $5 \times 10^{-5}$ | $1 \times 10^{-4}$ | $1 \times 10^{-3}$ | $1 \times 10^{-2}$ | $2 \times 10^{-2}$ |
| Evaluation | | | | | |
| Number of spherical protuberances: | | | | | |
| C | C | C | C | C | C |
| Number of image defects: | | | | | |
| C | C | B | B | B | B |
| Charging performance: | | | | | |
| B | B | A | A | A | A |
| Residual potential: | | | | | |
| B | B | A | A | A | A |
| Potential uniformity: | | | | | |
| A | A | A | A | B | B |
| Cost: | | | | | |
| A | A | A | A | A | B |

Example B-9

Using the first film-forming chamber shown in FIG. 6, a lower-part blocking layer and up to a photoconductive layer were deposited as the first layer on each cylindrical aluminum substrate of 108 mm in diameter under conditions shown in Table B-16, to produce unfinished photosensitive members.

TABLE B-16

| | Lower-part blocking layer | Photoconductive layer |
|---|---|---|
| Source gas and flow rate: | | |
| $SiH_4$ [ml/min(normal)] | 100 | 100 |
| $H_2$ [ml/min(normal)] | 300 | 600 |
| $PH_3$ [ppm] (based on $SiH_4$) | 300 | 0 |
| NO [ml/min(normal)] | 5 | 0 |
| Substrate temperature: | | |
| (° C.) | 260 | 260 |
| Reactor internal pressure: | | |
| (Pa) | 0.6 | 0.8 |
| Hign-frequency power: | | |
| (W) (105 MHz) | 500 | 800 |
| Layer thickness: | | |
| (μm) | 3 | 25 |

Next, each unfinished photosensitive member was taken out of the first film-forming chamber into the atmosphere, and then cleaned by means of the water washing system shown in FIG. 8. This unfinished photosensitive member was moved to the second film-forming chamber shown in FIG. 5, and thereafter the inside of the second film-forming chamber was evacuated, where as the second layer an upper-part blocking layer and a surface layer were deposited on the first layer under conditions shown in Table B-17. In this Example, photosensitive members B-9G to B-9L were produced in which the content of Group 13 element B (boron) incorporated in the upper-part blocking layer was changed by varying the concentration of the source gas $B_2H_6$.

TABLE B-17

| | Upper-part blocking layer | Surface layer |
|---|---|---|
| Source gas and flow rate: | | |
| $SiH_4$ [ml/min(normal)] | 100 | 50 |
| $H_2$ [ml/min(normal)] | 0 | 0 |
| $B_2H_6$ (ppm) (based on $SiH_4$) | (changed) | 0 |
| NO [ml/min(normal)] | 0 | 0 |
| $CH_4$ [ml/min(normal)] | 500 | 500 |
| Substrate temperature: | | |
| (° C.) | 240 | 240 |
| Reactor internal pressure: | | |
| (Pa) | 70 | 70 |
| High-frequency power: | | |
| (W) (13.56 MHz) | 300 | 100 |
| Layer thickness: | | |
| (μm) | 0.3 | 0.5 |

The negative-charging photosensitive members obtained following the above procedure were evaluated in the same manner as in Example B-1.

After the evaluation, samples were cut out from the respective photosensitive members, and SIMS (secondary ion mass spectroscopy) was conducted to examine the B (boron) content in each upper-part blocking layer.

The results of evaluation are shown in Table B-18. As can be seen from Table B-18, it is suitable for the B (boron) content in each upper-part blocking layer to be from 100 atomic ppm to 30,000 atomic ppm. Also, when the cleaning was carried out by means of the water washing system before the second layer is deposited, the adhesion was improved.

TABLE B-18

| Example B-9 | | | | | |
|---|---|---|---|---|---|
| Photosensitive member No: | | | | | |
| B-9G | B-9H | B-9I | B-9J | B-9K | B-9L |
| B content in upper-part blocking layer: (atomic ppm) | | | | | |
| 80 | 100 | 1,000 | 10,000 | 30,000 | 35,000 |
| Evaluation | | | | | |
| Number of spherical protuberances: | | | | | |
| C | C | C | C | C | C |
| Number of image defects: | | | | | |
| C | B | B | B | B | C |
| Charging performance: | | | | | |
| C | A | A | A | A | C |
| Residual potential: | | | | | |
| C | A | A | A | A | C |
| Potential uniformity: | | | | | |
| B | A | A | A | A | B |
| Cost: | | | | | |
| A | A | A | A | A | A |

Example B-10

Using the first film-forming chamber shown in FIG. 6, a photoconductive layer was deposited as the first layer on each cylindrical aluminum substrate of 108 mm in diameter under the conditions shown in Table B-1, to produce unfinished photosensitive members. Each unfinished photosensitive member with the photoconductive layer thus deposited was first taken out of the first film-forming chamber. Then, in the same manner as in Example B-1, the surface of the unfinished photosensitive member was observed with a microscope to count the number of spherical protuberances, and the results were ranked.

Thereafter, those having ranks C and D for the number of spherical protuberances were picked out, and the surfaces of the unfinished photosensitive members were each polished by means of the polishing apparatus shown in FIG. 7, to flatten the protuberant portions of the spherical protuberances. Here, the polishing time by which the surface of the unfinished photosensitive member became perfectly flat was measured. Thereafter, unfinished photosensitive members were produced in which the polishing time was changed under the same polishing conditions.

Where the time by which the surface was completely polished is regarded as 100, unfinished photosensitive members in which the polishing time was 50 and 10 were produced, and these unfinished photosensitive members were cleaned by means of the water washing system shown in FIG. 8. Thereafter, these unfinished photosensitive member were each moved to the second film-forming chamber shown in FIG. 5, where as the second layer an upper-part blocking layer and a surface layer were deposited on the first layer under the conditions shown in Table B-2.

Example B-11

The same unfinished photosensitive members as those in Example B-10 and in which the polishing time was changed following the same procedure as in Example B-10 were cleaned by means of the water washing system shown in FIG. 8. Thereafter, these unfinished photosensitive member were each moved to the second film-forming chamber shown in FIG. 5, where as the second layer an upper-part blocking layer and an SiC type surface layer were deposited on the first layer under the conditions shown in Table B-8.

The photosensitive members produced in Examples B-10 and B-11 were evaluated in the same manner as in Example B-1. The results are shown together in Table B-19.

TABLE B-19

| Example B-10 | | | | | | | | |
|---|---|---|---|---|---|---|---|---|
| | Before deposition Polishing time: | | | | | | | |
| Evaluation | 100 | | 50 | | 10 | | None | |
| Number of spherical protuberances: | C | D | C | D | C | D | C | D |
| Image defects: | C | D | C | D | C | D | C | D |
| Charging performance: | A | A | A | A | A | A | A | A |
| Residual potential: | A | A | A | A | A | A | A | A |
| Potential uniformity: | A | A | A | A | A | A | A | A |
| Cost: | A | A | A | A | A | A | A | A |
| | After deposition Polishing time: | | | | | | | |
| | 100 | | 50 | | 10 | | None | |
| Number of spherical protuberances: | C | D | C | D | C | D | C | D |
| Image defects: | A | A | A | A | A | B | A | B |
| Charging performance: | A | A | A | A | A | A | A | A |
| Residual potential: | A | A | A | A | A | A | A | A |
| Potential uniformity: | A | A | A | A | A | A | A | A |
| Cost: | A | A | A | A | A | A | A | A |
| Example B-11 | | | | | | | | |
| | Before deposition Polishing time: | | | | | | | |
| Evaluation | 100 | | 50 | | 10 | | None | |
| Number of spherical protuberances: | C | D | C | D | C | D | C | D |
| Image defects: | C | D | C | D | C | D | C | D |
| Charging performance: | A | A | A | A | A | A | A | A |
| Residual potential: | A | A | A | A | A | A | A | A |
| Potential uniformity: | A | A | A | A | A | A | A | A |
| Cost: | A | A | A | A | A | A | A | A |
| | After deposition Polishing time: | | | | | | | |
| | 100 | | 50 | | 10 | | None | |
| Number of spherical protuberances: | C | D | C | D | C | D | C | D |
| Image defects: | A | B | B | C | B | C | B | C |

TABLE B-19-continued

| | | | | | | | | |
|---|---|---|---|---|---|---|---|---|
| Charging performance: | A | A | A | A | A | A | A | A |
| Residual potential: | A | A | A | A | A | A | A | A |
| Potential uniformity: | A | A | A | A | A | A | A | A |
| Cost: | A | A | A | A | A | A | A | A |

In Table B-19;

"Before deposition": Evaluation of the rank C and rank D photosensitive members before the upper-part blocking layer and the surface layer were deposited.

"After depositions": Evaluation of the rank C and rank D photosensitive members after the upper-part blocking layer and the surface layer were deposited.

As shown in Table B-19, the image defects are remedied when the upper-part blocking layer and the surface layer are deposited in the second film-forming chamber after the photoconductive layer has been formed in the first film-forming chamber and after the surface of the unfinished photosensitive member has been made flat.

In addition, the use of the a-C:H surface layer as the surface layer has brought improvements of the level of image defects dots even when the photosensitive member surface is not made perfectly flat. This is presumed to be that since the surface layer is formed of a-C:H, electric charges are sufficiently kept from slipping through the boundaries between the spherical protuberances and the normal portion even if spherical protuberances with large height are present.

Example C-1

Using the photosensitive member film formation apparatus of a VHF plasma-assisted CVD system, the first film-forming chamber, shown in FIG. 6, a photoconductive layer formed of at least a non-single-crystal material and a silicon carbide layer formed of a non-single-crystal material containing at least carbon and silicon were deposited as the first layer on each cylindrical aluminum substrate of 108 mm in diameter under conditions shown in Table C-1, to produce unfinished photosensitive members.

Next, each unfinished photosensitive member with the first layer thus deposited was moved to the photosensitive member film formation apparatus of an RF plasma-assisted CVD system, the second film-forming chamber shown in FIG. 5, in a vacuum state by using a transport chamber, and as the second layer, an upper-part blocking layer was deposited on the first layer and then a surface layer formed of a non-single-crystal material composed chiefly of carbon atoms was deposited on the upper-part blocking layer under conditions shown in Table C-2. Thus, electrophotographic photosensitive members were produced.

The photosensitive members obtained following the above procedure were photosensitive members used under negative charging, and were evaluated in the same manner as in Example A-1 in respect of the number of spherical protuberances, the image defects, the charging performance, the residual potential, the potential uniformity and the cost. Note, however, that with regard to the the number of spherical protuberances and the image defects the evaluation was made by relative comparison regarding as 100% the value obtained in Comparative Example C-2; with regard to the charging performance, the residual potential and the potential uniformity, by relative comparison regarding as 100% the value obtained in Comparative Example C-3; and with regard to the cost, by relative comparison regarding as 100% the value obtained in Comparative Example C-4.

The results of evaluation are shown in Table C-7 together with those in Comparative Examples C-1, C-2, C-3 and C-4.

TABLE C-1

| | First layer Photoconductive layer | Silicon carbide layer |
|---|---|---|
| Source gas and flow rate: | | |
| $SiH_4$ [ml/min(normal)] | 200 | 60 |
| $H_2$ [ml/min(normal)] | 400 | — |
| $CH_4$ [ml/min(normal)] | — | 120 |
| Substrate temperature: | | |
| (° C.) | 240 | 220 |
| Reactor internal pressure: | | |
| (Pa) | 0.7 | 0.7 |
| High-frequency power: | | |
| (W) | 500 | 600 |
| Layer thickness: | | |
| (μm) | 25 | 0.5 |

TABLE C-2

| | Second layer Upper-part blocking layer | Surface layer |
|---|---|---|
| Source gas and flow rate: | | |
| $SiH_4$ [ml/min(normal)] | 200 | — |
| $B_2H_6$ (ppm) (based on $SiH_4$) | 1,000 | — |
| $CH_4$ [ml/min(normal)] | 200 | 1,000 |
| Substrate temperature: | | |
| (° C.) | 220 | 100 |
| Reactor internal pressure: | | |
| (Pa) | 67 | 67 |
| High-frequency power: | | |
| (W) | 300 | 200 |
| Layer thickness: | | |
| (μm) | 0.3 | 0.5 |

Cross-hatching and heat shock were further evaluated by the methods described below.

Evaluation Ranks of Examples C

Number of Spherical Protuberances:

A: From 35% or more to less than 65%.

B: From 65% or more to less than 95%.

C: Equal to Comparative Example C-2.

D: 105% or more.

Image Defects:

A: From 35% or more to less than 65%.

B: From 65% or more to less than 95%.

C: Equal to Comparative Example C-2.

D: 105% or more.

Charging Performance:

A: 115% or more.

B: From 105% or more to less than 115%.

C: Equal to Comparative Example C-3.

Residual Potential:

A: Less than 85%.

B: From 85% or more to less than 95%.

C: Equal to Comparative Example C-3.

Potential Uniformity:

AA: Less than 85%.

A: From 85% or more to less than 95%.

B: Equal to Comparative Example C-3.

C: From 105% or more to less than 110%.

D: 110% or more.

Cost:

A: Less than 85%.

B: From 85% or more to less than 95%.

C: Equal to Comparative Example C-4.

D: 105% or more.

Cross-Hatching:

Using a sharp needle, the surface of each electrophotographic photosensitive member was streakily scratched in cross-hatches at intervals of 1 cm. This was immersed in water for a weak, and thereafter taken out to observe the surface of the electrophotographic photosensitive member to visually examine whether or not films stand peeled at the scratched portions. Evaluation was made according to the following criteria.

A: Any film stands not peeled. Very good.

B: Films stand peeled very partly at some streaky scratches.

C: Films stand a little peeled widely.

Heat Shock

Each electrophotographic photosensitive member was left for 48 hours in a container temperature-controlled at −20° C., and immediately thereafter, it was left for 2 hours in a container moisture-controlled to 95%. This cycle was repeated by 10 cycles, and thereafter the surface of the electrophotographic photosensitive member was visually observed. Evaluation was made according to the following criteria.

A: Any film stands not peeled. Very good.

B: Films stand peeled very partly at ends of the electrophotographic photosensitive member, but no problem because the peeling is in non-image areas.

C: Films stand a little peeled widely.

D: Films stand peeled over the whole surface.

Comparative Example C-1

Using the photosensitive member film formation apparatus of a VHF plasma-assisted CVD system, the first film-forming chamber shown in FIG. 6, a photoconductive layer formed of at least a non-single-crystal material was deposited as the first layer on each cylindrical aluminum substrate of 108 mm in diameter under conditions shown in Table C-3. In this Comparative Example, any silicon carbide layer formed of a non-single-crystal material containing at least carbon and silicon was not provided in the first layer.

Next, each unfinished photosensitive member with the first layer thus deposited was moved to the photosensitive member film formation apparatus of an RF plasma-assisted CVD system, the second film-forming chamber shown in FIG. 5, in a vacuum state by using a transport chamber, and, as the second layer, an upper-part blocking layer was deposited on the first layer and then a surface layer formed of a non-single-crystal material composed chiefly of carbon atoms was deposited on the upper-part blocking layer under conditions shown in Table C-4. Thus, electrophotographic photosensitive members were produced.

The negative-charging photosensitive members thus produced were evaluated in the same manner as in Example C-1.

The results of evaluation are shown in Table C-9 together with those in Comparative Examples C-2, C-3 and C-4.

TABLE C-3

| | First layer Photoconductive layer |
|---|---|
| Source gas and flow rate: | |
| $SiH_4$ [ml/min(normal)] | 200 |
| $H_2$ [ml/min(normal)] | 400 |
| Substrate temperature: | |
| (° C.) | 240 |
| Reactor internal pressure: | |
| (Pa) | 0.7 |
| High-frequency power: | |
| (W) | 500 |
| Layer thickness: | |
| (μm) | 25 |

TABLE C-4

| | Second layer | |
|---|---|---|
| | Upper-part blocking layer | Surface layer |
| Source gas and flow rate: | | |
| $SiH_4$ [ml/min(normal)] | 200 | — |
| $B_2H_6$ (ppm) (based on $SiH_4$) | 1,000 | — |
| $CH_4$ [ml/min(normal)] | 200 | 1,000 |
| Substrate temperature: | | |
| (° C.) | 220 | 100 |
| Reactor internal pressure: | | |
| (Pa) | 67 | 67 |
| High-frequency power: | | |
| (W) | 300 | 200 |
| Layer thickness: | | |
| (μm) | 0.3 | 0.5 |

Comparative Example C-2

Using the photosensitive member film formation apparatus of a VHF plasma-assisted CVD system, the first film-forming chamber shown in FIG. 6, a photoconductive layer formed of at least a non-single-crystal material and a silicon carbide layer formed of a non-single-crystal material containing at least carbon and silicon were deposited as the first layer on each cylindrical aluminum substrate of 108 mm in diameter under conditions shown in Table C-5, to produce unfinished electrophotographic photosensitive members.

Next, each unfinished photosensitive member obtained was moved to the photosensitive member film formation apparatus of an RF plasma-assisted CVD system, the second film-forming chamber shown in FIG. 5, in a vacuum state by using a transport chamber.

In this Comparative Example, any upper-part blocking layer as the second layer was not provided.

Next, as the second layer, a surface layer formed of a non-single-crystal material composed chiefly of carbon atoms was deposited on the first-layer blocking layer under conditions shown in Table C-6. Thus, electrophotographic photosensitive members were produced. The negative-charging photosensitive members thus obtained were evaluated in the same manner as in Example C-1.

The results of evaluation are shown in Table C-9 together with those in Comparative Examples C-1, C-3 and C-4.

TABLE C-5

| | First layer | |
|---|---|---|
| | Photoconductive layer | Silicon carbide layer |
| Source gas and flow rate: | | |
| $SiH_4$ [ml/min(normal)] | 200 | 60 |
| $H_2$ [ml/min(normal)] | 400 | — |
| $CH_4$ [ml/min(normal)] | — | 120 |
| Substrate temperature: | | |
| (° C.) | 240 | 220 |
| Reactor internal pressure: | | |
| (Pa) | 0.7 | 0.7 |
| High-frequency power: | | |
| (W) | 500 | 600 |
| Layer thickness: | | |
| (μm) | 25 | 0.5 |

TABLE C-6

| | Second layer | |
|---|---|---|
| | Not deposited | Surface layer |
| Source gas and flow rate: | | |
| $SiH_4$ [ml/min(normal)] | — | — |
| $B_2H_6$ (ppm) (based on $SiH_4$) | — | — |
| $CH_4$ [ml/min(normal)] | — | 1,000 |
| Substrate temperature: | | |
| (° C.) | — | 100 |
| Reactor internal pressure: | | |
| (Pa) | — | 67 |
| High-frequency power: | | |
| (W) | — | 200 |
| Layer thickness: | | |
| (μm) | — | 0.5 |

Comparative Example C-3

Using the photosensitive member film formation apparatus of a RF plasma-assisted CVD system as shown in FIG. 5, a photoconductive layer formed of at least a non-single-crystal material and a silicon carbide layer formed of a non-single-crystal material containing at least carbon and silicon were deposited as the first layer on each cylindrical aluminum substrate of 108 mm in diameter under conditions shown in Table C-7. Subsequently, as the second layer, an upper-part blocking layer was deposited, and further, a surface layer formed of a non-single-crystal material composed chiefly of carbon atoms was deposited, under conditions shown in Table C-7. Thus, electrophotographic photosensitive members were produced.

The negative-charging photosensitive members thus obtained were evaluated in the same manner as the evaluation in Example C-1.

The results of evaluation are shown in Table C-9 together with those in Comparative Examples C-1, C-2 and C-4.

TABLE C-7

| | First layer | | Second layer | |
|---|---|---|---|---|
| | Photoconductive layer | Silicon carbide layer | Upper-part blocking layer | Surface layer |
| Source gas and flow rate: | | | | |
| $SiH_4$ [ml/min(normal)] | 200 | 60 | 200 | — |
| $H_2$ [ml/min(normal)] | 400 | — | — | — |
| $B_2H_6$ (ppm) (based on $SiH_4$) | — | — | 1,000 | — |
| $CH_4$ [ml/min(normal)] | — | 120 | 200 | 1,000 |
| Substrate temperature: | | | | |
| (° C.) | 240 | 220 | 220 | 100 |
| Reactor internal pressure: | | | | |
| (Pa) | 62 | 65 | 67 | 67 |
| High-frequency power: | | | | |
| (W) | 500 | 600 | 300 | 200 |
| Layer thickness: | | | | |
| (μm) | 25 | 0.5 | 0.3 | 0.5 |

Comparative Example C-4

Using the photosensitive member film formation apparatus of a VHF plasma-assisted CVD system as shown in FIG. 6, a photoconductive layer formed of at least a non-single-crystal material and a silicon carbide layer formed of a non-single-crystal material containing at least carbon and silicon were deposited as the first layer on each cylindrical aluminum substrate of 108 mm in diameter under conditions shown in Table C-8. Subsequently, as the second layer, an upper-part blocking layer was deposited, and further, a surface layer formed of a non-single-crystal material composed chiefly of carbon atoms was deposited, under conditions shown in Table C-8. Thus, electrophotographic photosensitive members were produced.

The negative-charging photosensitive members thus obtained were evaluated in the same manner as the evaluation in Example C-1.

The results of evaluation are shown in Table C-9 together with those in Comparative Examples C-1, C-2 and C-3.

TABLE C-8

| | First layer | | Second layer | |
|---|---|---|---|---|
| | Photoconductive layer | Silicon carbide layer | Upper-part blocking layer | Surface layer |
| Source gas and flow rate: | | | | |
| $SiH_4$ [ml/min(normal)] | 200 | 60 | 200 | — |
| $H_2$ [ml/min(normal)] | 400 | — | — | — |

TABLE C-8-continued

| | First layer | | Second layer | |
|---|---|---|---|---|
| | Photo-con-duct-ive layer | Sili-con car-bide layer | Upper-part block-ing layer | Surface layer |
| $B_2H_6$ (ppm) (based on $SiH_4$) | — | — | 1,000 | — |
| $PH_3$ (ppm) (based on $SiH_4$) | — | — | — | — |
| NO [ml/min(normal)] | — | — | — | — |
| $CH_4$ [ml/min(normal)] | — | 120 | 200 | 1,000 |
| Substrate temperature: | | | | |
| (° C.) | 240 | 220 | 220 | 100 |
| Reactor internal pressure: | | | | |
| (Pa) | 0.7 | 0.7 | 0.8 | 0.8 |
| High-frequency power: | | | | |
| (W) | 500 | 600 | 300 | 200 |
| Layer thickness: | | | | |
| (μm) | 25 | 0.5 | 0.3 | 0.5 |

taining at least carbon and silicon were deposited as the first layer on each cylindrical aluminum substrate of 108 mm in diameter under conditions shown in Table C-10.

Next, each unfinished photosensitive member with the first layer thus deposited was moved to the photosensitive member film formation apparatus of an RF plasma-assisted CVD system, the second film-forming chamber shown in FIG. 5, in a vacuum state by using a transport chamber, and, as the second layer, an upper-part blocking layer was deposited on the first layer and then a surface layer formed of a non-single-crystal material composed chiefly of carbon atoms was deposited on the upper-part blocking layer under conditions shown in Table C-11. Thus, electrophotographic photosensitive members were produced.

The photosensitive members obtained following the above procedure were photosensitive members used under positive charging, and were evaluated in the same manner as in Example C-1, using for the evaluation a copying machine basing on GP-605 (manufactured by CANON INC.), as a test electrophotographic apparatus. The results of evaluation are shown in Table C-12.

TABLE C-9

| | Spherical protuberances | Image defects | Charging performance | Residual potential | Potential uniformity | Cross haTLhing | Heat shock | Cost |
|---|---|---|---|---|---|---|---|---|
| Example: | | | | | | | | |
| C-1 | C | B | A | A | A | A | A | A |
| Comparative Example: | | | | | | | | |
| C-1 | C | C | A | A | A | A | A | A |
| C-2 | C | C | A | A | B | A | A | B |
| C-3 | C | D | C | C | B | A | A | A |
| C-4 | C | B | A | A | A | B | B | C |

As can be seen from Table C-9, the photosensitive member of the present invention is very improved in the number of image defects, dots, even though the number of spherical protuberances are on the same level as those in Comparative Examples C-1 to C-4.

In Comparative Example C-4, the VHF system is subsequently employed also for the deposition of the second layer, where the growth mechanism is identical, and the image defects were little reduced in number. Hence, the effect of reducing dots was exhibited only a little.

In Comparative Example C-3, both the first layer and the second layer are subsequently deposited by the RF system. In such a case as well, since the growth mechanism is identical, the image defects were little reduced in number.

It has also found that providing the silicon carbide layer in the first layer is effective in improving film adherence.

It can also be understood that providing the upper-part blocking layer brings improvements in charging performance and residual potential, and the image defects have come small in number.

Example C-2

Using the photosensitive member film formation apparatus of a VHF plasma-assisted CVD system, the first film-forming chamber shown in FIG. 6, a photoconductive layer formed of at least a non-single-crystal material and a silicon carbide layer formed of a non-single-crystal material con-

TABLE C-10

| | First layer | |
|---|---|---|
| | Photocon-ductive layer | Silicon carbide layer |
| Source gas and flow rate: | | |
| $SiH_4$ [ml/min(normal)] | 150 | 55 |
| $H_2$ [ml/min(normal)] | 150 | — |
| $B_2H_6$ (ppm) (based on $SiH_4$) | 500 | — |
| NO [ml/min(normal)] | 10 | — |
| $CH_4$ [ml/min(normal)] | — | 110 |
| Substrate temperature: | | |
| (° C.) | 200 | 210 |
| Reactor internal pressure: | | |
| (Pa) | 0.8 | 0.8 |
| High-frequency power: | | |
| (W) | 300 | 300 |
| Layer thickness: | | |
| (μm) | 26 | 0.3 |

TABLE C-11

| | Second layer | |
|---|---|---|
| | Upper-part blocking layer | Surface layer |
| Source gas and flow rate: | | |
| $SiH_4$ [ml/min(normal)] | 200 | — |
| $PH_3$ (ppm) (based on $SiH_4$) | 1,000 | — |
| $CH_4$ [ml/min(normal)] | 200 | 900 |
| Substrate temperature: | | |
| (° C.) | 240 | 95 |
| Reactor internal pressure: | | |
| (Pa) | 67 | 67 |
| High-frequency power: | | |
| (W) | 300 | 200 |
| Layer thickness: | | |
| (μm) | 0.3 | 0.5 |

Example C-3

Electrophotographic photosensitive members were produced in the same manner as in Example B-3 except that the unfinished photosensitive member was taken out of the photosensitive member film formation apparatus of a VHF plasma-assisted CVD system, the first film-forming chamber, into the atmosphere.

Thereafter, each unfinished photosensitive member was moved to the photosensitive member film formation apparatus of an RF plasma-assisted CVD system, the second film-forming chamber, and the second layer was deposited on the first layer in the same manner as in Example C-2.

The photosensitive members obtained following the above procedure were photosensitive members used under positive charging, and were evaluated in the same manner as in Example C-1, using for the evaluation a copying machine basing on GP-605 (manufactured by CANON INC.), as a test electrophotographic apparatus. The results of evaluation are shown in Table C-12 together with those of Example C-2.

TABLE C-12

| | Spherical protuberances | Image defects | Charging performance | Residual potential | Potential uniformity | Cross hatching | Heat shock | Cost |
|---|---|---|---|---|---|---|---|---|
| Example: | | | | | | | | |
| C-2 | C | B | A | A | A | A | A | A |
| C-3 | C | B | A | A | A | A | A | A |

As can be seen from Table C-12, the effect of the present invention is obtainable where the unfinished photosensitive member is moved from the photosensitive member film formation apparatus of a VHF plasma-assisted CVD system, the first film-forming chamber, and the second layer is formed in the photosensitive member film formation apparatus of an RF plasma-assisted CVD system, the second film-forming chamber.

Example C-4

Using the photosensitive member film formation apparatus of a VHF plasma-assisted CVD system, the first film-forming chamber shown in FIG. 6, a photoconductive layer formed of at least a non-single-crystal material and a silicon carbide layer formed of a non-single-crystal material containing at least carbon and silicon were deposited as the first layer on each cylindrical aluminum substrate of 108 mm in diameter under conditions shown in Table C-13.

Next, each unfinished photosensitive member with the first layer thus deposited was first taken out of the first film-forming chamber into the atmosphere, and then moved to the photosensitive member film formation apparatus of an RF plasma-assisted CVD system, the second film-forming chamber shown in FIG. 5, where, as the second layer, an upper-part blocking layer was deposited on the first layer and then a surface layer formed of a non-single-crystal material composed chiefly of carbon atoms was deposited on the upper-part blocking layer under conditions shown in Table C-14. Thus, electrophotographic photosensitive members were produced.

The photosensitive members obtained following the above procedure were evaluated in the same manner as in Example C-1. The results of evaluation are shown in Table C-15 together with those of Example C-5.

Example C-5

Using the photosensitive member film formation apparatus of a VHF plasma-assisted CVD system, the first film-forming chamber shown in FIG. 6, a lower-part blocking layer formed of a non-single-crystal material, a photoconductive layer formed of a non-single-crystal material and a silicon carbide layer formed of a non-single-crystal material containing carbon and silicon were deposited as the first layer on each cylindrical aluminum substrate of 108 mm in diameter under the conditions shown in Table C-13.

Next, each unfinished photosensitive member with the first layer thus deposited was first taken out of the first film-forming chamber into the atmosphere.

In this Example, at this stage, the surface of the first layer was polished by means of the polishing apparatus shown in FIG. 7, to flatten the protuberant portions of the spherical protuberances.

Next, the unfinished photosensitive member the surface of the first layer of which was polished, was cleaned by means of the water washing system shown in FIG. 8.

Thereafter, the washed unfinished photosensitive member the surface of the first layer of which was polished was moved to the photosensitive member film formation apparatus of an RF plasma-assisted CVD system, the second film-forming chamber shown in FIG. 5, where, as the second layer, an upper-part blocking layer was deposited on the first layer and then a surface layer formed of a non-single-crystal material composed chiefly of carbon atoms was deposited on the upper-part blocking layer under conditions shown in Table C-14. Thus, electrophotographic photosensitive members were produced.

The photosensitive members obtained following the above procedure were evaluated in the same manner as in Example C-1. The results of evaluation are shown in Table C-15 together with those of Example C-4.

TABLE C-13

| | First layer | | |
|---|---|---|---|
| | Lower-part blocking layer | Photo-con-ductive layer | Silicon carbide layer |
| Source gas and flow rate: | | | |
| $SiH_4$ [ml/min(normal)] | 200 | 200 | 45 |
| $PH_3$ (ppm) (based on $SiH_4$) | 1,500 | 1.0 | — |
| NO [ml/min(normal)] | 10 | — | — |
| $CH_4$ [ml/min(normal)] | — | — | 90 |
| Substrate temperature: | | | |
| (° C.) | 200 | 200 | 230 |
| Reactor internal pressure: | | | |
| (Pa) | 0.8 | 0.8 | 0.8 |
| High-frequency power: | | | |
| (W) | 1,000 | 1,500 | 1,300 |
| Layer thickness: | | | |
| (μm) | 3 | 25 | 0.5 |

TABLE C-14

| | Second layer | |
|---|---|---|
| | Upper-part blocking layer | Surface layer |
| Source gas and flow rate: | | |
| $SiH_4$ [ml/min(normal)] | 150 | — |
| $B_2H_6$ (ppm) (based on $SiH_4$) | 3,000 | — |
| $CH_4$ [ml/min(normal)] | 150 | 800 |
| Substrate temperature: | | |
| (° C.) | 240 | 200 |
| Reactor internal pressure: | | |
| (Pa) | 50 | 60 |
| High-frequency power: | | |
| (W) | 320 | 280 |
| Layer thickness: | | |
| (μm) | 0.5 | 0.5 |

TABLE C-15

| | Spherical protuberances | Image defects | Charging performance | Residual potential | Potential uniformity | Cross hatching | Heat shock | Cost |
|---|---|---|---|---|---|---|---|---|
| Example: | | | | | | | | |
| C-4 | C | B | A | A | A | A | A | A |
| C-5 | C | A | A | A | A | A | A | A |
| C-11 | C | A | A | A | AA | A | A | A |

As can be seen from the results shown in Table C-15, the effect of the present invention is obtainable also when the lower-part blocking layer was provided.

It has also been found that the effect of reducing image defects is enhanced by depositing the second layer after the protuberant portions of the spherical protuberances have been made flat.

Example C-6

Using the photosensitive member film formation apparatus of a VHF plasma-assisted CVD system, the first film-forming chamber shown in FIG. 6, a lower-part blocking layer formed of a non-single-crystal material, a photoconductive layer formed of a non-single-crystal material and a silicon carbide layer formed of a non-single-crystal material containing carbon and silicon were deposited as the first layer on each cylindrical aluminum substrate of 108 mm in diameter under the conditions shown in Table C-16.

Next, each unfinished photosensitive member with the first layer thus deposited was first taken out of the first film-forming chamber into the atmosphere.

When it was taken out, the surface of the first layer was polished by means of the polishing apparatus shown in FIG. 7, to flatten the protuberant portions of the spherical protuberances.

Next, the unfinished photosensitive member the surface of the first layer of which was polished was cleaned by means of the water washing system shown in FIG. 8.

Thereafter, the unfinished photosensitive member thus washed, the surface of the first layer of which was polished and washed, was moved to the photosensitive member film formation apparatus of an RF plasma-assisted CVD system, the second film-forming chamber shown in FIG. 5. Then, as the second layer, an upper-part blocking layer was deposited on the first layer and then a surface layer formed of a non-single-crystal material composed chiefly of carbon atoms was deposited on the upper-part blocking layer under conditions shown in Table C-17. Thus, electrophotographic photosensitive members were produced.

In this Example, photosensitive members C-6A to C-6F were produced whose upper-part blocking layers were different in layer thickness.

The negative-charging photosensitive members obtained following the above procedure were evaluated in the same manner as in Example C-1, and also the size of the spherical protuberances was further evaluated. The whole surface of each photosensitive member obtained was observed with an optical microscope to examine the diameter of the largest spherical protuberance. As the result, it was found that, under the production conditions of this Example, the diameter was about 100 μm in every photosensitive member. The ratio of the layer thickness of the upper-part blocking layer to the diameter of the largest spherical protuberance, thus measured, was determined.

The results of evaluation are shown in Table C-18.

TABLE C-16

| | First layer | | |
|---|---|---|---|
| | Lower-part blocking layer | Photo-con-ductive layer | Silicon carbide layer |
| Source gas and flow rate: | | | |
| $SiH_4$ [ml/min(normal)] | 120 | 200 | 40 |
| $H_2$ [ml/min(normal)] | 360 | 1,000 | — |
| $PH_3$ (ppm) (based on $SiH_4$) | 3,000 | 0.5 | — |
| NO [ml/min(normal)] | 5 | — | — |
| $CH_4$ [ml/min(normal)] | — | — | 80 |
| Substrate temperature: | | | |
| (° C.) | 280 | 270 | 250 |
| Reactor internal pressure: | | | |
| (Pa) | 0.6 | 0.7 | 0.6 |
| High-frequency power: | | | |
| (W) | 400 | 600 | 600 |

TABLE C-16-continued

| | First layer | | |
|---|---|---|---|
| | Lower-part blocking layer | Photo-con-ductive layer | Silicon carbide layer |
| Layer thickness: | | | |
| (μm) | 5 | 25 | 0.5 |

TABLE C-17

| | Second layer | |
|---|---|---|
| | Upper-part blocking layer | Surface layer |
| Source gas and flow rate: | | |
| $SiH_4$ [ml/min(normal)] | 150 | — |
| $B_2H_6$ (ppm) (based on $SiH_4$) | 10,000 | — |
| $CH_4$ [ml/min(normal)] | 500 | 600 |
| Substrate temperature: | | |
| (° C.) | 230 | 220 |
| Reactor internal pressure: | | |
| (Pa) | 70 | 70 |
| High-frequency power: | | |
| (W) | 300 | 100 |
| Layer thickness: | | |
| (μm) | changed | 0.5 |

TABLE C-18

| | Example C-6 Photosensitive member No: | | | | | |
|---|---|---|---|---|---|---|
| | C-6A | C-6B | C-6C | C-6D | C-6E | C-6F |
| Layer thickness of upper-part blocking layer: (μm) | 0.001 | 0.005 | 0.01 | 0.1 | 1 | 2 |
| Layer thickness ratio of upper-part blocking layer to diameter of largest spherical protuberance: | $1 \times 10^{-5}$ | $5 \times 10^{-5}$ | $1 \times 10^{-4}$ | $1 \times 10^{-3}$ | $1 \times 10^{-2}$ | $2 \times 10^{-2}$ |
| Evaluation | | | | | | |
| Number of spherical protuberances: | C | C | C | C | C | C |
| Number of dots: | C | C | B | B | B | B |
| Charging performance: | B | B | A | A | A | A |
| Residual potential: | B | B | A | A | A | A |
| Potential uniformity: | A | A | A | A | B | B |
| Cost: | A | A | A | A | A | B |

As can be seen from the results shown in Table C-18, in order to obtain the effect of reducing image defects in the present invention, the layer thickness $10^{-4}$ times or more as large as the diameter of the largest spherical protuberance is preferable as the layer thickness of the upper-part blocking layer.

The effect of reducing image defects was also sufficiently obtained in respect of the photosensitive member C-6F, but a lowering of sensitivity was seen because the thickness of the upper-part blocking layer is too large. Thus, it is found preferable to control the upper limit of the layer thickness to be 1 μm or less.

When the cleaning was carried out by means of the water washing system before the second layer is deposited, the adhesion was improved.

Example C-7

Using the photosensitive member film formation apparatus of a VHF plasma-assisted CVD system, the first film-forming chamber shown in FIG. 6, a lower-part blocking layer formed of a non-single-crystal material, a photoconductive layer formed of a non-single-crystal material and a silicon carbide layer formed of a non-single-crystal material containing carbon and silicon were deposited as the first layer on each cylindrical aluminum substrate of 108 mm in diameter under the conditions shown in Table C-19.

Next, each unfinished photosensitive member with the first layer thus deposited was first taken out of the first film-forming chamber into the atmosphere.

When it was taken out, the surface of the first layer was polished by means of the polishing apparatus shown in FIG. 7, to flatten the protuberant portions of the spherical protuberances.

Next, the unfinished photosensitive member the surface of the first layer of which was polished was cleaned by means of the water washing system shown in FIG. 8.

Thereafter, the unfinished photosensitive member thus washed, the surface of the first layer of which was polished, was moved to the photosensitive member film formation apparatus of an RF plasma-assisted CVD system, the second film-forming chamber shown in FIG. 5. Then, as the second layer, an upper-part blocking layer was deposited on the first layer and then a surface layer formed of a non-single-crystal material composed chiefly of carbon atoms was deposited on the upper-part blocking layer both under conditions shown in Table C-20. Thus, electrophotographic photosensitive members were produced.

In this Example, photosensitive members C-7G to C-7L were produced in which the content of Group 13 element B (boron) incorporated in the upper-part blocking layer was changed.

The negative-charging photosensitive members obtained following the above procedure were evaluated in the same manner as in Example C-1.

After the evaluation, samples were cut out from the respective photosensitive members, and SIMS (secondary ion mass spectroscopy) was conducted to examine the B (boron) content in each upper-part blocking layer.

The results of evaluation are shown in Table C-21.

TABLE C-19

| | First layer | | |
|---|---|---|---|
| | Lower-part blocking layer | Photo-con-ductive layer | Silicon carbide layer |
| Source gas and flow rate: | | | |
| $SiH_4$ [ml/min(normal)] | 200 | 200 | 50 |
| $PH_3$ (ppm) (based on $SiH_4$) | 1,500 | 1.0 | — |
| NO [ml/min(normal)] | 10 | — | — |
| $CH_4$ [ml/min(normal)] | — | — | 100 |
| Substrate temperature: | | | |
| (° C.) | 200 | 210 | 210 |
| Reactor internal pressure: | | | |
| (Pa) | 0.7 | 0.7 | 0.8 |
| High-frequency power: | | | |
| (W) | 1,000 | 2,000 | 1,500 |
| Layer thickness: | | | |
| (μm) | 3 | 25 | 0.5 |

TABLE C-20

| | Second layer | |
|---|---|---|
| | Upper-part blocking layer | Surface layer |
| Source gas and flow rate: | | |
| $SiH_4$ [ml/min(normal)] | 200 | — |
| $B_2H_6$ (ppm) (based on $SiH_4$) | changed | — |
| $CH_4$ [ml/min(normal)] | 200 | 1,000 |
| Substrate temperature: | | |
| (° C.) | 230 | 95 |
| Reactor internal pressure: | | |
| (Pa) | 60 | 67 |
| High-frequency power: | | |
| (W) | 310 | 210 |
| Layer thickness: | | |
| (μm) | 0.4 | 0.6 |

TABLE C-21

| | Example C-7 Photosensitive member No: | | | | | |
|---|---|---|---|---|---|---|
| | C-7G | C-7H | C-7I | C-7J | C-7K | C-7L |
| B content in upper-part blocking layer: (atomic ppm) | 80 | 100 | 1,000 | 10,000 | 30,000 | 35,000 |
| Evaluation | | | | | | |
| Number of spherical protuberances: | C | C | C | C | C | C |
| Number of dots: | C | B | B | B | B | C |
| Charging performance: | C | A | A | A | A | C |
| Residual potential: | C | A | A | A | A | C |
| Potential uniformity: | B | A | A | A | A | B |
| Cost: | A | A | A | A | A | A |

As can be seen from the results shown in Table C-21, it is suitable for the B (boron) content in each upper-part blocking layer to be from 100 atomic ppm to 30,000 atomic ppm. Also, when the cleaning was carried out by means of the water washing system before the second layer is deposited, the adhesion was improved.

Example C-8

Using the photosensitive member film formation apparatus of a VHF plasma-assisted CVD system, the first film-forming chamber shown in FIG. 6, a lower-part blocking layer formed of a non-single-crystal material, a photoconductive layer formed of a non-single-crystal material and a silicon carbide layer formed of a non-single-crystal material containing carbon and silicon were deposited as the first layer on each cylindrical aluminum substrate of 108 mm in diameter under the conditions shown in Table C-13.

Next, each unfinished photosensitive member with the first layer thus deposited was first taken out of the first film-forming chamber into the atmosphere.

In this Example, when it was taken out, the surface of the first layer was polished by means of the polishing apparatus shown in FIG. 7, to flatten the protuberant portions of the spherical protuberances. As a result of this flattening, the surface protuberances which had been about 10 μm in height before the polishing decreased to 1 μm or less.

Next, the unfinished photosensitive member the surface of the first layer of which was polished was cleaned by means of the water washing system shown in FIG. 8.

Thereafter, the unfinished photosensitive member thus washed, the surface of the first layer of which was polished, was moved to the photosensitive member film formation apparatus of an RF plasma-assisted CVD system, the second film-forming chamber shown in FIG. 5, where an upper-part blocking layer was deposited on the first layer under the conditions shown in Table C-14.

Next, the unfinished photosensitive member with the layers up to the upper-part blocking layer thus deposited was moved to another photosensitive member film formation apparatus of an RF plasma-assisted CVD system, a third film-forming chamber, and a surface layer formed of a non-single-crystal material composed chiefly of carbon atoms was deposited on the upper-part blocking layer under the conditions shown in Table C-14. Thus, electrophotographic photosensitive members were produced.

The negative-charging photosensitive members obtained following the above procedure were evaluated in the same manner as in Example C-1. The results of evaluation are shown in Table C-15 together with those of Examples C-4 and C-5.

As can be seen from the results shown in Table C-15, good results were obtained also when the layers constituting the second layer were deposited in different film-forming chambers (reactors).

Example C-9

Using the photosensitive member film formation apparatus of a VHF plasma-assisted CVD system, the first film-forming chamber, shown in FIG. 6, up to a silicon carbide layer 2 formed of a non-single-crystal material containing carbon and silicon were deposited as the first layer on a cylindrical aluminum substrate under the conditions, as shown in Table C-22, that the flow rate of $B_2H_6$, which is a gas for incorporating the Group 13 element B (boron) in the silicon carbide layer, was changed.

Next, the substrate with up to the first layer deposited thereon was taken once out of the film-forming chamber and exposed to the atmosphere. Then, after this substrate was left standing for 10 minutes in the atmosphere, its surface was polished by means of the polishing apparatus shown in FIG. 7, to flatten the protuberant portions of the spherical protuberances. As a result of this flattening, the surface protuberances which had been 10 μm in height before the polishing was reduced to 1 μm or less.

The unevenness ascribable to the protuberant portions was evaluated using a microscope (STM-5, manufactured by Olympus Optical Co. Ltd.) having the function to detect the position of Z-directions (perspective directions of an observation object and an objective lens), on the basis of the difference between Z1 and Z2, wherein Z1 is a point in time at which the microscope is focused on the tip of the protuberance and Z2 is a point in time at which the microscope is focused on the normal portion close to said protuberance.

Next, the surface was cleaned by means of the water washing system shown in FIG. 8.

Thereafter, the substrate with the first layer deposited thereon was moved to the photosensitive member film formation apparatus of an RF plasma-assisted CVD system, the second film-forming chamber shown in FIG. 5, where as the second layer an intermediate layer formed of a non-single crystal material containing carbon and silicon and an upper-part blocking layer formed of a non-single crystal material were deposited on the first layer under the conditions shown in Table C-22.

Next, the substrate on which the upper-part blocking layer was deposited was moved to another photosensitive member film formation apparatus of an RF plasma-assisted CVD system, a third film-forming chamber shown in FIG. 5, and a surface layer formed of a non-crystal material composed chiefly of carbon atoms was deposited on the upper-part blocking layer under the conditions shown in Table C-22. Thus, in this Example, photosensitive members M to R were produced.

The photosensitive members obtained following the above procedures were electrophotographic photosensitive members used under negative charging, and were evaluated in the same way as in Example C-1. The evaluation results are shown in Table C-23.

It can be seen from Table C-23 that the charging performance is improved by incorporating impurities of 100 ppm to 30,000 ppm in the silicon carbide layer.

TABLE C-22(A)

| | First layer | | | |
|---|---|---|---|---|
| | Lower-part blocking layer | Photoconductive layer | Silicon carbide layer 1 | Silicon carbide layer 2 |
| Source gas and flow rate: | | | | |
| $SiH_4$ (*) | 120 | 500 | 150 | 65 |
| $H_2$ (*) | 300 | 1,000 | — | — |
| $B_2H_6$ (**) | — | — | changed | — |
| $PH_3$ (**) | 3,000 | 0.5 | — | — |
| NO (*) | 5 | — | — | — |
| $CH_4$ (*) | — | — | 500 | 130 |
| Substrate temperature: | | | | |
| (° C.) | 250 | 260 | 240 | 250 |
| Reactor internal | | | | |

TABLE C-22(A)-continued

| | First layer | | | |
|---|---|---|---|---|
| | Lower-part blocking layer | Photoconductive layer | Silicon carbide layer 1 | Silicon carbide layer 2 |
| pressure: | | | | |
| (Pa) | 0.6 | 0.7 | 0.8 | 0.8 |
| High-frequency power: | | | | |
| (W) | 400 | 600 | 500 | 500 |
| Layer thickness: | | | | |
| (μm) | 5 | 25 | 0.2 | 0.5 |

(*): [ml/min(normal)]
(**): (ppm) (based on $SiH_4$)

TABLE C-22(B)

| | Second layer | | |
|---|---|---|---|
| | Intermediate layer | Upper-part blocking layer | Surface layer |
| Source gas and flow rate: | | | |
| $SiH_4$ (*) | 450 | 150 | — |
| $H_2$ (*) | — | — | — |
| $B_2H_6$ (**) | — | 10,000 | — |
| $PH_3$ (**) | — | — | — |
| NO (*) | — | — | — |
| $CH_4$ (*) | 900 | 500 | 900 |
| Substrate temperature: | | | |
| (° C.) | 250 | 250 | 270 |
| Reactor internal pressure: | | | |
| (Pa) | 80 | 75 | 80 |
| High-frequency power: | | | |
| (W) | 100 | 300 | 100 |
| Layer thickness: | | | |
| (μm) | 0.2 | 0.2 | 0.5 |

(*): [ml/min(normal)]
(**): (ppm) (based on $SiH_4$)

TABLE C-23

| | Example C-9 Photosensitive member No: | | | | | |
|---|---|---|---|---|---|---|
| | M | N | O | P | Q | R |
| B content in Silicon carbide layer: (atomic ppm) | 80 | 100 | 1,000 | 10,000 | 30,000 | 35,000 |
| Evaluation | | | | | | |
| Number of spherical protuberances: | C | C | C | C | C | C |
| Number of dots: | B | B | B | B | B | B |
| Charging performance: | A | AA | AA | AA | AA | A |
| Residual potential: | A | A | A | A | A | A |
| Potential uniformity: | B | A | A | A | A | B |
| Cost: | A | A | A | A | A | A |
| Cross-hatching: | B | B | B | B | B | B |
| Heat shock: | A | A | A | A | A | A |

Example D-1

Using the a-Si photosensitive member film formation apparatus of a VHF plasma-assisted CVD system as shown in FIG. 6, eight substrates were produced on which layers up to an intermediate layer (silicon carbide layer) were deposited as the first layer on eight cylindrical aluminum substrates of 80 mm in diameter under conditions shown in Table D-1.

TABLE D-1

| | Lower-part blocking layer | Photoconductive layer | * Intermediate layer |
|---|---|---|---|
| Source gas and flow rate: | | | |
| $SiH_4$ [ml/min(normal)] | 250 | 250 | 35 |
| $B_2H_6$ (ppm) (based on $SiH_4$) | — | 0.1 | — |
| NO [ml/min(normal)] | 20 | — | — |
| $CH_4$ [ml/min(normal)] | — | — | 125 |
| Substrate temperature: | | | |
| (° C.) | 200 | 200 | 200 |
| Reactor internal pressure: | | | |
| (Pa) | 0.8 | 0.8 | 1.0 |
| High-frequency power: | | | |
| (W) | 600 | 1,200 | 400 |
| Layer thickness: | | | |
| (μm) | 3 | 30 | 0.3 |

* (silicon carbide layer)

Next, the eight substrates on each of which the first layer was deposited was first taken out of the film-forming chamber and exposed to the atmosphere. Then, immediately after they were taken out, the arithmetic mean roughness Ra of the outermost surface of each first layer was measured. It was measured with an atomic-force microscope (AFM) Q-Scope 250, manufactured by Quesant Co. As the result, the surfaces of the eight substrates were found to have arithmetic mean roughness Ra within the range of from 45 nm to 60 nm in the 10 μm×10 μm visual field.

Next, the surfaces of four among the eight were worked. To work the surfaces, a lapping tape (trade name: C2000; available from Fuji Photo Film Co. Ltd.) of 360 mm in width was pressed at 400 kPa against the surface by means of a pressure roller having a JIS rubber hardness of 30, and the surface was polished at a tape speed of 3.0 mm/min and a photosensitive member rotational speed of 60 rpm, changing polishing time. As the result, the Ra's of the surfaces of the four after the polishing were 3 nm, 15 nm, 19 nm and 25 nm. Next, the four were each moved to the a-Si photosensitive member film formation apparatus of an RF plasma-assisted CVD system as shown in FIG. 5, and as the second layer an upper-part blocking layer and a surface layer were deposited under conditions shown in Table D-2.

TABLE D-2

| | Upper-part blocking layer | Surface layer |
|---|---|---|
| Source gas and flow rate: | | |
| $SiH_4$ [ml/min(normal)] | 120 | 15 |
| $B_2H_6$ (ppm) (based on $SiH_4$) | 500 | — |

TABLE D-2-continued

| | Upper-part blocking layer | Surface layer |
|---|---|---|
| NO [ml/min(normal)] | — | — |
| $CH_4$ [ml/min(normal)] | 120 | 500 |
| Substrate temperature: | | |
| (° C.) | 210 | 210 |
| Reactor internal pressure: | | |
| (Pa) | 60 | 60 |
| High-frequency power: | | |
| (W) | 300 | 210 |
| Layer thickness: | | |
| (μm) | 0.3 | 0.5 |

The photosensitive members obtained following the above procedure were photosensitive members used under negative charging, and were evaluated in the following way.

Image Defects:

The electrophotographic photosensitive members produced in this Examples were each set in the electrophotographic apparatus as shown in FIG. 9, employing a corona discharger as a primary charging assembly and having a cleaning blade in its cleaner, and images were formed. Stated specifically, a copying machine iR6000 (manufactured by CANON INC.; process speed: 265 mm/sec; image exposure) was used as a base machine and was so remodeled that the negative charging was performable, and a toner was changed for a negative toner. Using this remodeled machine as a test electrophotographic apparatus, copies of an A3-size white blank original were taken. Images thus obtained were observed, and the number of black dots coming from spherical protuberances of 0.3 mm or more in diameter was counted. The results obtained were ranked by relative comparison regarding as 100% the value obtained in Example D-2 given later.

A: From 35% or more to less than 65%.

B: From 65% or more to less than 95%.

C: Equal to Example D-2.

Evaluation of Adhesion:

(Observation of Film Peel-Off)

Each electrophotographic photosensitive member produced was left standing for 48 hours in a container temperature-controlled at −30° C., and immediately thereafter, it was left standing for 48 hours in a container temperature-controlled at +50° C. and moisture-controlled to 95%. This cycle was repeated by 10 cycles to conduct a heat shock test, and thereafter the surface of the electrophotographic photosensitive member was observed. Further, vibration of from 10 Hz to 10 kHz with an acceleration of 7G was repeated by 5 cycles for a sweep time of 2.2 minutes to conduct a vibration test, and thereafter the surface of the electrophotographic photosensitive member was observed. Evaluation was made according to the following criteria.

A: After the vibration test, any film are not seen to have peeled. Very good.

B: After the vibration test, minute film peel-off is partly seen at ends of non-image areas, but no problem in practical use.

C: Equal to Example D-2 (After the heat shock test, minute film peel-off is partly seen at ends of non-image areas, but no problem in practical use).

Evaluation of Cleaning Performance:

(Slip-through of Toner)

Using the above remodeled machine of iR6000, evaluation was made on slip-through of toner. Using an A3-size prescribed sheet as an original, a 100,000-sheet paper feed running test was conducted. After the running, copies of a halftone image were taken to examine whether or not the toner has slipped through the cleaning blade. Stated specifically, in A3-size halftone images, the area of any spots caused by the slip-through of toner was estimated from five copy sample sheets. The like evaluation was made five times to obtain results on the five copy sample sheets.

Judgement criteria are set as shown below.

A: Any spots are not seen at all.

B: Spots are little seen (equal to Example D-2).

Damage of Cleaning Blade Edge:

Each electrophotographic photosensitive member produced in this Example was set in the above remodeled machine of iR6000, and a 5,000,000-sheet paper feed running test was conducted to make evaluation on how the edge of the cleaning blade stands damaged as a result of the running.

A: Any damages are not seen at all, and the blade is in a very good state.

B: Good.

C: Equal to Example D-2.

Example D-2

Using the a-Si photosensitive member film formation apparatus of a VHF plasma-assisted CVD system as shown in FIG. 6, the first layer was deposited on eight cylindrical aluminum substrates of 80 mm in diameter under the conditions shown in Table D-1.

Next, the eight substrates on each of which the first layer was thus deposited was first taken out of the film-forming chamber. Then, immediately after they were taken out, the arithmetic mean roughness Ra of their their surfaces was measured. It was measured in the same manner as in Example D-1. As the result, the surfaces of the eight were found to have the arithmetic mean roughness Ra within the range of from 45 nm to 60 nm in the 10 μm×10 μm visual field.

Next, among the eight produced, one having an Ra of 58 nm was, without being surface-worked, moved to the a-Si photosensitive member film formation apparatus of an RF plasma-assisted CVD system as shown in FIG. 5, and as the second layer an upper-part blocking layer and a surface layer were deposited under the conditions shown in Table D-2.

Example D-3

Using the a-Si photosensitive member film formation apparatus of a VHF plasma-assisted CVD system as shown in FIG. 6, the first layer was deposited on eight cylindrical aluminum substrates of 80 mm in diameter under the conditions shown in Table D-1.

Next, the eight substrates on each of which the first layer was thus deposited was first taken out of the film-forming chamber. Then, immediately after they were taken out, the arithmetic mean roughness Ra of their surfaces were measured. It was measured in the same manner as in Example D-1. As the result, the surfaces of the eight was found to have Ra within the range of from 45 nm to 60 nm.

Next, the surface of one among the eight were worked. To work the surfaces, a lapping tape (trade name: C2000; available from Fuji Photo Film Co. Ltd.) of 360 mm in width was pressed at 0.1 MPa against the surface by means of a pressure roller having a JIS rubber hardness of 30, and the surface was polished under conditions of a tape speed of 3.0 mm/min and a photosensitive member rotational speed of 60 rpm. As the result, the Ra of the surface after the polishing was 29 nm. Next, this was moved to the a-Si photosensitive member film formation apparatus of an RF plasma-assisted CVD system as shown in FIG. 5, and as the second layer an upper-part blocking layer and a surface layer were deposited under conditions shown in Table D-2.

The electrophotographic photosensitive members of Examples D-1 and D-3 were evaluated in the same manner as in Example D-1 to obtain the results shown in Table D-3.

TABLE D-3

| | Example Ra of first layer surface: | | | | |
|---|---|---|---|---|---|
| | D-1 | | | | D-3 |
| | 3 nm | 15 nm | 19 nm | 25 nm | 29 nm |
| Evaluation | | | | | |
| Image defects: | A | A | B | B | C |
| Film peel-off: | B | A | A | B | B |
| Toner slip-through: | A | A | A | B | B |
| Damage of blade edge: | A | A | A | B | C |

As can be seen from Table D-3, the polishing of the surface of the first layer to the level of an Ra of 25 nm or less has brought the effect of reducing image defects. Further, from the results on the observation of film peeling, it has been found that the photosensitive member of Example D-1 has superior adhesion. Still further, from the results on the slip-thorough of toner and the damage of cleaning blade, it has been found that the photosensitive member of Example D-1 is very superior in cleaning performance. Still further, any interference fringes are not seen, and good images are obtained. Also, the deposition of the first layer in the a-Si photosensitive member film formation apparatus of a VHF plasma-assisted CVD system makes it possible to shorten the film formation time in virtue of the film deposition rate made higher and also, since eight photosensitive members can be produced in one-time film formation, promises very good productivity and can achieve cost reduction.

Example D-4

Using the a-Si photosensitive member film formation apparatus of a VHF plasma-assisted CVD system as shown in FIG. 6, layers up to an intermediate layer were deposited as the first layer on eight cylindrical aluminum substrates of 80 mm in diameter under conditions shown in Table D-4.

TABLE D-4

| | Lower-part blocking layer | Photoconductive layer | Intermediate layer |
|---|---|---|---|
| Source gas and flow rate: | | | |
| $SiH_4$ [ml/min(normal)] | 150 | 150 | 25 |
| $B_2H_6$ (ppm) (based on $SiH_4$) | — | 0.2 | — |
| NO [ml/min(normal)] | 15 | — | — |
| $CH_4$ [ml/min(normal)] | — | — | 120 |
| Substrate temperature: | | | |
| (° C.) | 200 | 200 | 200 |
| Reactor internal pressure: | | | |
| (Pa) | 0.8 | 0.8 | 1.0 |
| High-frequency power: | | | |
| (W) | 400 | 1,000 | 400 |
| Layer thickness: | | | |
| (μm) | 3 | 30 | 0.2 |

Next, the substrates on each of which the first layer was thus deposited was first taken out of the film-forming chamber. Then, immediately after they were taken out, the arithmetic mean roughness Ra of their surfaces were measured in the same manner as in Example D-1. As the result, the surfaces of the eight were found to have the Ra within the range of from 48 nm to 58 nm.

Next, the surfaces of these were worked. The surfaces were worked in the same manner as in Example D-1. As the result, their surface Ra was 8 nm. Next, these were cleaned by means of the water washing system shown in FIG. 8. Thereafter, these were each moved to the a-Si photosensitive member film formation apparatus of an RF plasma-assisted CVD system as shown in FIG. 5, and as the second layer an intermediate layer, an upper-part blocking layer and a surface layer were deposited under conditions shown in Table D-5.

TABLE D-5

| | Intermediate layer | Upper-part blocking layer | Surface layer |
|---|---|---|---|
| Source gas and flow rate: | | | |
| $SiH_4$ [ml/min(normal)] | 10 | 120 | 10 |
| $B_2H_6$ (ppm) (based on $SiH_4$) | — | 600 | — |
| $CH_4$ [ml/min(normal)] | 650 | 120 | 650 |
| Substrate temperature: | | | |
| (° C.) | 190 | 210 | 210 |
| Reactor internal pressure: | | | |
| (Pa) | 67 | 67 | 67 |
| High-frequency power: | | | |
| (W) | 170 | 300 | 170 |
| Layer thickness: | | | |
| (μm) | 0.05 | 0.2 | 0.5 |

The negative-charging photosensitive members obtained following the above procedure were evaluated in the same manner as in Example D-1.

The results of evaluation are shown in Table D-8. As can be seen from the results of Example D-4, the image defects were on a very good level, and very good results were obtained also on the cleaning performance. Further, any interference fringes were not seen, and good images were obtained. Also, when the cleaning is carried out by means of the water washing system before the second layer is deposited, the adhesion is improved, and good results are obtained especially in the heat shock test and vibration test. Still also, the deposition of the first layer in the a-Si photosensitive member film formation apparatus of a VHF plasma-assisted CVD system makes it possible to shorten the film formation time in virtue of the film deposition rate made higher and also, since eight photosensitive members can be produced in one-time film formation, promises very good productivity and can achieve cost reduction .

Example D-5

Using the a-Si photosensitive member film formation apparatus of a VHF plasma-assisted CVD system as shown in FIG. 6, layers up to an intermediate layer were deposited as the first layer on eight cylindrical aluminum substrates of 80 mm in diameter under conditions shown in Table D-6.

TABLE D-6

| | Lower-part blocking layer | Photoconductive layer | Intermediate layer |
|---|---|---|---|
| Source gas and flow rate: | | | |
| $SiH_4$ [ml/min(normal)] | 200 | 200 | 25 |
| NO [ml/min(normal)] | 18 | — | — |
| $CH_4$ [ml/min(normal)] | — | — | 125 |
| Substrate temperature: | | | |
| (° C.) | 200 | 200 | 200 |
| Reactor internal pressure: | | | |
| (Pa) | 0.8 | 0.8 | 1.0 |
| High-frequency power: | | | |
| (W) | 300 | 1,200 | 400 |
| Layer thickness: | | | |
| (μm) | 3 | 30 | 0.5 |

Next, the substrates on each of which the first layer was thus deposited was first taken out of the film-forming chamber. Then, immediately after they were taken out, the arithmetic mean roughness Ra of their surfaces was measured in the same manner as in Example D-1. As the result, the surfaces of the eight were found to have the Ra within the range of from 48 nm to 58 nm.

Next, the surfaces of these unfinished photosensitive members were worked. The surfaces were worked in the same manner as in Example D-1. As the result, their surface Ra was 3 nm. Next, after worked, these were cleaned by means of the water washing system shown in FIG. 8. Thereafter, these were each moved to the a-Si photosensitive member film formation apparatus of an RF plasma-assisted CVD system as shown in FIG. 5, and, after these were each subjected to hydrogen plasma etching, an intermediate layer, an upper-part blocking layer and a surface layer were deposited as the second layer, under conditions shown in Table D-7.

TABLE D-7

| | Hydrogen plasma etching | Intermediate layer | Upper-part blocking layer | Surface layer |
|---|---|---|---|---|
| Source gas and flow rate: | | | | |
| $SiH_4$ [ml/min(normal)] | — | 10 | 120 | 10 |
| $H_2$ [ml/min(normal)] | 1,000 | — | — | — |
| $B_2H_6$ (ppm) (based on $SiH_4$) | — | — | 400 | — |
| $CH_4$ [ml/min(normal)] | — | 650 | 120 | 650 |
| Substrate temperature: | | | | |
| (° C.) | 190 | 190 | 210 | 210 |
| Reactor internal pressure: | | | | |
| (Pa) | 70 | 67 | 67 | 67 |
| High-frequency power: | | | | |
| (W) | 450 | 170 | 300 | 170 |
| Layer thickness: | | | | |
| (μm) | — | 0.05 | 0.3 | 0.5 |

The negative-charging photosensitive members obtained following the above procedure were evaluated in the same manner as in Example D-1.

The results of evaluation are shown in Table D-8. As can be seen from the results of Example D-5, the image defects are on a very good level, and very good results are obtained also on the cleaning performance. Further, any interference fringes are not seen, and good images are obtained. Also, in Example D-5, the cleaning was carried out by means of the water washing system before the second layer was deposited and further the plasma etching was carried out before the second layer was deposited bring an improvement of adherence, and good results were obtained especially in the heat shock test and vibration test. Still also, the deposition of the first layer in the a-Si photosensitive member film formation apparatus of a VHF plasma-assisted CVD system makes it possible to shorten the film formation time in virtue of the film deposition rate made higher and also, since eight photosensitive members can be produced in one-time film formation, promises very good productivity and can achieve cost reduction.

TABLE D-8

| | Example | |
|---|---|---|
| | D-4 | D-5 |
| Ra of first layer surface: | 8 nm | 3 nm |
| Evaluation | | |
| Image defects: | A | A |
| Film peel-off: | A | A |
| Toner slip-through: | A | A |
| Damage of blade edge: | A | A |

What is claimed is:

1. A process for producing an electrophotographic photosensitive member having a layer formed of a non single crystal material, the process comprising the steps of:

as a first step, placing a cylindrical substrate having a conductive surface, in a first film-forming chamber having an evacuation means and a source gas feed means and capable of being made vacuum-airtight, and decomposing a source gas by means of a high-frequency power to deposit on the cylindrical substrate a first layer formed of a non-single-crystal material;

as a second step, taking out of the first film-forming chamber the cylindrical substrate on which the first layer has been deposited; and as a third step, placing the cylindrical substrate on which the first layer has been deposited, in a second film-forming chamber having an evacuation means and a source gas feed means and capable of being made vacuum-airtight, and decomposing a source gas by means of a high-frequency power to deposit on the first layer a second layer comprising an upper-part blocking layer formed of a non-single-crystal material, wherein said upper-part blocking layer comprises a non-single-crystal material composed chiefly of silicon atoms and containing at least one of carbon atoms, oxygen atoms and nitrogen atoms, wherein said a non-single-crystal material further contains atoms capable of controlling conductivity, and wherein said atoms capable of controlling conductivity which are contained in said upper-part blocking layer comprises an element belonging to Group 13 or Group 15 of the periodic table in a content of from 100 atomic ppm or more to 30,000 atomic ppm or less.

2. The electrophotographic photosensitive member production process according to claim 1, wherein said first layer is made of a non-single-crystal material with silicon atoms as a matrix and containing at least one of hydrogen atoms and halogen atoms.

3. The electrophotographic photosensitive member production process according to claim 1, wherein the step of depositing said first layer comprises depositing a silicon carbide layer formed of a non-single-crystal material containing at least carbon and silicon.

4. The electrophotographic photosensitive member production process according to claim 3, wherein said silicon carbide layer is incorporated with an element belonging to Group 13 or Group 15 of the periodic table.

5. The electrophotographic photosensitive member production process according to claim 4, wherein said element belonging to Group 13 or Group 15 of the periodic table is incorporated in said silicon carbide layer in a content of from 100 atomic ppm or more to 30,000 atomic ppm or less.

6. The electrophotographic photosensitive member production process according to claim 1, wherein said upper-part blocking layer is so formed that said upper-part blocking layer is in a thickness of at least $10^{-4}$ times a diameter of the largest spherical protuberance among spherical protuberances present on the surface of an unfinished electrophotographic photosensitive member after the second layer has been deposited, and in a thickness of 1 μm or less.

7. The electrophotographic photosensitive member production process according to claim 1, wherein, in said second step, the cylindrical substrate on which the first layer has been deposited is taken out of said first film-forming chamber as it stands kept in vacuum.

8. The electrophotographic photosensitive member production process according to claim 1, wherein, in said second step, the cylindrical substrate on which the first layer has been deposited is first taken out of said first film-forming chamber and then exposed to a gas containing oxygen and water vapor.

9. The electrophotographic photosensitive member production process according to claim 8, wherein said gas containing oxygen and water vapor is the atmosphere.

10. The electrophotographic photosensitive member production process according to claim 1, wherein said third step comprises the step of further depositing a surface layer on said upper-part blocking layer.

11. The electrophotographic photosensitive member production process according to claim 10, wherein said surface layer comprises a non-single-crystal material composed chiefly of silicon atoms and containing at least one of carbon atoms, oxygen atoms and nitrogen atoms.

12. The electrophotographic photosensitive member production process according to claim 10, wherein said surface layer comprises a non-single-crystal material composed chiefly of carbon atoms.

13. The electrophotographic photosensitive member production process according to claim 1, wherein said first film-forming chamber is of a plasma-assisted CVD system employing a VHF band in high-frequency power.

14. The electrophotographic photosensitive member production process according to claim 1, wherein said second film-forming chamber is of a plasma-assisted CVD system employing an RF band in high-frequency power.

15. The electrophotographic photosensitive member production process according to claim 1, wherein at least a first region of a photoconductive layer is deposited as said first layer, and at least a second region of the photoconductive layer and said upper-part blocking layer are deposited as said second layer.

16. The electrophotographic photosensitive member production process according to claim 1, wherein said second step further comprises a step of working the surface of said first layer.

17. The electrophotographic photosensitive member production process according to claim 16, wherein said step of working the surface of said first layer is a step of removing at least hill portions of protuberances present on the surface of the first layer having been deposited in said first step.

18. The electrophotographic photosensitive member production process according to claim 16, wherein said step of working the surface of said first layer is a step of polishing.

19. The electrophotographic photosensitive member production process according to claim 18, wherein said polishing is to polish the protuberances present on the surface of the first layer having been deposited in said first step, to make the surface flat.

20. The electrophotographic photosensitive member production process according to claim 18, wherein said polishing is carried out by bringing a polishing tape into contact with the surface of said first layer having been deposited in said first step, by means of an elastic rubber roller, providing a relative difference in speed between a rotational-movement speed of the first-layer surface rotationally moved together with said cylindrical substrate and a rotational-movement speed of the elastic rubber roller which brings the polishing tape into contact with that surface.

21. The electrophotographic photosensitive member production process according to claim 18, wherein said polishing is so applied as to work the outermost surface of said first layer to have an arithmetic mean roughness Ra measured in a visual field of 10 μm×10 μm of 25 nm or less.

22. The electrophotographic photosensitive member production process according to claim 16, wherein the step of working the surface of said first layer is a step of plasma etching.

23. The electrophotographic photosensitive member production process according to claim 12, wherein the step of depositing said surface layer is carried out in a third film-forming chamber having an evacuation means and a source gas feed means and capable of being made vacuum-airtight.

24. The electrophotographic photosensitive member production process according to claim 1, wherein, in said second step, an unfinished photosensitive member with said first layer deposited thereon is subjected to inspection.

25. The electrophotographic photosensitive member production process according to claim 1, wherein, in said second step, before said third step is carried out, the surface of said first layer is brought into contact with water to carry out cleaning.

26. An electrophotographic photosensitive member produced by the process according to claim 1.

27. An electrophotographic apparatus which makes use of the electrophotographic photosensitive member according to claim 26.

28. An electrophotographic photosensitive member comprising:

a cylindrical substrate having a conductive surface;

a first layer comprising a photoconductive layer; and a second layer comprising an upper-part blocking layer formed of a non-single-crystal material composed chiefly of silicon atoms and containing an element belonging to Group 13 or Group 15 of the periodic table, said first layer being a layer from which hill portions of spherical protuberances present on its surface have been removed, wherein said upper-part blocking layer comprises a non-single-crystal material composed chiefly of silicon atoms and containing at least one of carbon atoms, oxygen atoms and nitrogen atoms, and wherein said element belonging to Group 13 or Group 15 of the periodic table is incorporated in said upper-part blocking layer in a content of from 100 atomic ppm or more to 30,000 atomic ppm or less.

29. An electrophotographic photosensitive member according to claim 28, wherein said upper-part blocking layer is in a thickness of at least $10^{-4}$ times a diameter of the largest spherical protuberance among protuberances present on the surface of said first layer, and in a thickness of 1 μm or less.

30. An electrophotographic photosensitive member according to claim 28, wherein said first layer comprises a lower part blocking layer formed of a non-single-crystal material composed chiefly of silicon atoms and containing an element belonging to Group 13 or Group 15 of the periodic table.

31. An electrophotographic photosensitive member according to claim 28, wherein said second layer comprises a surface layer formed of a non-single-crystal silicon carbide or a surface layer formed of a non-single-crystal carbon.

* * * * *

UNITED STATES PATENT AND TRADEMARK OFFICE

CERTIFICATE OF CORRECTION

PATENT NO. : 7,033,717 B2
APPLICATION NO. : 10/630772
DATED : April 25, 2006
INVENTOR(S) : Satoshi Kojima et al.

It is certified that error appears in the above-identified patent and that said Letters Patent is hereby corrected as shown below:

COLUMN 2:
Line 46, “come” should read --become--.

COLUMN 3:
Line 40, “remains” should read --remain--.
Line 44, “are” should read --is--.
Line 60, “come” should read --become--.

COLUMN 6:
Line 27, “come” should read --become--.

COLUMN 9:
Line 39, “that” should read --so that--.

COLUMN 13:
Line 43, “is” should read --are--.
Line 44, “SiF4” should read --$SiF_4$--.

COLUMN 14:
Line 17, “$P2H_4$” should read --$P_2H_4$--.

COLUMN 19:
Line 45, “comes” should read --becomes--.

COLUMN 20:
Line 40, “aimed” should read --aimed for--.
Line 51, “any” should read --for any--.

COLUMN 22:
Line 8, “optionally incorporated with” should read --optionally incorporate--.

COLUMN 24:
Line 26, “once” should read --first--.

UNITED STATES PATENT AND TRADEMARK OFFICE

CERTIFICATE OF CORRECTION

PATENT NO. : 7,033,717 B2
APPLICATION NO. : 10/630772
DATED : April 25, 2006
INVENTOR(S) : Satoshi Kojima et al.

It is certified that error appears in the above-identified patent and that said Letters Patent is hereby corrected as shown below:

COLUMN 43:
Line 34, "Example," should read:
--Example, photosensitive members A-10A to A-l0F were produced in which their upper-part blocking layers were so formed as to be different in layer thickness by changing film formation time.

Table A-24

| | Upper-part blocking layer | Surface layer |
|---|---|---|
| Source gas and flow rate: | | |
| $SiH_4$ [m1/min(normal)] | 70 | 30 |
| $B_2H_6$ (ppm) (based on $SiH_4$) | 10,000 | - |
| $CH_4$ [ml/min(normal)] | 490 | 400 |
| Substrate temperature: | | |
| (°C) | 280 | 280 |
| Reactor internal pressure: | | |
| (Pa) | 80 | 80 |
| High-frequency power: | | |
| (W) | 300 | 100 |
| Layer thickness: | | |
| (μm) | 0.003 to 1.5 | 0.5 |

The negative-charging photosensitive members obtained following the above procedure were evaluated in the same manner as in Example A-l, on the size of the spherical protuberances was further evaluated. The surface of the first layer seen through the surface layer and upper-part blocking layer was observed with an optical microscope to examine the diameter of the largest spherical protuberance. As the result, it was found that, under the production conditions of this Example, the diameter was about 80 --

COLUMN 57:
Line 12, "depositions":" should read --deposition";--.

COLUMN 59:
Line 16, "weak," should read --week,--.

COLUMN 63:
Table C-9, "haTLhing" should read --hatching--.
Line 59, "come" should read --become--.

COLUMN 74:
Line 2, "taken once" should read --first taken--.

UNITED STATES PATENT AND TRADEMARK OFFICE

CERTIFICATE OF CORRECTION

PATENT NO. : 7,033,717 B2
APPLICATION NO. : 10/630772
DATED : April 25, 2006
INVENTOR(S) : Satoshi Kojima et al.

It is certified that error appears in the above-identified patent and that said Letters Patent is hereby corrected as shown below:

COLUMN 78:
Line 65, "were" should read --was--.

COLUMN 79:
Table D-3:

" Example
Ra of first layer surface:
D-1 D-3
3 nm 15 nm 19 nm 15 nm 29 nm"

should read
-- Example

D-1 D-3

Ra of first layer surface:
3 nm 15 nm 19 nm 25 nm 29 nm--.

COLUMN 80:
Line 21, "was" should read --were--.

COLUMN 81:
Line 48, "was" should read --were--.
Line 57, "after" should read --after being--.

Signed and Sealed this

Twenty-first Day of November, 2006

JON W. DUDAS
*Director of the United States Patent and Trademark Office*